US006195077B1

(12) United States Patent
Gyouten et al.

(10) Patent No.: US 6,195,077 B1
(45) Date of Patent: Feb. 27, 2001

(54) DEVICE AND METHOD FOR DRIVING LIQUID CRYSTAL DISPLAY APPARATUS

(75) Inventors: Seijirou Gyouten, Tenri; Yoshinori Ogawa, Yamatotakada, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 08/826,791

(22) Filed: Mar. 24, 1997

(30) Foreign Application Priority Data

Jun. 12, 1996 (JP) ..... 8-151328
Aug. 9, 1996 (JP) ..... 8-211587
Oct. 31, 1996 (JP) ..... 8-290488

(51) Int. Cl.[7] ..... G09G 3/36
(52) U.S. Cl. ..... 345/99; 345/204; 345/100
(58) Field of Search ..... 345/99, 100, 212, 345/214, 95, 98, 94, 58, 90, 204

(56) References Cited

U.S. PATENT DOCUMENTS 5,311,169 5/1994 Inada et al. .
5,325,107 6/1994 Ogawa et al. .
5,398,043 * 3/1995 Takeda et al. ..... 345/94
5,561,442 * 10/1996 Okada et al. ..... 345/94
5,602,560 * 2/1997 Ikeda ..... 345/94
5,754,152 * 5/1998 Nakamura et al. ..... 345/94
5,841,410 * 11/1998 Oda et al. ..... 345/94
5,859,627 * 1/1999 Hoshiya et al. ..... 345/100

FOREIGN PATENT DOCUMENTS 62-43624 2/1987 (JP) .
52-65402 10/1993 (JP) .

* cited by examiner

*Primary Examiner*—Vijay Shankar
*Assistant Examiner*—Mansour M. Said

(57) ABSTRACT

In a liquid crystal display device, a segment side drive circuit supplies display data in: parallel to common electrodes Y1, Y2, Y3, selected by the common side drive circuit on the liquid crystal panel. When the distance to a liquid crystal display cell is increased, electrical resistance of the segment electrode increases and electrical capacitance of each liquid crystal cell increases. Therefore, n output voltage waveform is damped resulting in unevenness in density depending on the position. The controller supplies the segment side drive circuit with a correction clock which changes the pulse width according to the display position. The amount of correction which changes the level of an output voltage output by the segment side drive circuit to an intermediate level is adjusted according to the distance to even effective voltage values of display positions. Thereby, it is possible to eliminate a difference in density between an upper side and a lower side of the liquid crystal panel. It is also possible to adjust the amount of correction by changing the amount of change in the voltage of an intermediate level. It is also possible to make correction by inverting ON and OFF.

18 Claims, 44 Drawing Sheets

DEVICE AND METHOD FOR DRIVING LIQUID CRYSTAL DISPLAY APPARATUS

BACKGROUND OF THE INVENTION

1. Field of the Invention

The present invention relates to a driving device capable of improving display quality in a liquid crystal display apparatus such as a liquid crystal panel of simple matrix type.

2. Description of The Related Art

FIG. 39 shows a schematic electrical configuration for driving a simple matrix type liquid crystal panel 101 of one prior art. A plurality of segment electrodes of the liquid crystal panel 101 are driven in parallel by a segment side drive circuit 102, and a plurality of common electrodes are driven by a common side drive circuit 103 while being selected sequentially. Power voltages supplied from a power supply circuit 104 to the segment side drive circuit 102 and to the common side drive circuit 103 are six voltages V0, V1, V2, V3, V4 and V5, having a relation of V0>V1>V2>V3>V4>V5. The segment side drive circuit 102 is supplied with four voltages V0, V2, V3 and V5, and the common side drive circuit 103 is supplied with four voltages V0, V1, V4 and V5.

Display data which represents an image to be displayed on the liquid crystal panel 101 is given to the segment side drive circuit 102 as serial data by a controller 105. Data latch clock for latching the display data in synchronization with the display data, horizontal synchronization signal and AC-converting signal are also supplied to the segment side drive circuit 102 from the controller 105. The controller 105 supplies horizontal synchronization signal, vertical synchronization signal and AC-converting signal to the common side drive circuit 103. The common side drive circuit 103 selects a common electrode which should display first in response to a vertical synchronization signal, and thereafter scans in the vertical direction by changing the common electrode to be selected successively while synchronizing with the horizontal synchronization signal.

FIG. 40 shows internal configuration of the segment side drive circuit 102 shown in FIG. 39. The display data supplied from the controller 105 as serial data is converted to parallel data by a shift register 121, latched by the data latch 122 according to a data latch clock, and latched in a line latch 123 at every horizontal scanning period according to the horizontal synchronization signal (LP). Output of the line latch 123 is sent to a liquid crystal drive output circuit 126 via a level shifter 124, together with the AC-converting signal which is sent thereto via a level shifter 125. The level shifters 124, 125 are provided because the operating voltage of the liquid crystal drive output circuit 126 is different from operating voltage Vcc of the shift register 121, the data latch 122 and the line latch 123.

FIG. 41 shows voltage waveforms of various portions and voltage waveform applied to a liquid crystal cell of the liquid crystal panel 101 of the prior art shown in FIG. 39. Although FIG. 41 shows a case with seven scan electrodes for the convenience of description, the actual number of scan electrodes is larger than this. The display data stored in the line latch 123 of the segment side drive circuit 102 is given to the liquid crystal drive output circuit 126 via the level shifter 124. The liquid crystal drive output circuit 126 selects one voltage from among liquid crystal drive voltages V0, V2, V3 and V5 of four levels which are input, on the basis of the display data, and applies the voltage to the segment electrode. The outputs of a segment side drive circuit 102 for one scan electrode are applied to the segment electrodes in parallel. On the other hand, the common side drive circuit 103 supplies liquid crystal drive voltages V0 and V5 from among the four liquid crystal drive power voltages V0, V1, V4 and V5 to a selected common electrode, and supplies liquid crystal drive voltages V1 and V4 to non-selected common electrodes.

The liquid crystal panel 101 comprises common electrodes and segment electrodes which have non-zero resistance, while the liquid crystal layer interposed between the electrodes acts as a dielectric substance and has a non-zero capacitance. Consequently, electrical resistance of each electrode wire and a capacitor formed by a display dot where the liquid crystal works as a dielectric form a low-pass filter. Due to the low-pass filter, voltage drop and rounding of waveform become more significant as the distance from the segment side drive circuit 102 increases. Accordingly a difference in voltage drop and rounding of waveform is caused between a pixel on a scan electrode near to the segment side drive circuit 102 and a pixel on a scan electrode far therefrom, thereby causing a difference in the effective voltage applied to the liquid crystal cell and resulting in a difference in the display density. This difference in the display density causes an upper portion and a lower portion of the liquid crystal display surface to appear having different display densities.

There is a trend to increase panel sizes of liquid crystal display apparatuses are for such needs as replacing CRT monitors of personal computers. Also the standard display for the so-called PC-AT compatible computer is in the trend of increasing the number of display dots as the display standard evolves from VGA to SVGA, and from XGA to SXGA, causing the pixel pitch to decrease. Increasing display screen size causes the pixel and scan electrodes to become longer. Further, trend toward higher pixel resolution causes the widths of the pixel and scan electrodes to decrease. As a result, electrical resistances of the pixel and the scan electrodes increase, thereby causing the difference in the display density to increase further.

As a solution to these problems, for example, such prior art may be applied as proposed in the Japanese Unexamined Patent Publication JP-A 62-43624 (1987). In this prior art, a liquid crystal drive voltage which changes in a saw-tooth form as shown in FIG. 42 is used, thereby to change the voltage waveforms of various portions as shown in FIG. 43. In the case that a high drive voltage is applied at every scanning period, the difference in the density of display between the upper portion and the lower portion of the liquid crystal panel when the segment side drive circuit is installed in the upper portion of the liquid crystal panel can be reduced.

Also for the purpose of driving a simple matrix liquid crystal panel, the present applicant proposed a method of driving the segment side drive circuit with a low voltage, for example to enable it to drive with a single power supply of 5V. Operation with this driving method is shown in FIG. 44. The segment side drive circuit selects and outputs one of two voltages, VSH and VSL, according to a combination of the AC-converting signal and the display data, and determines whether to turn on or off the display. The common side drive circuit selects and outputs one of three voltages VCH, VCM and VCL according to the combination of the AC-converting signal and selection or non-selection.

Comparison of the voltage applied to each liquid crystal cell of the liquid crystal panel between FIG. 41 and FIG. 44 shows that the voltages in both driving methods are identical, provided that the following equations hold. This method of driving will be hereinafter called 5V driving method.

$V0-V5=VCH-VSL$
$V0-V4=VCH-VSM$
$V0-V3=VCH-VSH$
$(V4-V4, V1-V1)=(VCH=VSM)=0$
$(V4-V5, V1-V2)=VCM-VSL$
$(V4-V3, V1-V0)=VCM-VSH$
$V5-V2=VCL-VSL$
$V5-V1=VCL-VSH$
$V5-V0=VCL-VSH$

With this 5V driving method, too, there arises differences in the density between pixels in the upper portion and lower portion of the liquid crystal panel, as in the prior art described above. The problem of difference in the density can be solved by applying prior art disclosed in JP-A 62-43624.

Disclosed in the Japanese Unexamined Patent Publication JP-A 5-265402 (1993) is prior art of reducing unevenness in brightness of display which is dependent on the display pattern when driving a simple matrix liquid crystal panel. In this prior art, when driving a simple matrix liquid crystal panel, correction periods are provided for all outputs of a column side drive device which corresponds to the segment side at every scanning period of one line, and a correction voltage of an intermediate level between ON display voltage level and OFF display voltage level is output, instead of the display voltage which is output from the column side drive device. According to this prior art, although the unevenness in brightness which depends on the display pattern is reduced, the problem of difference in density between the upper portion and the lower portion of the liquid crystal panel cannot be solved.

In the common side drive circuit, similar to the segment side drive circuit, the drive voltage changes significantly as the distance from the drive circuit increases. Consequently, rounding of the waveform of the drive voltage becomes more significant, resulting in a difference in the density of display between the left side and the right side of the liquid crystal panel. Also since rounding of the waveform of the drive voltage becomes more significant, difference in the effective voltage increases depending on the display pattern. As the difference in the effective voltage increases, shadowing which represents the unevenness in the brightness dependent on the display pattern appears markedly.

Application of the prior art disclosed in JP-A 62-43624 for the elimination of difference in display density due to the distance from the segment side drive device leads to changes in greater voltage range as the distance increases. As a result, rounding of the waveform of the drive voltage becomes more significant and the difference in the effective voltage increases depending on the display pattern, thereby causing shadowing representing the unevenness in the brightness which depends on the display pattern to appear markedly, leading to degradation in the display quality and other problems.

With the prior art disclosed in the JP-A 5-265402, although the unevenness in brightness which depends on the display pattern can be reduced, the problem of difference in display density between the upper portion and the lower portion of the liquid crystal panel, for example, due to the difference in the distance from the drive circuit cannot be solved, resulting in unevenness in density depending on the display area of the display panel which degrades the display quality. Particularly, since a correction period is always provided for every scanning period, frequency of changes in the waveform increases thus leading to increasing effect of rounding of the waveform caused by the increased electrical resistance and increased capacitance due to the increase in the distance, thereby making the unevenness in brightness likely to occur.

In the common side drive circuit, similar to the case of the segment side drive circuit, variation in the drive voltage increases as the distance from the drive circuit increases. Consequently, there has been such a problem as rounding of the drive voltage waveform becomes more significant resulting in difference in the display density between the left side and right side of the liquid crystal panel. Also since rounding of the waveform of the drive voltage becomes more significant, difference in the effective voltage increases depending on the display pattern. As the difference in the effective voltage increases, shadowing representing the unevenness in the brightness which depends on the display pattern appears markedly, resulting in degraded display quality and other problems.

SUMMARY OF THE INVENTION

An object of the invention is to provide a drive device for a liquid crystal display apparatus which is capable of reducing the difference in display density corresponding to the distances from the segment and common drive circuits and reducing the unevenness in brightness depending upon on the display pattern.

The invention provides a drive device for driving a liquid crystal display apparatus in which a segment side drive circuit for driving a plurality of pixel columns in parallel according to display data and a common side drive circuit for selecting sequentially to drive scanning lines in a pixel line direction in every scanning period are arranged in the periphery of a liquid crystal panel to perform display, the drive device comprising:

correction period setting means for setting a correction period to correct a level of an output voltage of the segment side drive circuit in every scanning period so that an effective value thereof decreases during ON display and increases during OFF display; and output control means for adjusting an amount of correction for the output voltage of the segment side drive circuit according to a distance between an arrangement position of the segment side drive circuit and a position of a scanning line selected by the common side drive circuit in the liquid crystal panel.

According to the invention, the output control means controls the amount of correction in the correction period, which is set for every scanning period by the correction period setting means, according to a distance between the arrangement position of the segment side drive circuit and the position of the scanning line selected by the common side drive circuit in the liquid crystal panel. Since the output of the segment side drive circuit is supplied via segment electrode wires of the liquid crystal panel to the liquid crystal cell which forms each pixel, although rounding of the waveform caused by the electrical resistance of the segment electrode wire and the capacitance of each liquid crystal cell which is connected to the segment electrode wire becomes more significant as the length of the segment electrode wire increases, effect of the rounding of waveform due to the difference in distance is mitigated by adjusting the amount of correction which reduces the effective value of the output voltage during ON display and increases the effective value during OFF display. This thereby makes it possible to give good display with less unevenness in density as a whole.

Also since all outputs change in the correction period, distortion of waveform is made almost uniform regardless of the display pattern, thereby making it possible to reduce the unevenness in display brightness which depends on the display pattern.

The invention is characterized in that the output control means adjusts the amount of correction for the output voltage to drive each pixel column by the segment side drive circuit, according to the distance of the pixel column from the arrangement position of the common side drive circuit.

According to the invention, the output control means adjusts the amount of correction for the output voltage according to the distance between the position of the segment side drive circuit and the position of the scanning line selected by the common side drive circuit in the liquid crystal panel, and also adjusts the amount of correction for the output voltage according to the distance of the pixel column from the position of the common side drive circuit. Consequently, an output of the segment side drive circuit is adjusted according not only to the distance from the segment side drive circuit but also to the distance from the common side drive circuit, so that the effect of rounding of waveform due to the difference in distance from the segment side drive circuit and the common side drive circuit is mitigated and the difference in density between the upper portion and lower portion of the liquid crystal panel and between the left side and right side of the liquid crystal panel is reduced, making it possible to give good display with less unevenness in density as a whole. Also since all outputs change in the correction period, distortion of waveform is made almost uniform regardless of the display pattern, making it possible to reduce the unevenness in display brightness which depends on the display pattern.

Further the invention is characterized in that the correction period setting means controls the correction period so that the correction period decreases as the distance of the pixel column from the position of the common side drive circuit increases.

According to the invention, the correction period is decreased as the distance of the pixel column from the position of the common side drive circuit increases, and therefore even when the distance between the common side drive circuit and the pixel column increases thereby increasing the loss in output from the segment side drive circuit, the increase in loss is compensated for thereby making it possible to reduce the difference in density as a whole.

Further the invention is characterized in that the correction period setting means decreases the correction period for each of the plurality of pixel columns.

According to the invention, since the correction period is decreased for each of a plurality of pixel columns when a large number of pixel columns are provided in the liquid crystal panel and there is small differences in the distance between each pixel columns and the common side drive circuit, the configuration of the segment side drive circuit can be simplified.

Further the invention is characterized in that the output control means changes the output voltage level of the segment side drive circuit to an intermediate level between an ON display level and an OFF display level.

According to the invention, effect of rounding of waveform due to the distance between the arrangement position of the segment side drive circuit and the position of the scanning line selected by the common side drive circuit in the liquid crystal panel can be mitigated by changing the output voltage level of the segment side drive circuit to an intermediate level between ON display level and OFF display level, thereby making it possible to provide a good display with less unevenness in density as a whole.

Further the invention is characterized in that the output control means makes the intermediate level identical with that of a non-selection voltage which is derived for a non-selected scanning line from the common side drive circuit.

According to the invention, since the intermediate level is made identical with the non-selection voltage provided in the common side drive circuit, it is not necessary to specifically supply mid-level voltage, making it possible to give high-quality display at a low cost.

Further the invention is characterized in that the output control means controls an amount of change in the voltage of the intermediate level so that the amount of change decreases as the distance between the arrangement position of the segment side drive circuit and the position of the scanning line selected by the common side drive circuit in the liquid crystal panel increases.

According to the invention, since the change in the intermediate level decreases as the distance increases. The loss which increases as the distance increases can be compensated for. Thus, the difference in density due to the display position is eliminated.

Further the invention is characterized in that the output control means controls the intermediate level to be changed in the correction period in different ways depending whether the output voltage from the segment side drive circuit is at the ON display voltage level or at the OFF display voltage level.

According to the invention, since electric capacity of the liquid crystal cell varies depending on the applied voltage, more proper correction can be done by changing the intermediate level for correction depending on whether the display voltage is ON level or OFF level, thereby making it possible to improve the display quality.

Further the invention is characterized in that the output control means changes the output voltage level of the segment side drive circuit to an OFF display level during ON display and to an ON display level during OFF display, in the correction period.

According to the invention, since the voltage level which the output control means outputs during the correction period becomes ON display level and OFF display level, it can be embodied in a power supply circuit of the prior art which does not output a voltage of intermediate level. Because only a function to invert the level of the display data during correction period is required to be provided, a liquid crystal drive device can be manufactured at a low cost.

Further the invention is characterized in that the output control means controls the correction period to decrease as the distance between the arrangement position of the segment side drive circuit and the position of the scanning line selected by the common side drive circuit in the liquid crystal panel increases.

According to the invention, such correction period is controlled by the output control means so as to be shortened as the distance increases, and therefore even when the loss increases with increasing distance, increment of the loss can be compensated for by the correction, thereby making it made possible to reduce the difference in density as a whole.

The invention further provides a drive method for driving a liquid crystal display apparatus in which a segment side drive circuit for driving a plurality of pixel columns in parallel according to display data and a common side drive circuit for selecting sequentially to drive scanning lines in a pixel line direction in every scanning period are arranged in the periphery of a liquid crystal panel to perform display, the drive method comprising the steps of:

setting at least one correction period for correcting a level of an output voltage of the segment side drive circuit so that an effective value of the output voltage decreases during ON display and increases during OFF display; and adjusting an amount of correction for the level of the output voltage of the segment side drive circuit according to a distance between the position of the segment side drive circuit and the position of a scanning line selected by the common side drive circuit in the liquid crystal panel.

According to the invention, the amount of correction in the correction period which is set for every scanning period is adjusted according to the distance between the arrangement position of the segment side drive circuit and the position of a scanning line selected by the common side drive circuit in the liquid crystal panel. The effect of the rounding of waveform due to the difference in distance is mitigated by adjusting the amount of correction so as to reduce the effective value of the output voltage during ON display and increase the effective value during OFF display, thereby making it possible to give good display with less unevenness in density as a whole. Also since all outputs change in the correction period, distortion of waveform is made almost uniform regardless of the display pattern, making it possible to reduce the unevenness in display brightness which depends on the display pattern.

Further the invention is characterized in that the amount of correction is adjusted according to the distance of the pixel column from the position of the common side drive circuit.

According to the invention, the amount of correction for voltage level which is output during the correction period is adjusted according to the distance between the position of the segment side drive circuit and the position of scanning line selected by the common side drive circuit in the liquid crystal panel, and is also adjusted according to the distance of the pixel column from the position of the common side drive circuit. Consequently, amount of correction for the output voltage level is determined according to the distances from the drive circuits, and the effect of rounding of waveform due to the difference in distance is reduced thereby making it possible to give good display with less unevenness in density as a whole. Also since all outputs change in the correction period, distortion of waveform is made almost uniform regardless of the display pattern, thus making it possible to reduce the unevenness in display brightness which depends on the display pattern.

Further the invention is characterized in that, in the correction period, the output voltage level of the segment side drive circuit is changed to an intermediate level between an ON display level and an OFF display level.

According to the invention, the effect of rounding of waveform due to the distance between the arrangement position of the segment side drive circuit and the position of the scanning line selected by the common side drive circuit in the liquid crystal panel is mitigated by changing the output voltage level of the segment side drive circuit to an intermediate level between ON display level and OFF display level during correction period, thereby making it possible to give good display with less unevenness in density as a whole.

Further the invention is characterized in that, in the correction period, the output voltage level of the segment side drive circuit is changed to an OFF level during ON display and to an ON display level during OFF display.

According to the invention, since the voltage level which is output during the correction period becomes ON display level and OFF display level, it is required only to invert the display data during the correction period, thus making it possible to drive the liquid crystal device at a low cost.

According to the invention, as described above, the amount of correction in the correction period which is set for every scanning period by the correction period setting means is adjusted according to the distance between the segment side drive circuit and the position of the scanning line selected by the common side drive circuit in the liquid crystal panel, and the difference in the display density due to the rounding of waveform can be reduced. Also since all outputs change in the correction period, unevenness in display brightness which depends on the display pattern can be reduced.

Also according to the invention, the amount of correction for the output from the segment side drive circuit during the correction period is adjusted for each scanning period according to the distance between the position of the segment side drive circuit and the position of scanning line selected by the common side drive circuit in the liquid crystal panel, and is also adjusted according to the distance of the pixel column from the position of the common side drive circuit, and therefore unevenness in display density due to rounding of waveform of output voltage is mitigated, making it possible to give good display. Also since the waveforms of all output voltages change in the correction period, the waveform changes uniformly regardless of the display pattern, thus making it possible to reduce the unevenness in display brightness.

Also according to the invention, since length of the correction period is adjusted so as to become shorter as the distance between the common side drive circuit and the pixel column increases, even when the loss in output from the segment side drive circuit increases as the distance increases, the increase in the loss can be compensated for by the correction, thus making it possible to reduce the difference in density as a whole.

Also according to the invention, since the length of the correction period is decreased for a plurality of pixel columns when a large number of pixel columns are provided in the liquid crystal panel and there is small differences in the distance of the pixel columns from the common side drive circuit, the configuration of the segment side drive circuit can be simplified.

Also according to the invention, the effect of rounding waveform due to the position is mitigated by changing the output voltage level from the segment side drive circuit to an intermediate level between ON display level and OFF display level during the correction period, thus making it possible to give good display with less unevenness in density as a whole.

Also according to the invention, since the intermediate level is made identical with the non-selection voltage provided in the common side drive circuit, it is not necessary to specifically supply mid-level voltage from the power source, thus making it possible to give high-quality display at a low cost.

Also according to the invention, since the amount of change to the intermediate level decreases as the distance increases, the loss which increases as the distance increases can be compensated for, thus the difference in density due to the display position is eliminated.

Also according to the invention, although electric capacity of the liquid crystal cell varies depending on the applied voltage, more proper correction can be done to improve the display quality by changing the intermediate level for correction between ON display level and OFF display level.

According to the invention, since the voltage level which is output during correction period becomes ON display level and OFF display level, it can be easily realized with a power supply circuit of the prior art which does not output intermediate level or the like. Because only a function to invert the display data during correction period is required to be provided in the output circuit, a liquid crystal drive device of a low cost can be provided.

Also according to the invention, since the correction period is controlled so as to be shortened as the distance increases, even when loss increases as the distance increases, the increase in loss of voltage can be compensated for, thereby making it possible to reduce the difference in density as a whole.

Further according to the invention, the amount of correction to the intermediate level in the correction period is adjusted according to the distance between the position of the segment side drive circuit which drives a plurality of pixel columns in parallel and the position of pixel on the scanning line selected by the common side drive circuit, thereby to reduce the difference in density due to the distance, for example reducing the difference in density between upper and lower portions of the liquid crystal panel, and the unevenness in display brightness which depends on the display pattern is reduced, making it possible to improve the display quality.

Also according to the invention, the effect of rounding of waveform due to the position is mitigated by changing the output voltage level from the segment side drive circuit to an intermediate level between ON display level and OFF display level during the correction period, thus making it possible to provide a good display with less unevenness in density as a whole.

Also according to the invention, since the voltage level which is output during the correction period becomes ON display level and OFF display level, it is required only to invert the display data during the correction period, thus making it possible to drive the liquid crystal device at a low cost.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
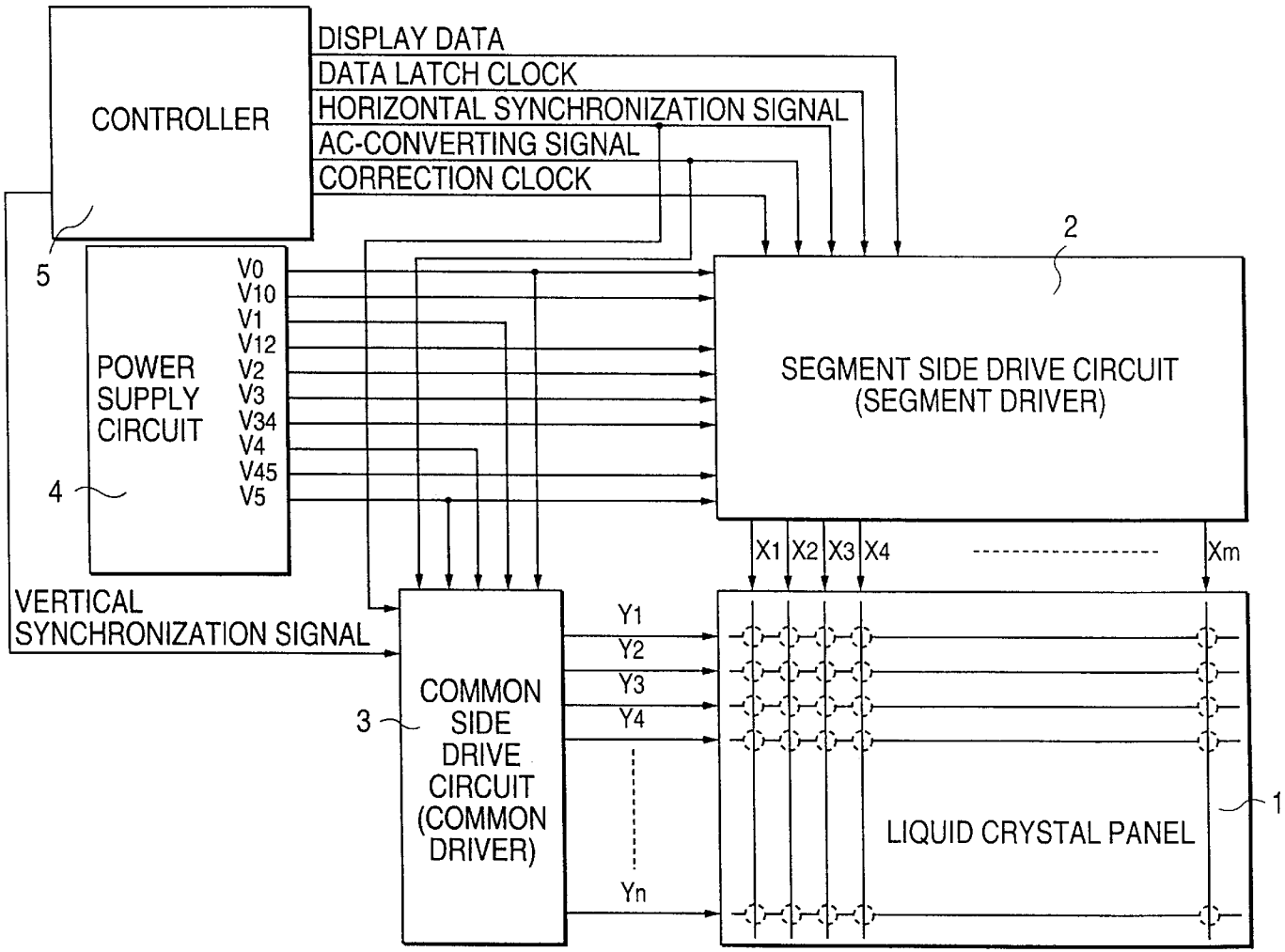
FIG. 1 is a block diagram schematically showing the electrical configuration for driving a liquid crystal panel according to first embodiment of the invention.

Now referring to the drawings, preferred embodiments of the invention are described below.

FIG.1 schematically shows the electrical configuration of a drive device for a liquid crystal display apparatus according to first embodiment of the invention. A liquid crystal panel 1 which displays images is of simple matrix type which displays an image with a pixel located at each intersect of a plurality of segment electrodes X1, X2, X3, X4, . . . , Xm extending in column direction and common electrodes Y1, Y2, Y3, Y4, . . . , Yn which extend in row direction. The segment electrodes are driven in parallel by a segment side drive circuit 2 and the common electrodes which are scanning lines are successively selected and driven by a common side drive circuit 3.

The segment side drive circuit 2 and the common side drive circuit 3 are supplied by a power supply circuit 4 with a plurality of voltages for displaying on the liquid crystal panel 1. The power supply circuit 4 supplies the segment side drive circuit 2 with eight voltages V0, V10, V12, V2, V3, V34, V45 and V5. The eight voltages have a relation of V0>V10>V12>V2>V3>V34>V45>V5. The power supply circuit 4 supplies the common side drive circuit 3 with maximum voltage V0 and the minimum voltage V5 of the voltages applied to the selected common electrode, voltage V1 being V10>V1>V12 applied to non-selected common electrode and voltage V4 being V34>V4>V45.

Display data of each pixel for an image to be displayed on the liquid crystal panel 1 is supplied to the segment side drive circuit 2 by a controller 5 in synchronization with data latch clock. The controller 5 supplies a horizontal synchronization signal and an AC-converting signal to the segment side drive circuit 2 and the common side drive circuit 3. The AC-converting signal drives the liquid crystal panel alternately. The controller 5 also supplies vertical synchronization signal to the common side drive circuit 3. When a vertical synchronization signal is supplied, the common side drive circuit 3 selects the first common electrode Y1 and then successively switches the common electrode to be driven in synchronization with the horizontal synchronization signal. One period of horizontal synchronization signal makes a scanning period. The controller 5 also supplies the segment side drive circuit 2 with correction clock signal which represents the correction period for correcting the output voltage from the segment side drive circuit 2 within each scanning period.

Figure 2:
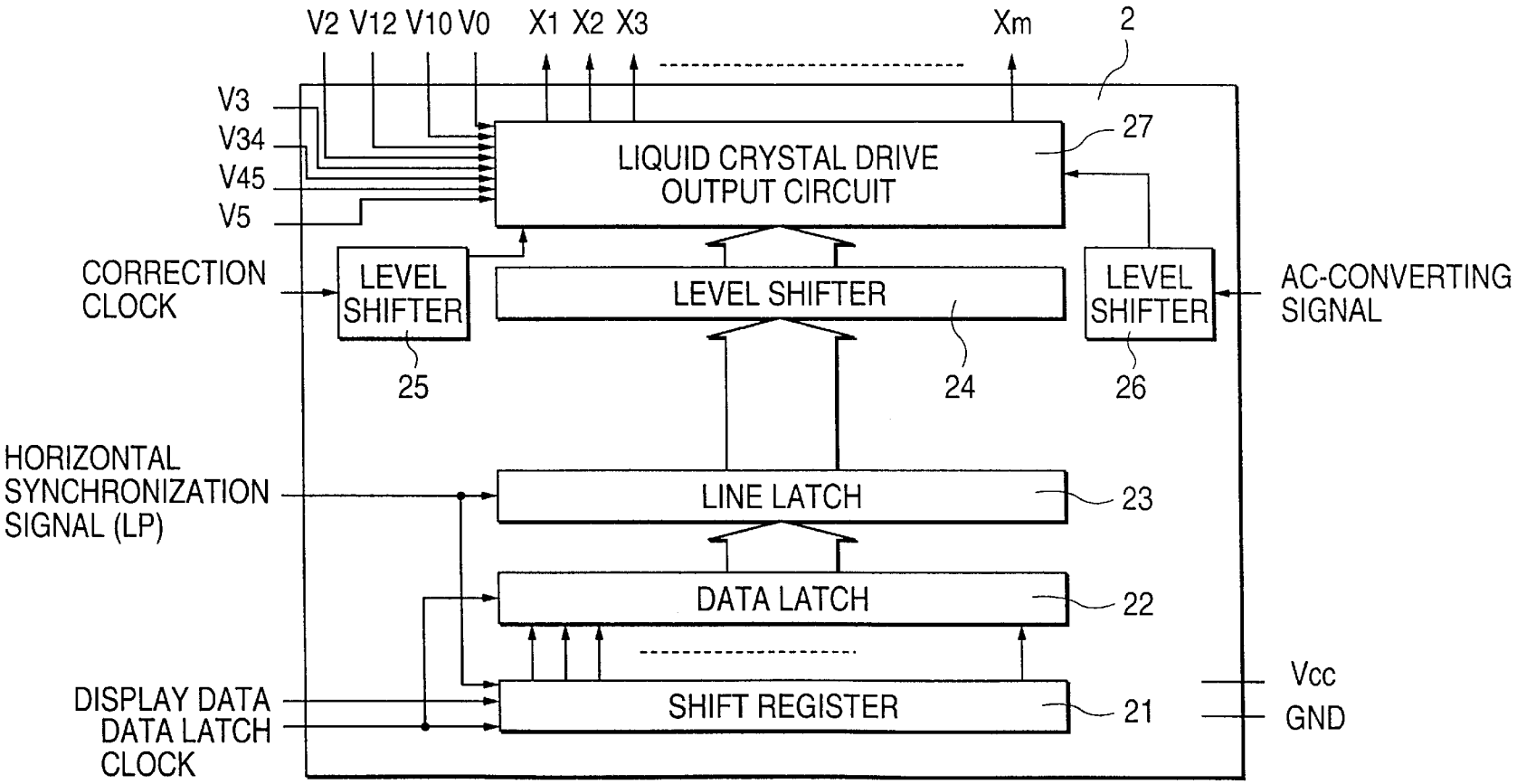
FIG. 2 is a block diagram showing the inner electrical configuration of a segment side drive circuit 2 of FIG. 1.

FIG. 2 shows internal configuration of the segment side drive circuit 2 shown in FIG. 1. The display data is supplied as serial data to a shift register 21 together with data latch clock, and is converted to parallel data. A data latch 22 latches the display data which has been converted to parallel data. A line latch 23 latches m pieces of display data to be displayed on the segment electrodes X1, X2, X3, . . . , Xm in synchronization with the horizontal synchronization signal (LP). The shift register 21, the data latch 22 and the line latch 23 operate with a working power voltage Vcc of ordinary logic circuits, 5V for example, supplied to the segment side drive circuit 2.

Supplied in the segment side drive circuit 2 are the plurality of voltages V0, V10, V12, V2, V3, V34, V45 and V5 for driving the liquid crystal panel 1, which include voltages different from the working power voltage Vcc of ordinary logic circuits. For this reason, level shifters 24, 25, 26 are provided for shifting the voltage from the ordinary logic level to the logic level for driving the liquid crystal panel. The level shifter 24 shifts the level of display data for m segment electrodes which is latched in the line latch 23 and supplies it to the liquid crystal drive output circuit 27. The level shifter 25 supplies a correction clock which is input from the controller 5, to the liquid crystal drive circuit 27 after shifting in level. The level shifter 26 receives the AC-converting signal for driving the liquid crystal panel 1 with alternating current, shifts the level thereof and supplies the level-shifted signal to the liquid crystal drive output circuit 27.

Figure 3:
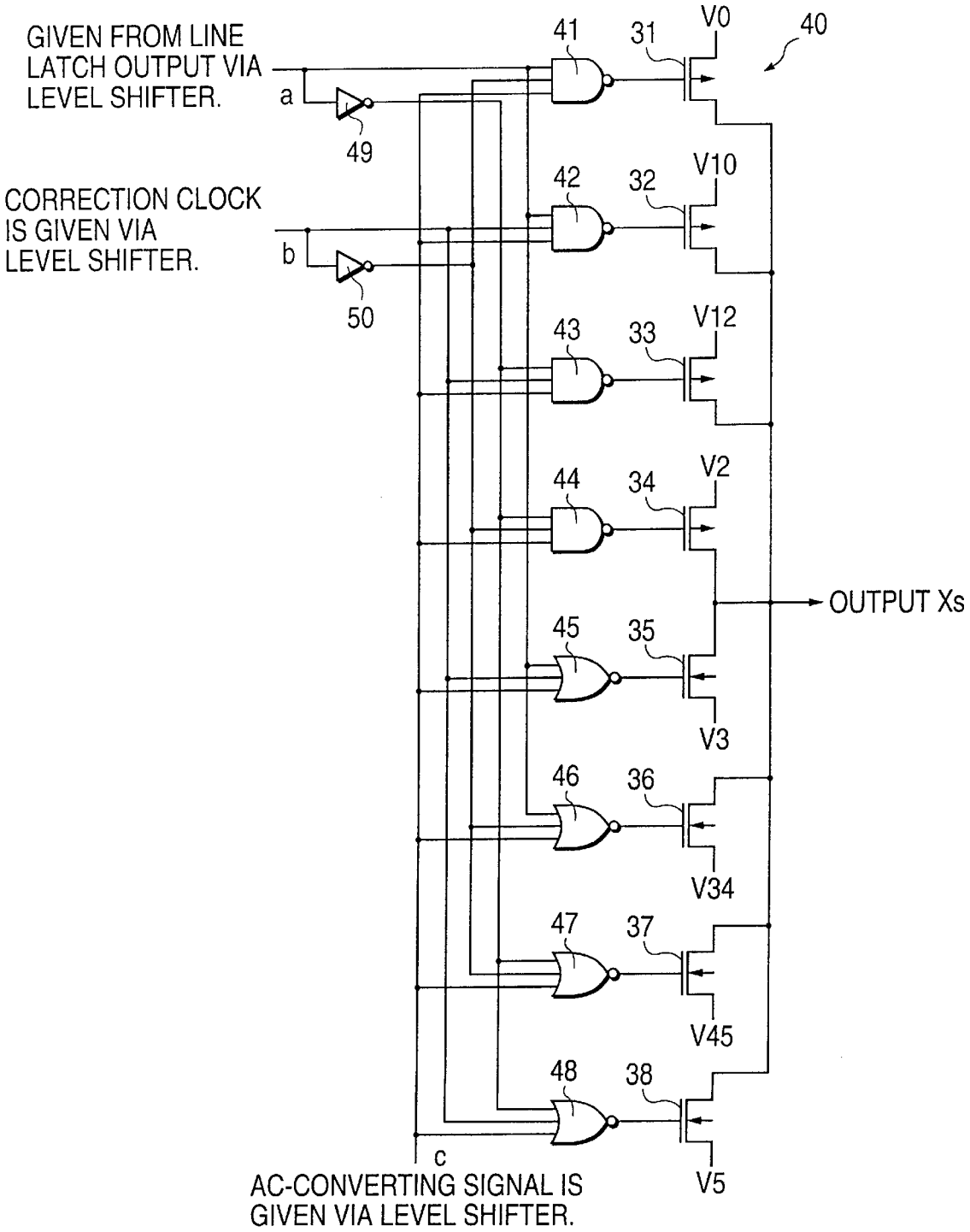
FIG. 3 is an electric circuit diagram of a liquid crystal drive output circuit portion 40 showing the construction for one segment electrode of a liquid crystal drive output circuit 27 of FIG. 2.

FIG. 3 shows liquid crystal drive output circuit portion 40, being the construction for one segment electrode of the liquid crystal drive output circuit 27 shown in FIG. 2. Drain electrodes of P channel MOS transistors 31, 32, 33, 34 and of N channel MOS transistors 35, 36, 37, 38 are connected to each other. The drain electrodes which are connected to each other become output Xs ($1 \leqq s \leqq m$). Source electrodes of the P channel MOS transistors 31, 32, 33, 34 receive voltages V0, V10, V12 and V2 supplied in this order from the power supply circuit 4. Source electrodes of the N channel MOS transistors 35, 36, 37, 38 receive voltages V3, V34, V45 and V5 supplied in this order from the power supply circuit 4.

Connected to gate electrodes of the P channel MOS transistors 31, 32, 33, 34 are output terminals of NAND circuits 41, 42, 43, 44, respectively. Connected to gate electrodes of the N channel MOS transistors 35, 36, 37, 38 are output terminals of NOR circuits 45, 46, 47, 48, respectively. The NAND circuits 41 through 44 and the NOR circuits 45 through 48, including inverter circuits 49, 50, constitute a logic circuit, which receives a line latch output, a correction clock and an AC-converting signal supplied thereto via the level shifters 24, 25, 26, and carries out logical operations according to a truth table such as shown in Table 1. The output of the line latch 23 supplied via the level shifter 24 will be denoted as a, the correction clock signal supplied via the level shifter 25 will be denoted as b and the AC-converting signal supplied via the level shifter 26 will be denoted as c. When signal b which corresponds to the correction clock is "H", namely high level, intermediate voltages V12, V10, V34 and V45 arc output as correction voltages.

TABLE 1

| a | b | c | Vs |
|---|---|---|---|
| L | L | H | V2 |
| L | H | H | V12 |
| H | L | H | V0 |
| H | H | H | V10 |
| L | L | L | V3 |
| L | H | L | V34 |
| H | L | L | V5 |
| H | H | L | V45 |

Figure 4:
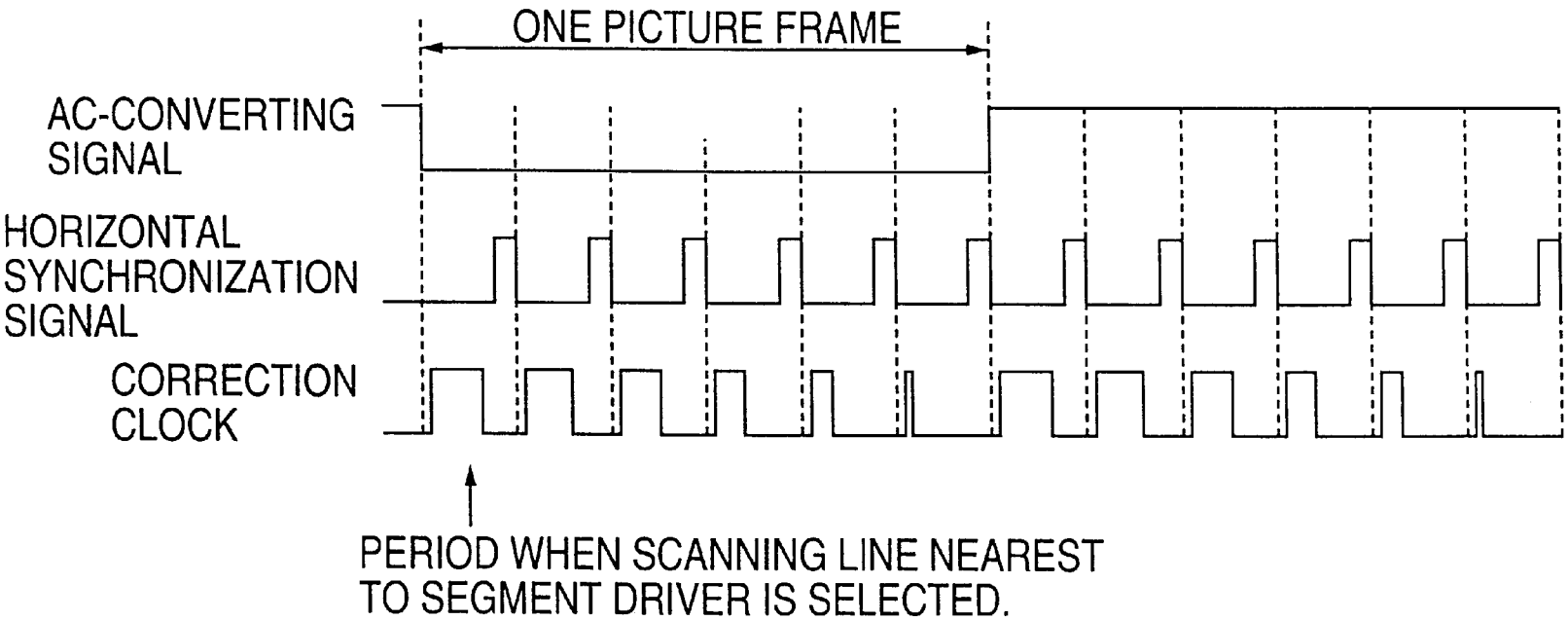
FIG. 4 is a timing chart showing an AC-converting signal, a horizontal synchronization signal and a correction clock given from a controller 5 of FIG. 1 to a segment side drive circuit.

FIG. 4 shows the relationship between an AC-converting signal, an horizontal synchronization signal and a correction clock. Although a case with six scanning lines is shown for the convenience of description, the actual number of the scanning lines is generally larger than this. Assume a case where the segment side drive circuit 2 is located at the top of the liquid crystal panel 1, then a scanning line selected by the common side drive circuit 3 immediately after the signal level of the AC-converting signal is changed is located near the segment side drive circuit 2, and a scanning line selected by the common side drive circuit 3 immediately before the signal level of the AC-converting signal is changed is, located at a position farthest from the segment side drive circuit 2. Pulse width of the correction clock is increased when driving the scanning line nearest to the segment side drive circuit 2, and the pulse width is decreased from one scanning line to the next.

Figure 5:
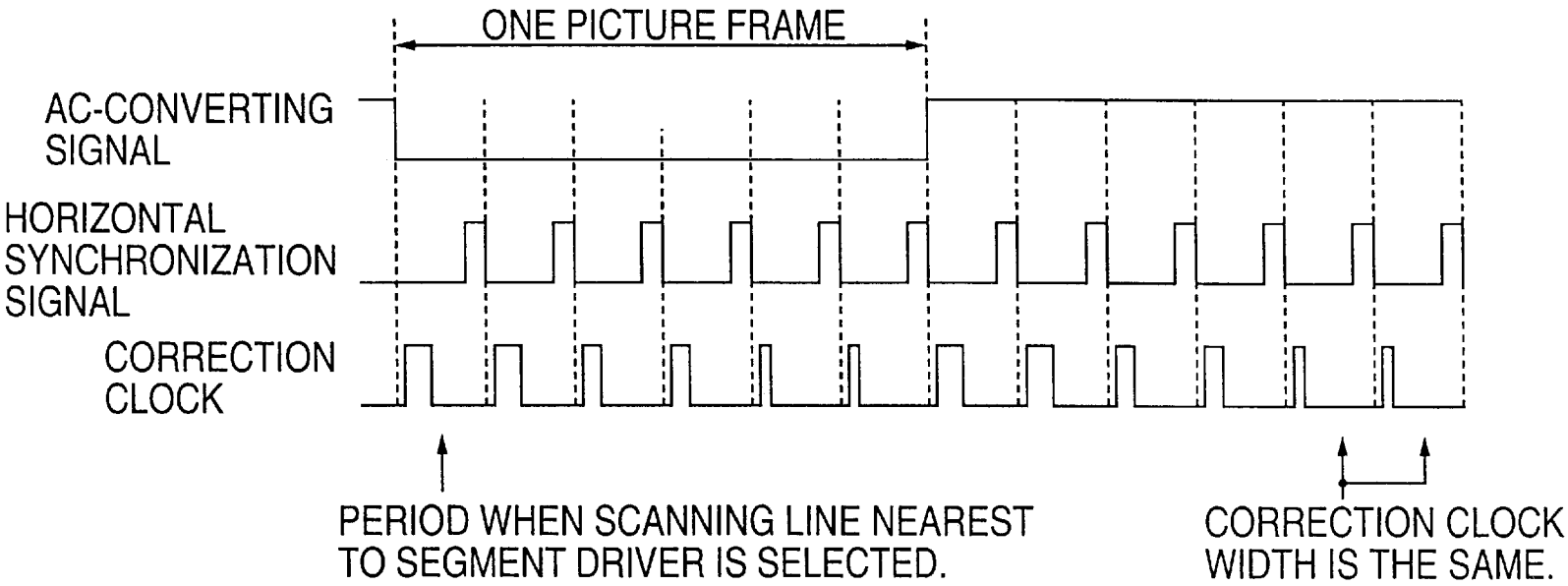
FIG. 5 is a timing chart showing an AC-converting signal, a horizontal synchronization signal and a correction clock given from a controller 5 of FIG. 1 to a segment side drive circuit.

FIG. 5 shows changes in the pulse width of the correction clock in case the pulse width is changed for every two scanning lines, not for every scanning line as in the case of FIG. 4. Such an adjustment by changing the pulse width of the correction clock as in this case can be carried out at intervals of a plurality of scanning lines. When the number of scanning lines is large, it is difficult to change the pulse width at every scanning line as shown in FIG. 4. Also when the number of scanning lines is large, the change in the distance from the segment side drive circuit 2, which is caused by the difference in position between the continuous scanning lines, is small. Therefore, when the number of scanning lines is large, it is desirable to change the pulse width of the correction clock at intervals of a plurality of scanning lines.

Figure 6:
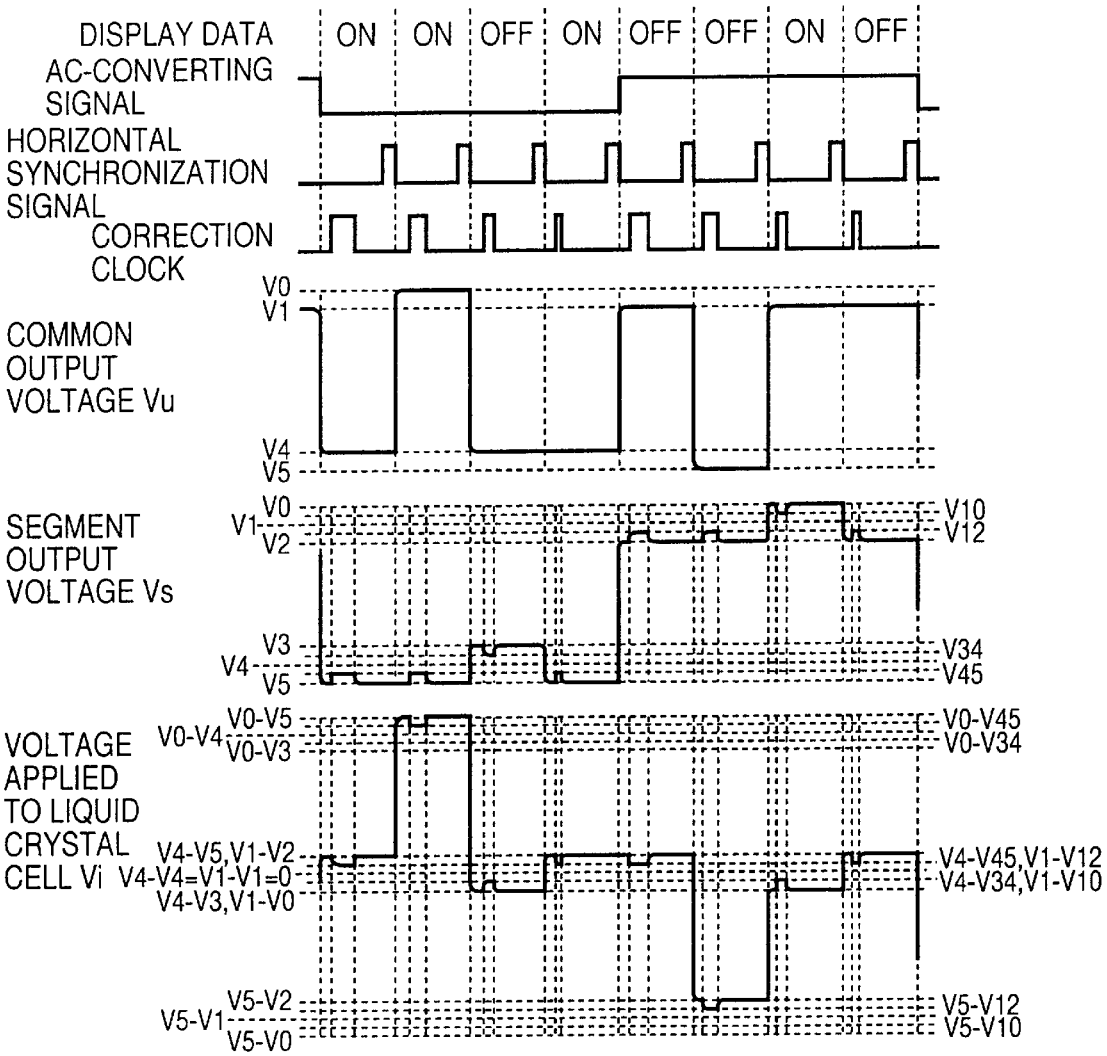
FIG. 6 is a timing chart showing signal waveforms of various portions in the embodiment of FIG. 1.

FIG. 6 shows the waveforms of common output voltage Vu from the common side drive circuit 3 which drives the pixels located on two scanning lines and the display thereof, output voltage Vs from the segment side drive circuit 2 and voltage Vi which is applied to the liquid crystal cell, in a case of four scanning lines. It is assumed that pulse width of the correction clock is decreased from one common electrode to the next. As the pulse width decreases, the period of correction voltage in the segment output voltage Vs becomes shorter.

Although V10, V12, V34 and V45 are used as the correction voltage levels in this embodiment, they may also be

V10=V12=VA

V34=V45=VB with the number of correction voltages being reduced. It is also possible to match the correction voltages to the non-selection voltages V1, V4 from the common side drive circuit 3, being set as follows.

VA=V1

VB=V4

Figure 7:
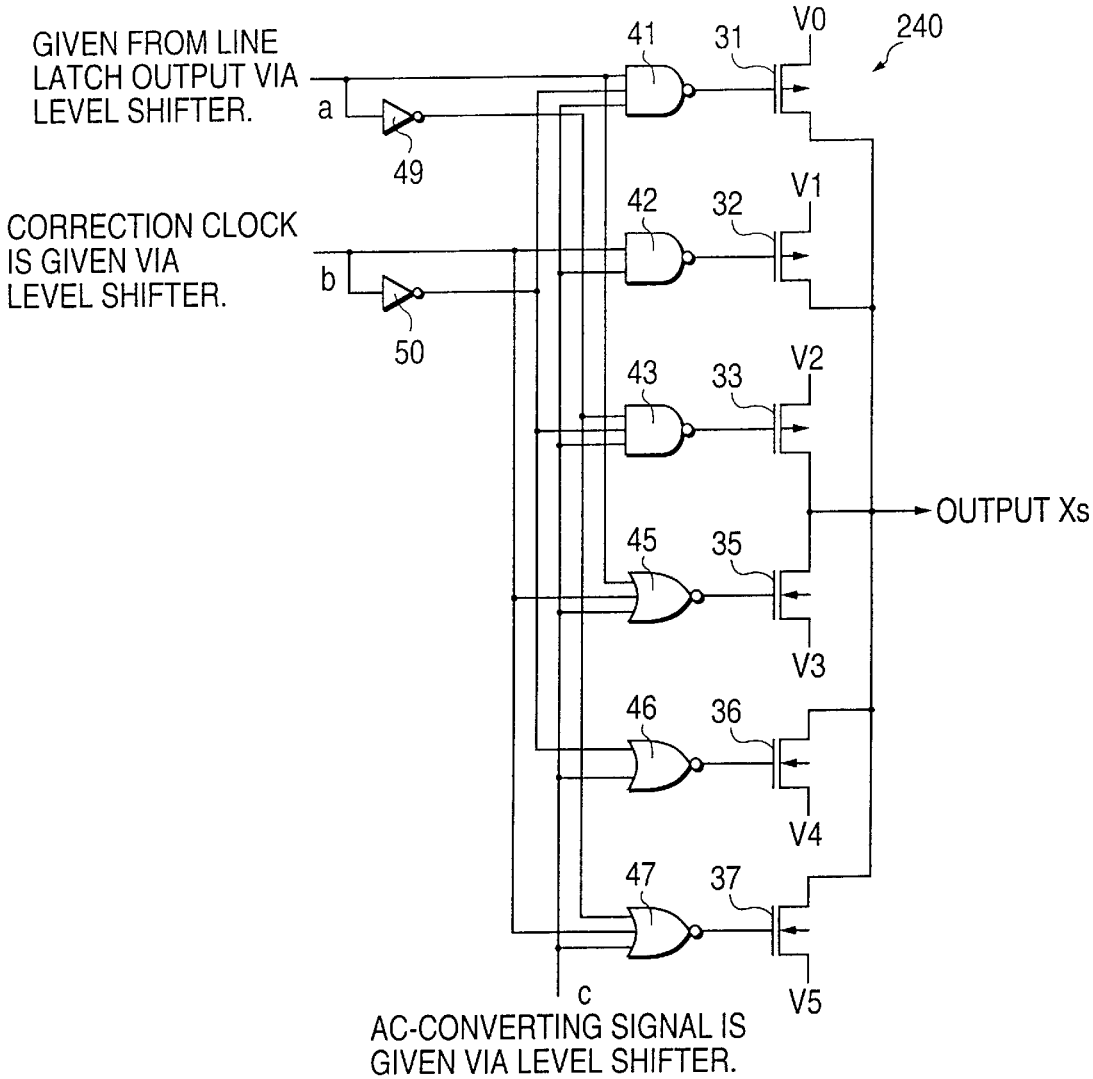
FIG. 7 is an electric circuit diagram showing another construction for one segment electrode of the liquid crystal drive output circuit 27 of the embodiment of FIG. 1.

Liquid crystal drive output circuit portion 240 for one segment electrode in this case is shown in FIG. 7. Components of the output circuit portion 240 identical with those of the output circuit portion 40 shown in FIG. 3 will be given the same reference numerals and description thereof will be omitted. Truth table values of the logic circuit which controls the P channel MOS transistors 31, 32, 33 and the N channel MOS transistors 35, 36, 37 provided in the output circuit portion 240 are shown in Table 2. Signals a, b, c are similar to those in Table 1, and correction voltages V1, V4 are output during a period when the signal b which corresponds to the correction clock is "H".

TABLE 2

| a | b | c | Vs |
|---|---|---|---|
| H | L | H | V0 |
| — | H | H | V1 |
| L | L | H | V2 |
| L | L | L | V3 |
| — | H | L | V4 |
| H | L | L | V5 |

Figure 8:
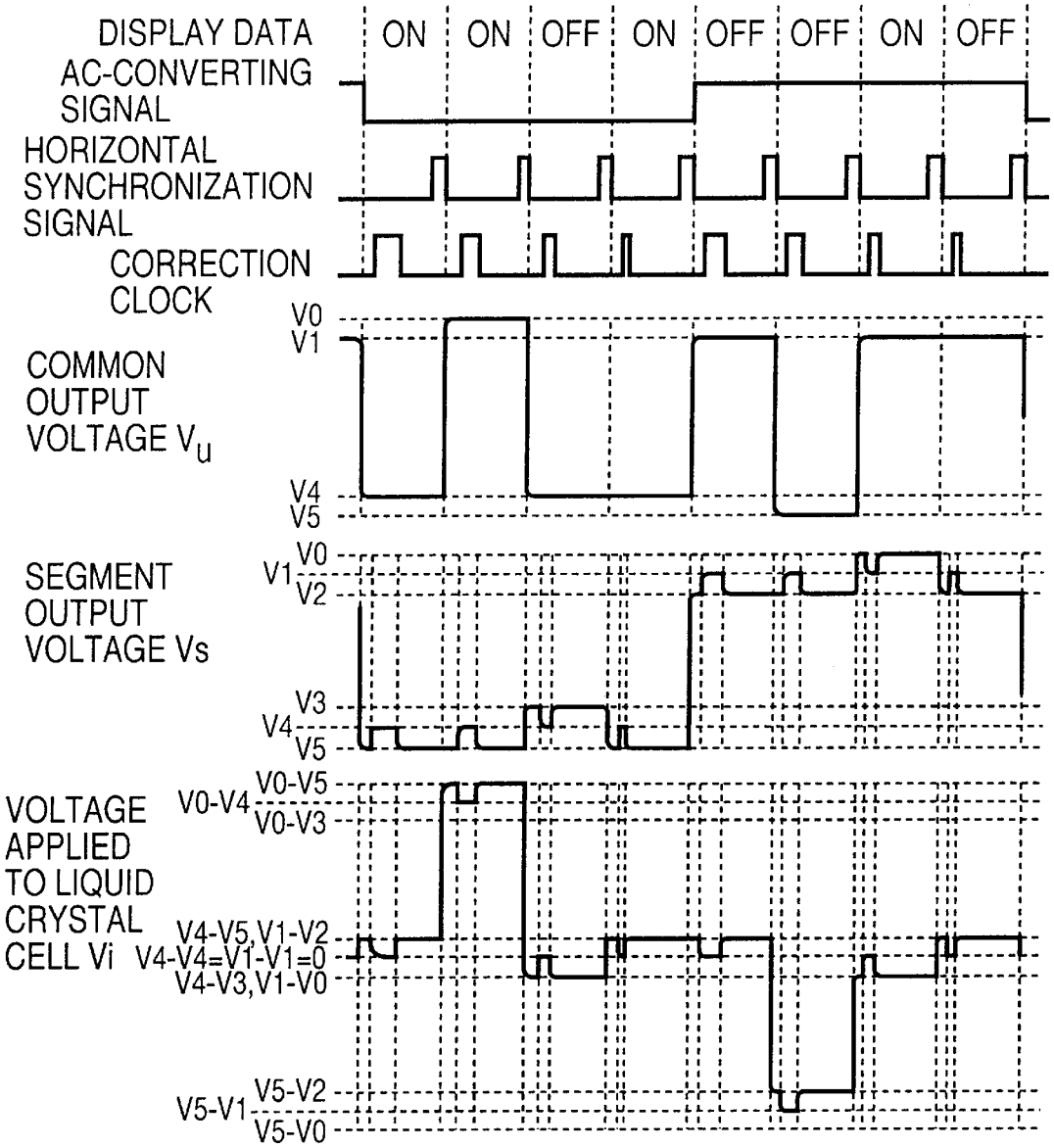
FIG. 8 is a timing chart showing signal waveforms of various portions in the embodiment of FIG. 7.

FIG. 8 shows voltage waveforms of various portions and a voltage applied to the liquid crystal cell when the output circuit portion 240 of FIG. 7 is used. When the correction voltage on ON display voltage level side and the correction voltage on OFF display voltage level side are made different from each other, unevenness in brightness which depends on ON display pattern and unevenness in brightness which depends on OFF display pattern can be reduced. Also when correction voltage is given for every one scanning line, unevenness in brightness which depends on display pattern can be reduced.

Figure 9:
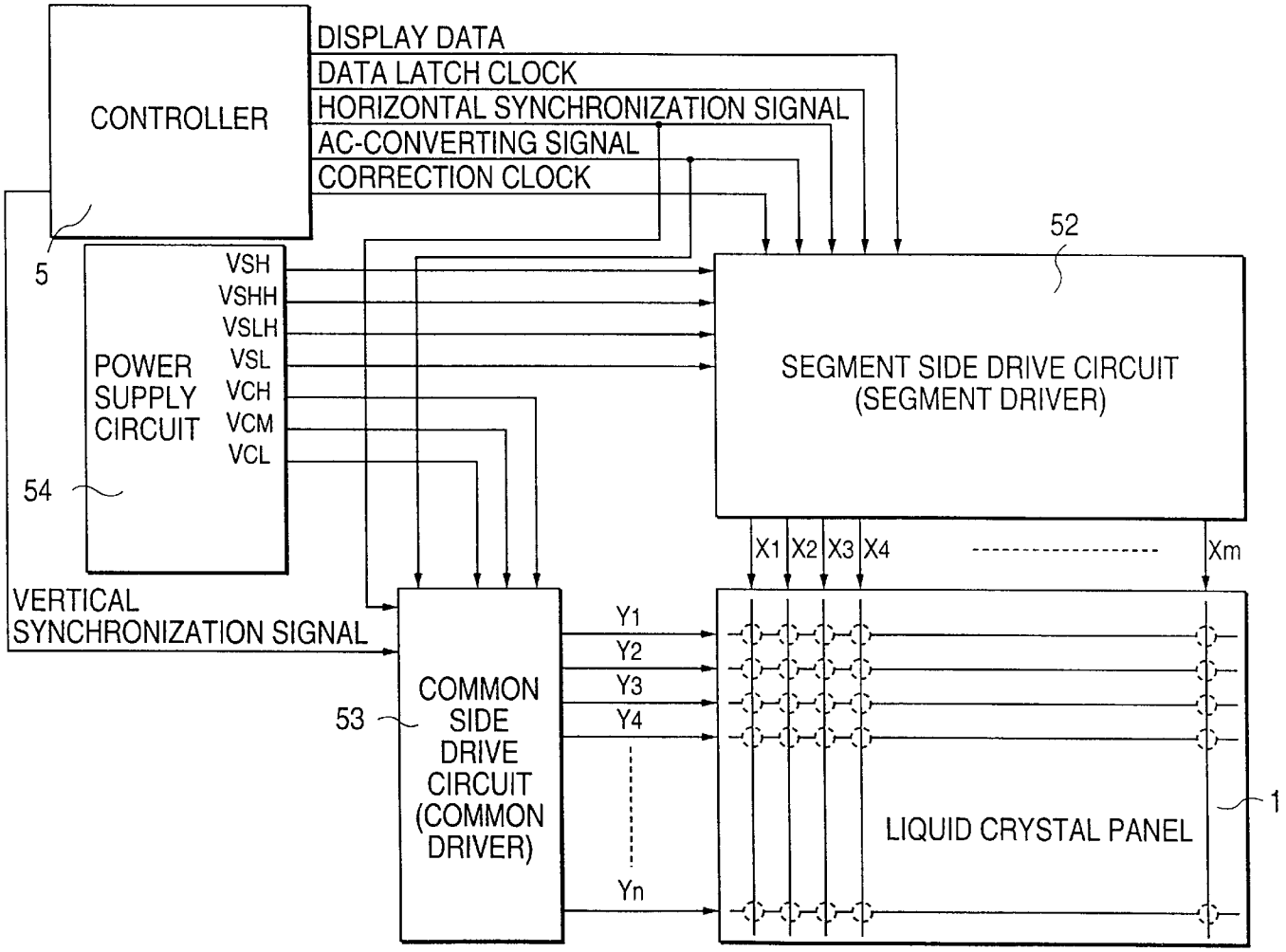
FIG. 9 is a block diagram schematically showing the electrical configuration for driving a liquid crystal panel according to second embodiment of the invention.

FIG. 9 schematically shows the electrical configuration of a drive device for a liquid crystal panel according to the second embodiment of the invention. In this embodiment, a segment side drive circuit 52 is made operate within the range of logic circuit operating voltage which is usually 5V. Because the 5V drive method is employed, although configurations of the segment side drive circuit 52, a common side drive circuit 53 and a power supply circuit 54 are different from those of the embodiment shown in FIG. 1, corresponding portions are given the same reference numerals and similar description will be omitted. The power supply circuit 54 supplies the segment side drive circuit 52 with four levels of voltage, VSH and VSL which are ON and OFF display levels and correction voltage levels VSHH, VSLH. The common side drive circuit 53 is supplied with three levels of voltage; selection voltages VCH, VCL and non-selection voltage VCM.

Figure 10:
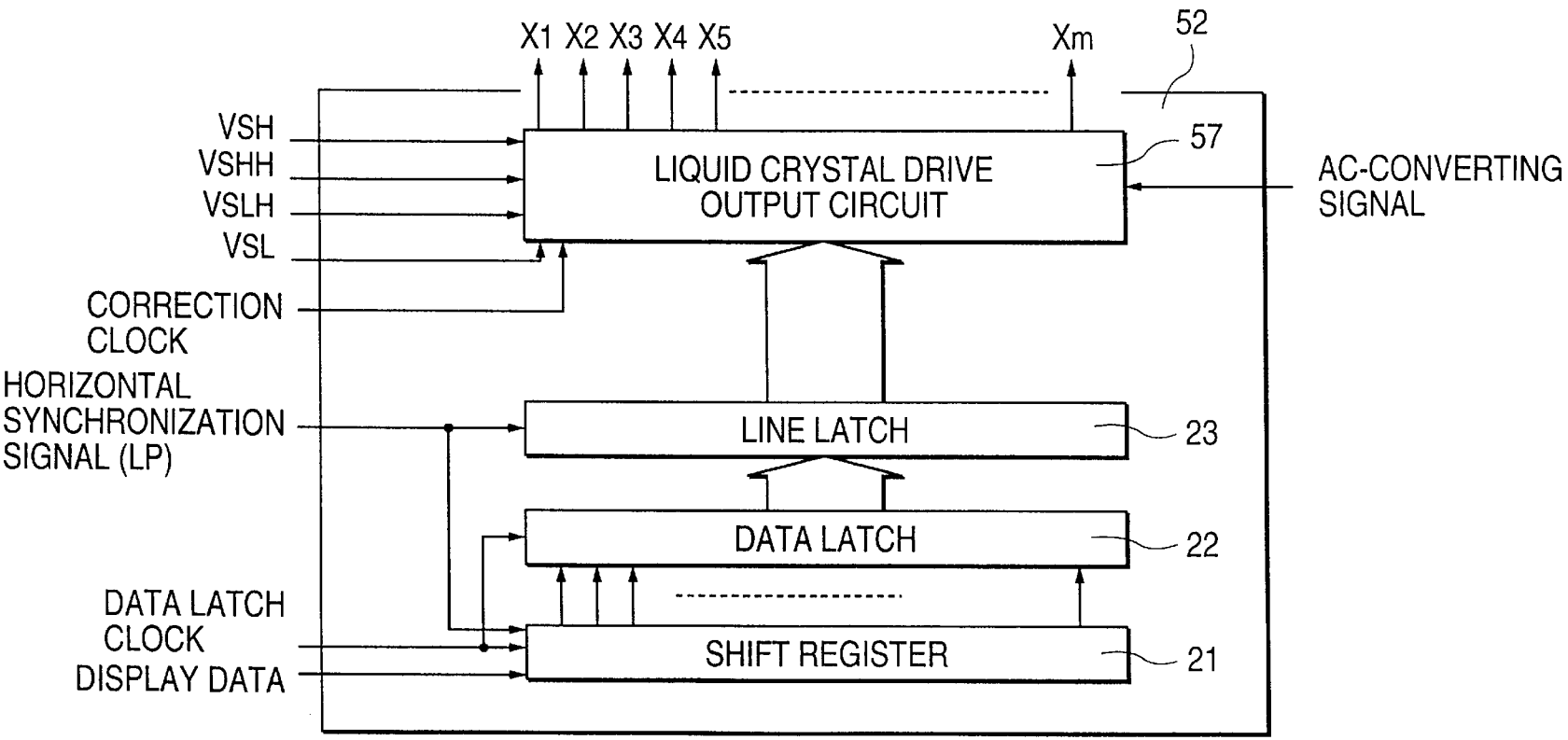
FIG. 10 is a block diagram showing the inner electrical configuration of a segment side drive circuit 52 of FIG. 9.

FIG. 10 shows the internal electrical configuration of the segment side drive circuit 52 shown in FIG. 9. Major difference from the segment side drive circuit 2 shown in FIG. 2 is that the level shifter is not included inside. Because a liquid crystal drive output circuit 57 in the segment side drive circuit 52 in this embodiment operates in a power voltage range similar to that of the shift register 21, the data latch 22 and the line latch 23, an output of the line latch 23 can be directly supplied without the need for level shift.

Figure 11:
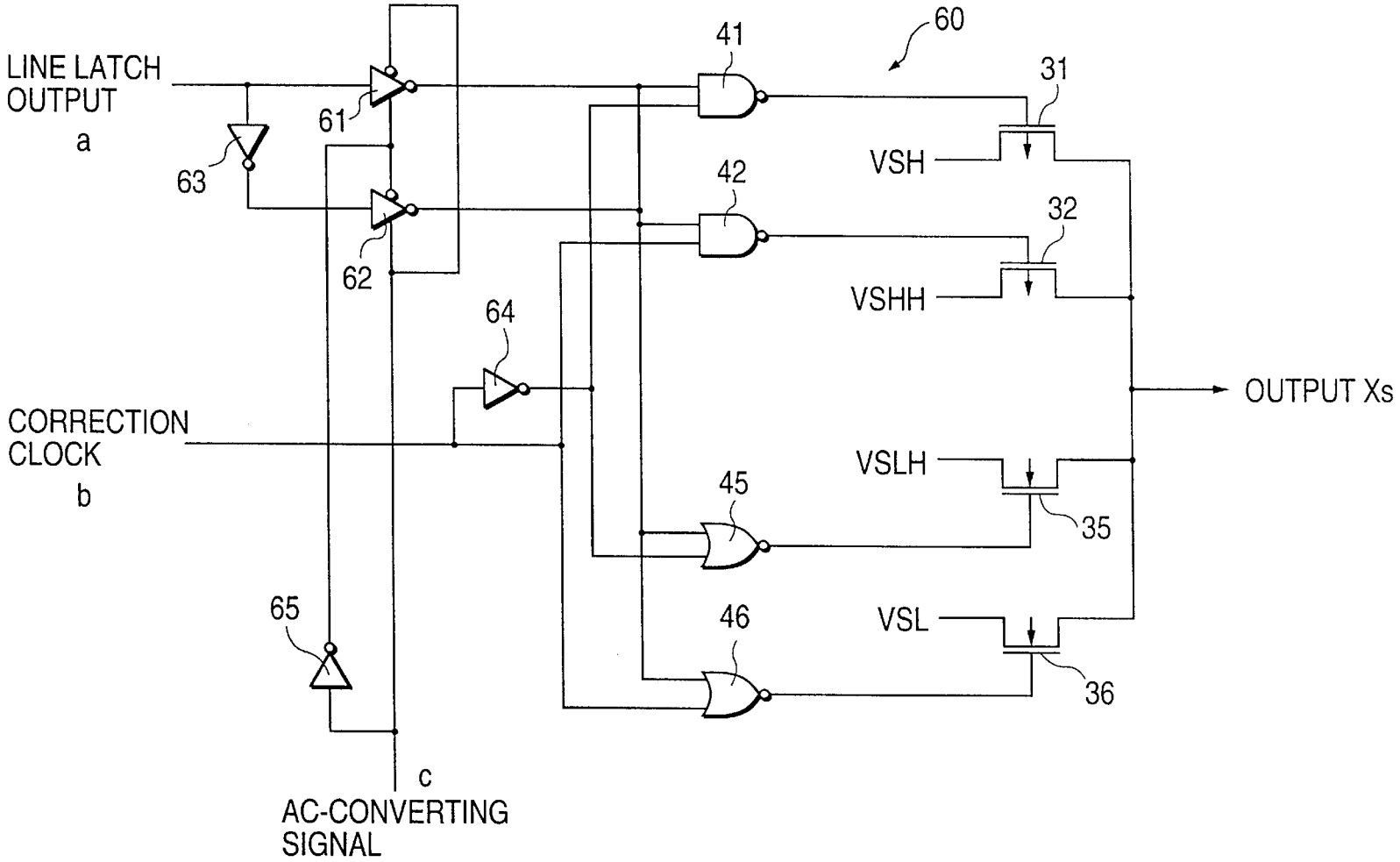
FIG. 11 is an electric circuit diagram of a liquid crystal drive output circuit portion 60 showing the construction for one segment electrode of liquid crystal drive output circuit 57 of FIG. 10.

FIG. 11 shows a liquid crystal drive output circuit portion 60 for one segment electrode of the liquid crystal drive output circuit 57 shown in FIG. 10. Drain electrodes of P channel MOS transistors 31, 32 source electrodes of which are provided with voltages VSH, VSHH supplied from the power source circuit 54, and drain electrodes of N-channel MOS transistors 35, 36 source electrodes of which are provided with voltages VSL, VSLH supplied from the power source circuit 54 are connected in common. The drain electrodes connected in common give an output Xs.

Supplied to one of the inputs of each of the NAND circuits 41, 42 and the NOR circuits 45, 46 are the output of the clocked inverter circuit 61 to which the line latch output a is given and the output of the clocked inverter circuit 62 to which the line latch output a inverted by the inverter circuit 63 is given. Switching between the clocked inverter circuits 61, 62 is carried out by the AC-converting signal c and the output of the inverter circuit 65 obtained by inverting the AC-converting signal c. Supplied to other inputs of the NAND circuit 41 and the NOR circuit 45 is a signal obtained by inverting the correction clock b by the inverter circuit 64. Other inputs of the NAND circuit 42 and the NOR circuit 46 are supplied with the correction clock b as it is. Truth table values representing the operation of these logic circuits are shown in Table 3.

TABLE 3

| a | b | c | Xs |
|---|---|---|---|
| L | L | L | VSH |
| L | H | L | VSHH |
| H | H | L | VSLH |
| H | L | L | VSL |
| H | L | H | VSH |
| H | H | H | VSHH |
| L | H | H | VSLH |
| L | L | H | VSL |

Figure 12:
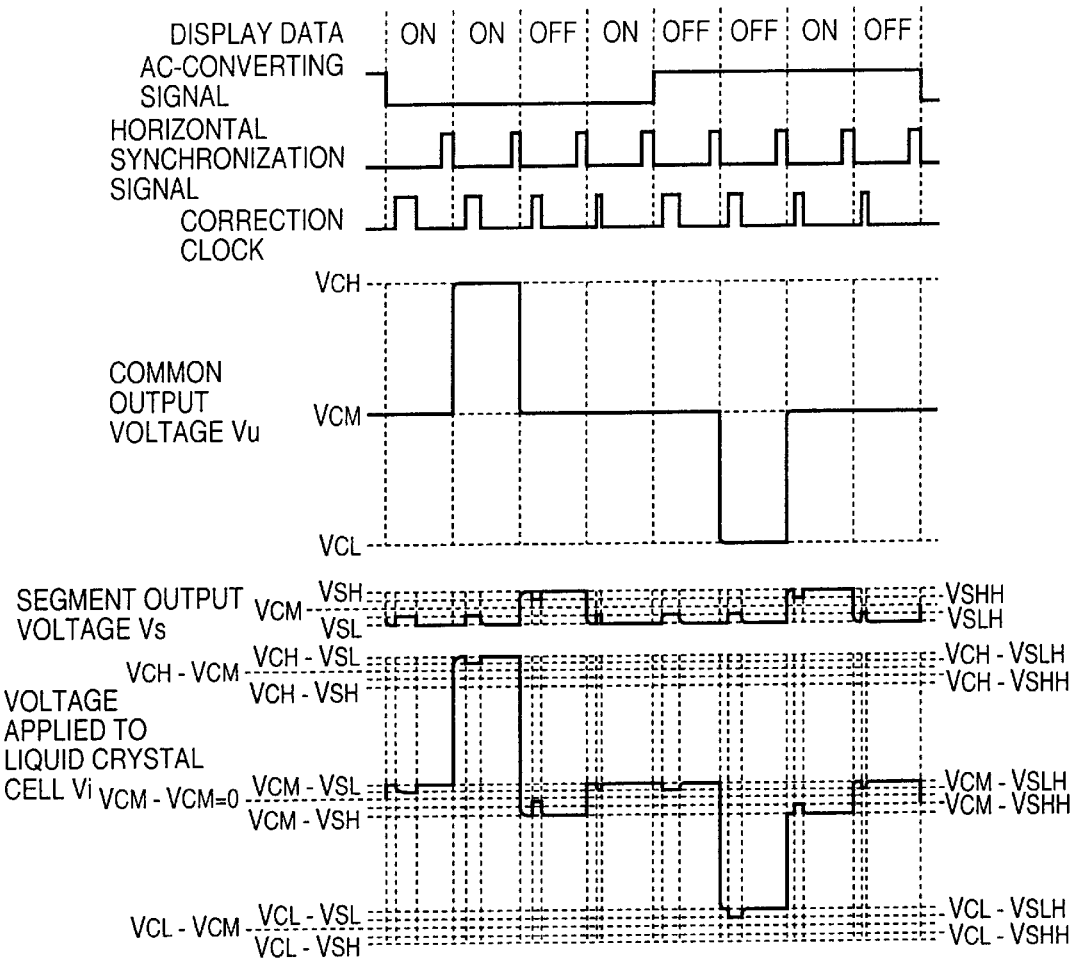
FIG. 12 is a timing chart showing voltage waveforms of various portions in the embodiment of FIG. 9.
Figure 13:
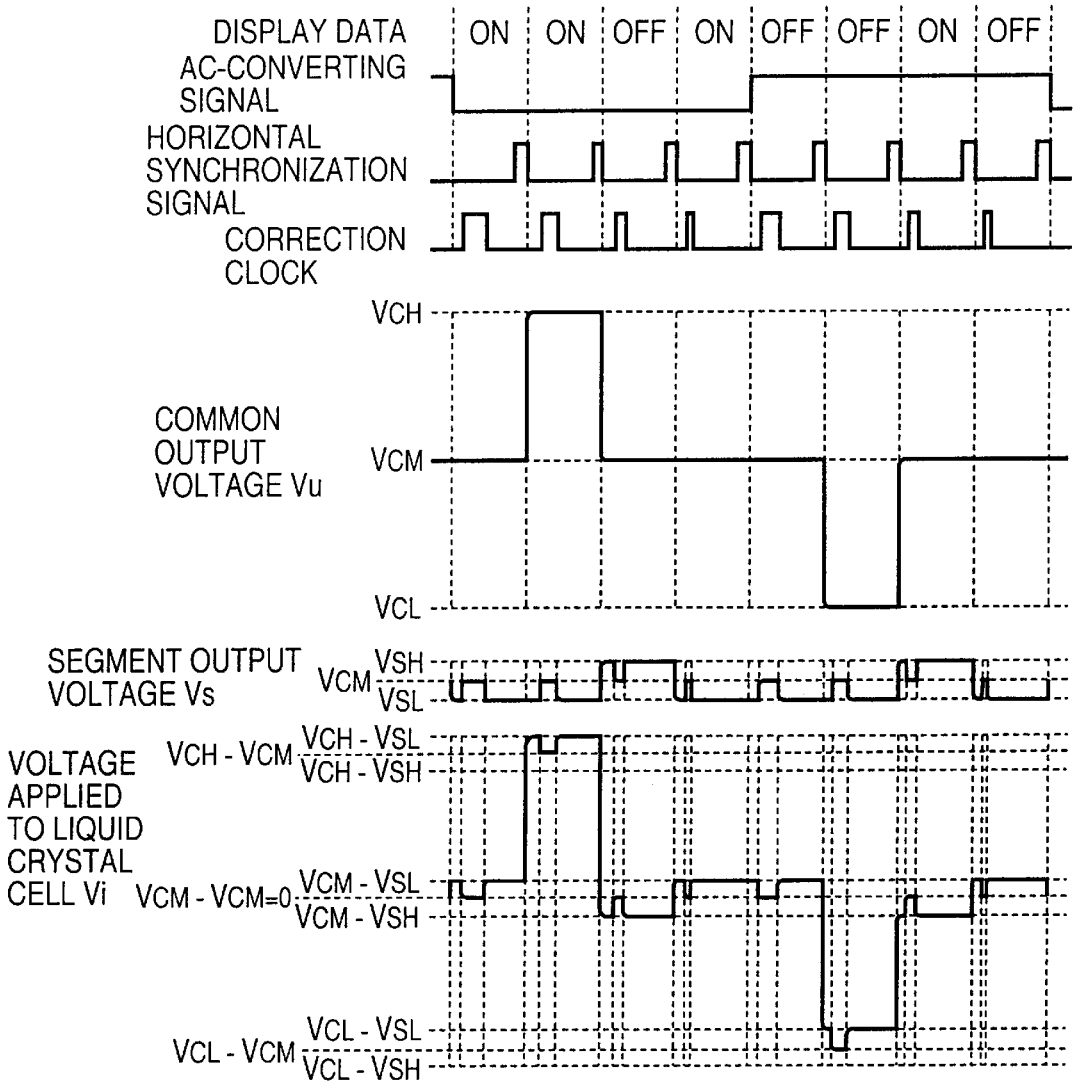
FIG. 13 is a timing chart showing voltage waveforms of various portions in the embodiment of FIG. 9.

FIG. 12 shows operating voltage waveforms of various portions and waveform of voltage Vi applied to the liquid crystal cell in the embodiment shown in FIG. 9. Segment voltage Vs is selected from among voltages of four levels, VSH, VSHH, VSLH and VSL according to a combination of the AC-converting signal, the line latch output and the correction clock. The correction clock is adjusted so that the pulse width decreases at every scanning line as shown in FIG. 4 described previously. Although the correction voltage levels are set to two levels of VSHH and VSLH in this embodiment, number of levels can be reduced to three as a whole by setting as VSHH=VSLH. Output waveforms of various portions and voltage waveform applied to the liquid crystal cell when the voltage is made identical with VCM which is the non-selection voltage level in the common side drive circuit 53, namely VSHH=VSLH=VCM, in particular, are shown in FIG. 13. Although the configuration of this embodiment does not include a level shifter, such a configuration is also possible as a level shifter is formed between the line latch circuit and the liquid crystal drive output circuit, while 3V is used as the power for the circuit up to the latch circuit, and the liquid crystal drive output circuit is driven with 5V. Such a configuration can be achieved by forming a level shifter between the line latch 23 and the liquid crystal drive output circuit 57 of FIG. 10. With this configuration, a system configuration of further lower power consumption can be achieved.

Figure 14:
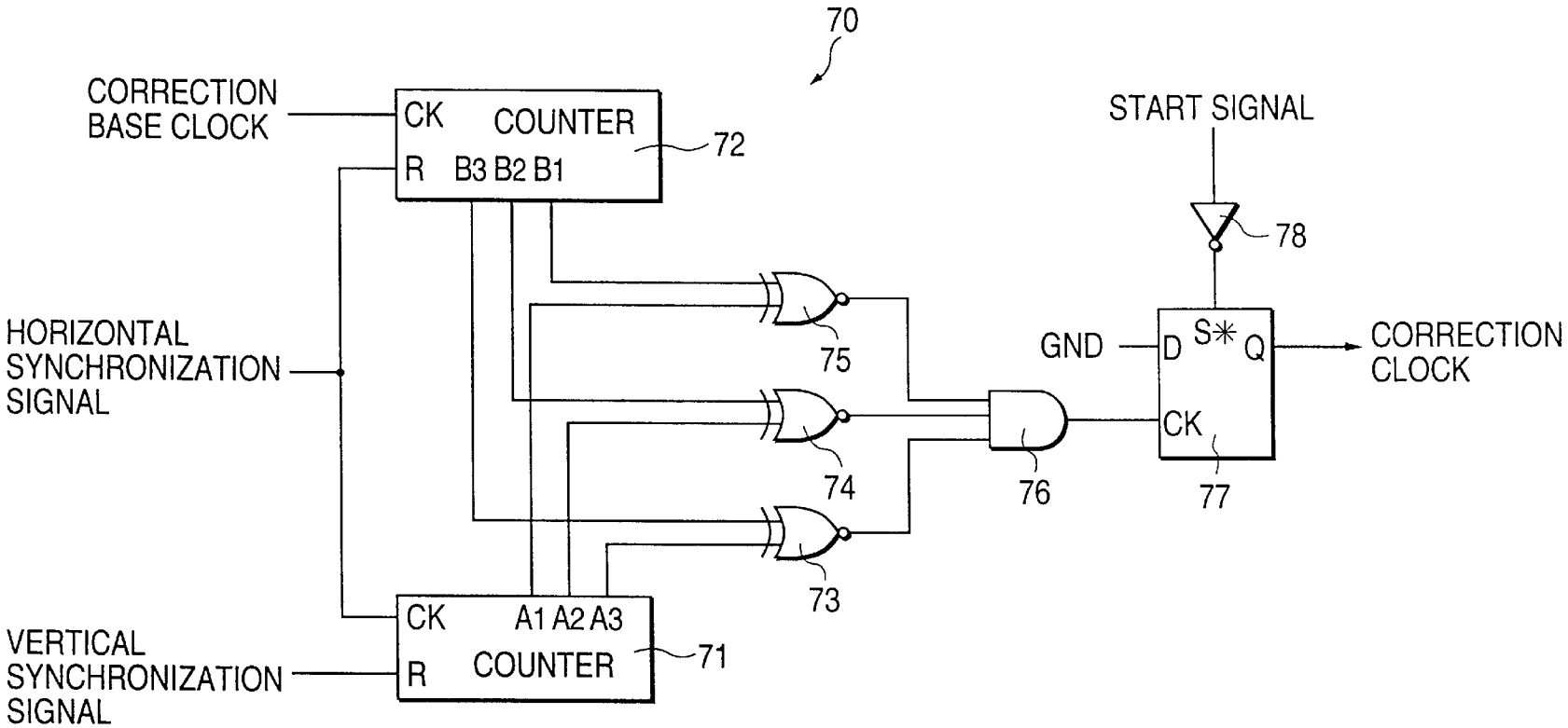
FIG. 14 is a logic circuit diagram of a correction clock generator circuit 70 provided in the controller 5 of FIG. 1 or FIG. 9.

FIG. 14 shows a correction clock generator circuit 70 provided in the controller 5 shown in FIG. 1 and FIG. 9. In this configuration, although it is assumed that the length of correction period can be changed in seven steps for the convenience of description, a configuration capable of changing the length in greater number of steps can also be achieved similarly.

The correction clock generator circuit 70 includes two counters 71, 72, three EXNOR circuits 73, 74, 75, a 3-input AND circuit 76, a D flip-flop circuit 77 and an inverter circuit 78. The counter 71 receives vertical synchronization signal at a reset input terminal R thereof. Supplied to a clock terminal CK is horizontal synchronization signal along with a reset input terminal R of the counter 72. The clock input terminal CK of the counter 72 receives a correction base clock signal supplied thereto. The counter 71 counts up and the counter 72 counts down.

Supplied to the EXNOR circuit 73 are outputs A3 and B3 of the third bit of the counters 71, 72, respectively. Supplied to the EXNOR circuit 74 are outputs A2 and B2 of the second bit of the counters 71, 72, respectively. Supplied to the EXNOR circuit 75 are outputs A1 and B1 of the first bit of the counters 71, 72, respectively. Outputs of the EXNOR circuit 73, 74, 75 are supplied to three inputs of the 3-input AND circuit 76. Output of the AND circuit 76 is supplied to the clock input CK of the D flip-flop circuit 77. Data input D of the D flip-flop circuit 77 is connected to ground voltage GND. Supplied to a set input terminal S* (* indicates inversion) of the D flip-flop circuit 77 is a start signal which is input via the inverter circuit 78. Output Q of the D flip-flop circuit 77 is led out as a correction output. When a low level input is given to the set input S* of the D flip-flop circuit 77 from the inverter circuit 78, the D flip-flop circuit 77 is set and the output Q becomes high level. When an output of the AND circuit 76 is given to the clock input CK, the grounded data input D is latched and the output Q changes to low level.

Figure 15:
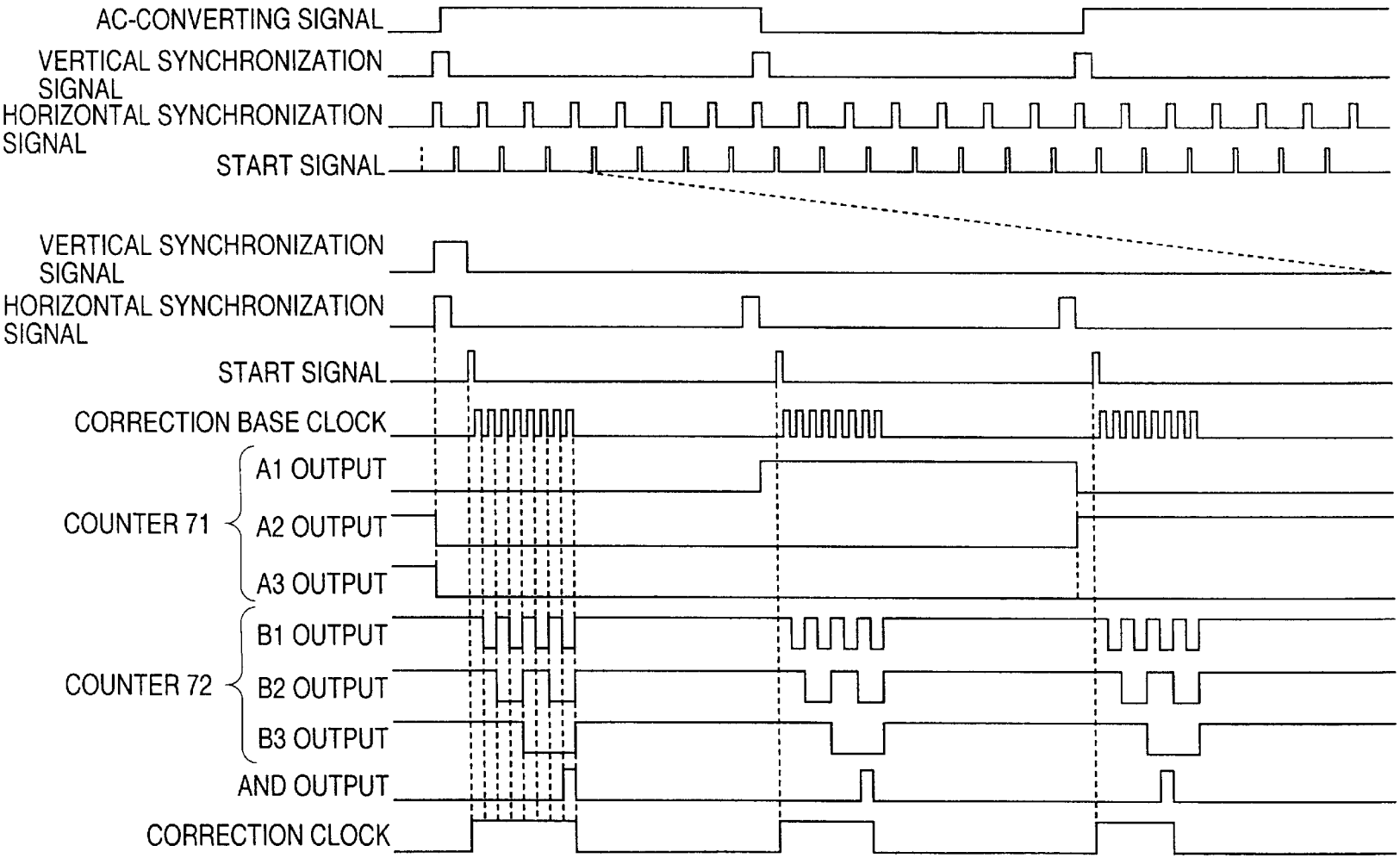
FIG. 15 is a timing chart showing the operation of the correction clock generator circuit of FIG. 14.

FIG. 15 shows waveforms of various portions of the correction clock generator circuit 70 shown in FIG. 14. The correction base clock indicates the position where a correction period is to be provided, and the length of correction period is adjusted by the correction clock generator circuit. When the counter 71 is initialized by the vertical synchronization signal, outputs A1, A2, A3 of the counter 71 become low level. The counter 72 changes the outputs B1, B2, B3 to high level every time the horizontal synchronization signal is input. When the value counted up by the counter 71 becomes equal to the value counted down by the counter 72, an output of the AND circuit 76 becomes high level. Then when the base clock is input, an output of the AND circuit 76 returns to low level. As the output of the AND circuit 76 changes in this way, an output Q of the D flip-flop circuit 77 changes to the ground voltage GND which is low level. Therefore, the correction clock signal rises upon the start signal and falls when the output of the AND circuit 76 returns to low level after rising provided that count of the counter 71 and count of counter 72 correspond.

Figure 16:
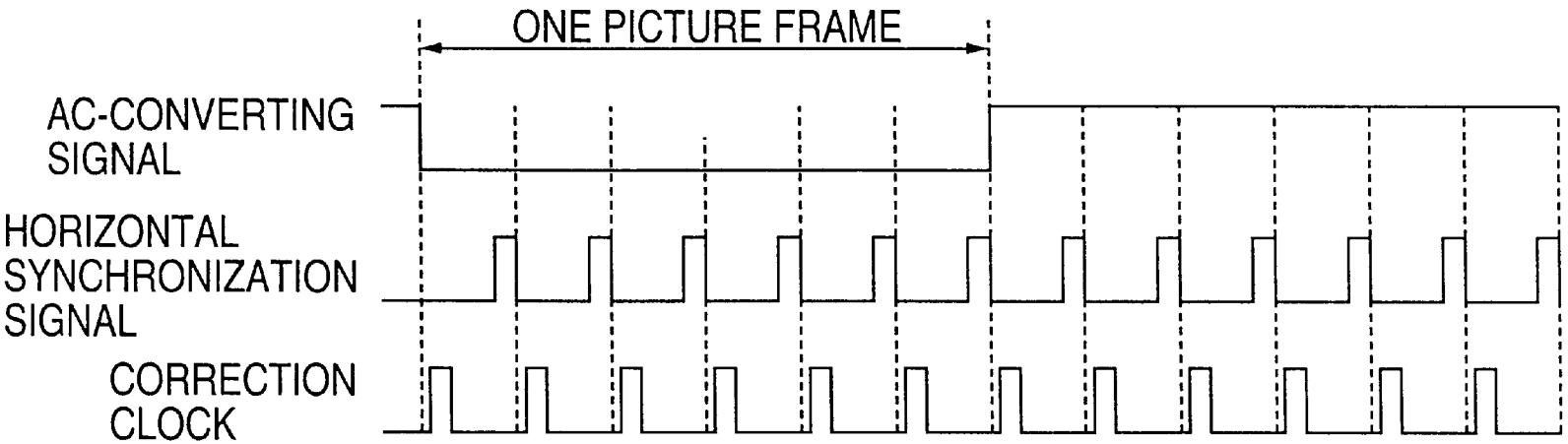
FIG. 16 is a timing chart showing the relationship between the AC-converting signal, the horizontal synchronization signal and the correction clock in the third embodiment of the invention.
Figure 17:
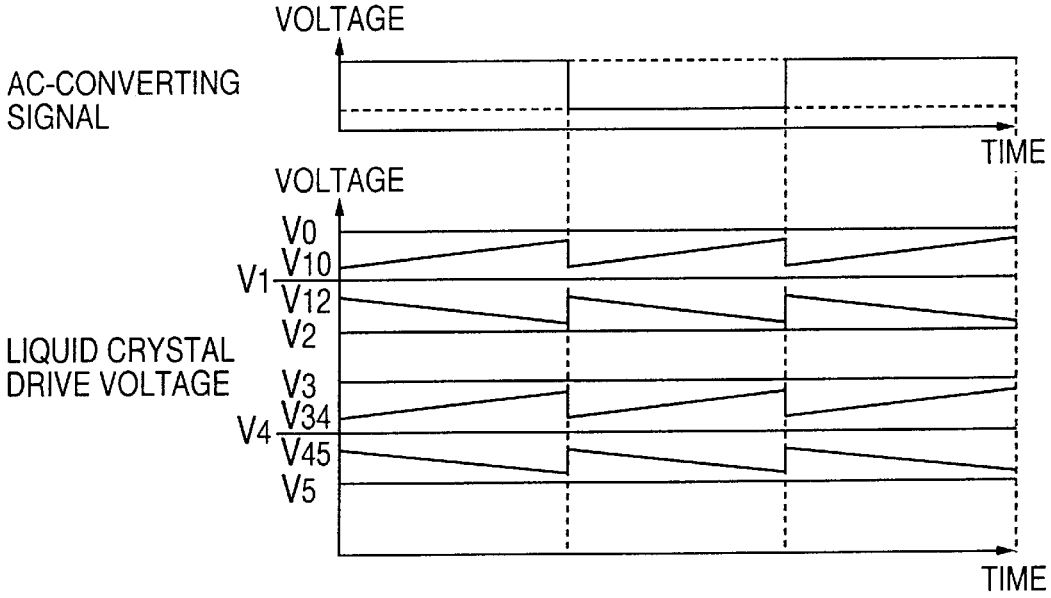
FIG. 17 is a timing chart showing the correction voltage level in the third embodiment of the invention.

FIG. 16 shows the correction clock used in third embodiment of this invention. The correction clock of this embodiment has a constant pulse width. Electrical configuration for driving the liquid crystal panel is similar to that of the embodiment of FIG. 1, and therefore description thereof will be omitted. In this embodiment, correction voltage levels V10, V12, V34, V45 change with time as shown in FIG. 17. Although the voltage changes in saw-tooth shape in FIG. 17, it may also be changed stepwise. In case the voltage is changed stepwise, the correction voltage level may be changed at intervals of a plurality of scanning lines, instead of being changed at every scanning line.

In FIG. 17, the configuration is made such as the difference between ON display voltage level and the correction voltage level or the difference between OFF display voltage level and the correction voltage level becomes largest when the common side drive circuit is selecting the scanning line nearest to the segment side drive circuit. The difference in voltage level decreases with distance of the selected scanning line from the segment side drive circuit, and becomes minimum when the scanning line farthest from the segment side drive circuit is being selected. Operation in this embodiment becomes similar to that of the first embodiment, and differs only in that the correction clock width remains always constant and the correction voltage level changes with time.

Figure 18:
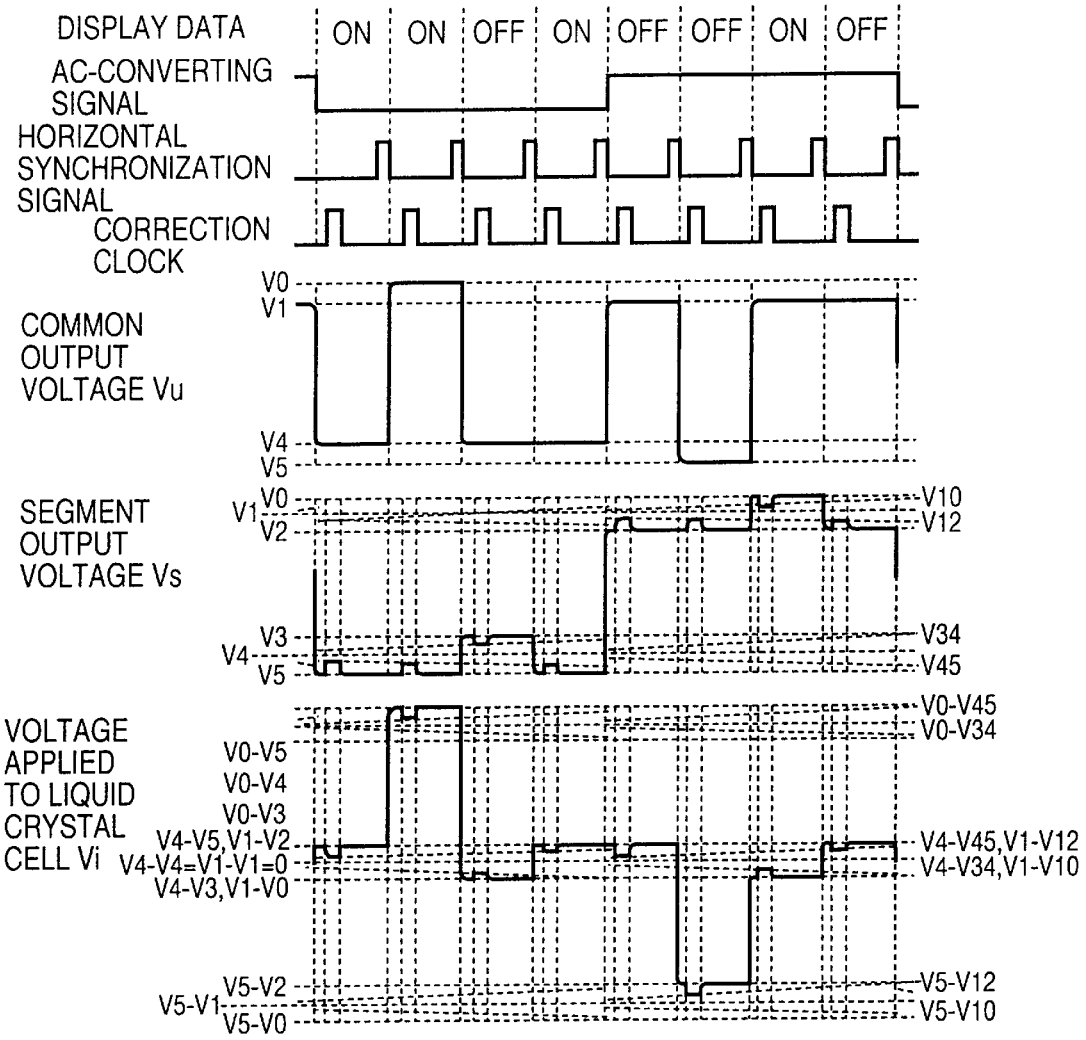
FIG. 18 is a timing chart showing the voltage waveforms of various portions in the third embodiment of the invention.

FIG. 18 shows the waveforms of various portions and the waveform of voltage applied to the liquid crystal cell in this embodiment. Amount of correction immediately after the AC-converting signal has changed becomes greater and decreases with time, and becomes minimum immediately before the AC-converting signal changes. In this embodiment, since the correction voltage is varied in level, the variation range of application voltage narrows as compared with the prior art disclosed in JP-A 62-43624, thereby preventing severe rounding of waveform. Thus the rounding of waveform is restrained, so that lacking in uniformity of luminance hardly occurs, and degrading in display quality can be prevented.

Figure 19:
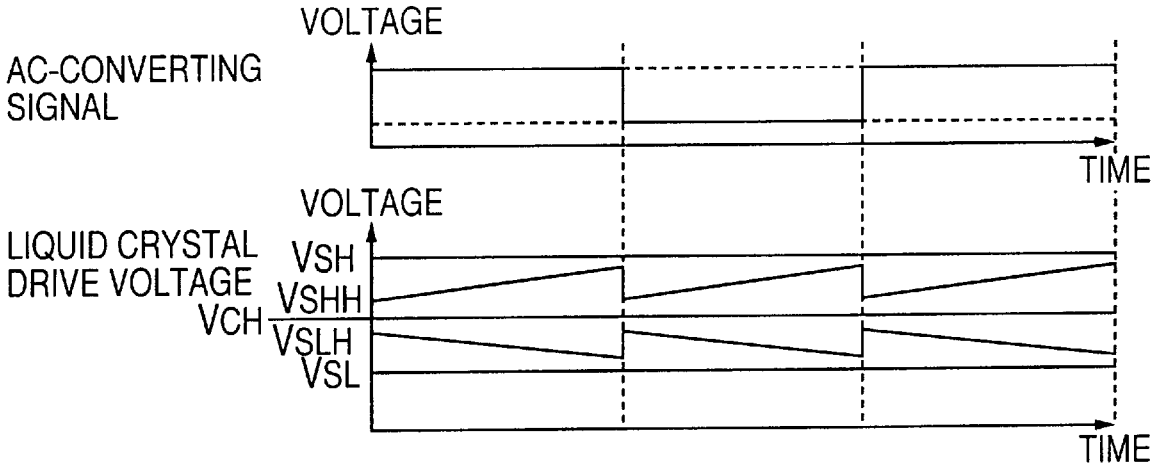
FIG. 19 is a timing chart showing the change in liquid crystal drive voltage which is output from a power supply circuit of fourth embodiment of the invention.

FIG. 19 shows changing voltage level when 5V drive method is applied to the third embodiment, as fourth embodiment of the invention. The correction clock of this embodiment has a constant pulse width as shown in FIG. 16. Electrical configuration for driving the liquid crystal panel is similar to that of the embodiment of FIG. 9, and therefore description thereof will be omitted. In FIG. 19, similarly to FIG. 17, correction voltage level changes as the distance between the segment side drive circuit 2 and the scanning line selected by the common side drive circuit 3 changes. Although the voltage changes in saw-tooth shape, it may also be changed stepwise. In case the voltage is changed stepwise, the correction voltage level may also be changed at intervals of a plurality of scanning lines, instead of being changed at every scanning line.

Figure 20:
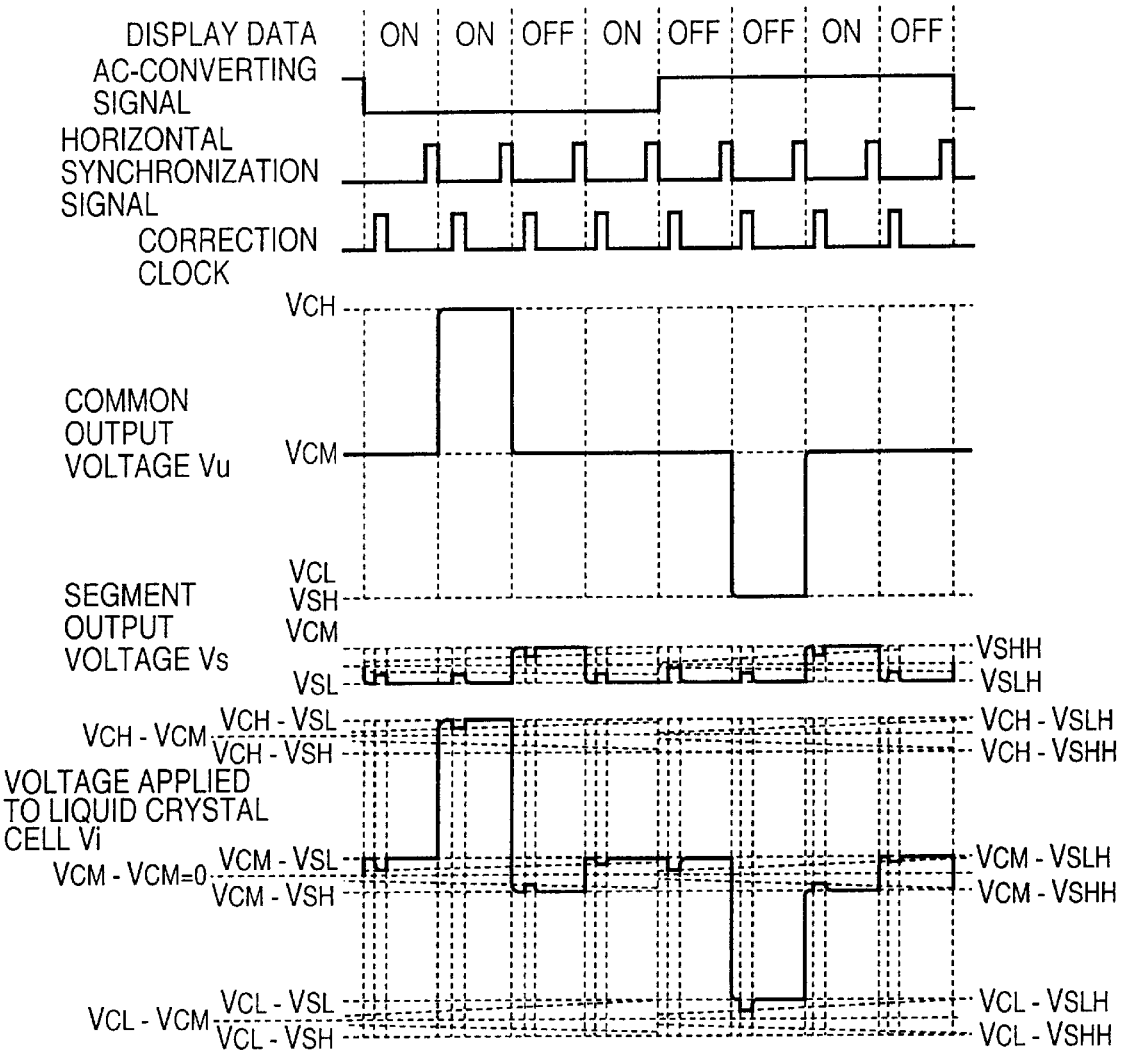
FIG. 20 is a timing chart showing voltage waveforms of various portions in the fourth embodiment of the invention.

FIG. 20 shows voltage waveforms of various portions and a voltage waveform applied to a liquid crystal cell in fourth embodiment. The pulse width of the correction clock remains always constant while the correction voltage changes with time. Consequently, among segment output voltage Vs and voltage Vi applied to the liquid crystal cell, voltage level of the portion which is the correction voltage changes according to the time lapsed after the AC-converting signal has changed. It is also possible to change the pulse width of the correction clock as well. Although the correction clock generator circuit is provided in the controller 5, it may also be provided in the segment side drive circuit. Also this embodiment is shown to be based on 5V drive method, but the level shifter may be formed between the line latch circuit and the liquid crystal drive output circuit in order to make a system of further lower power consumption.

Figure 21:
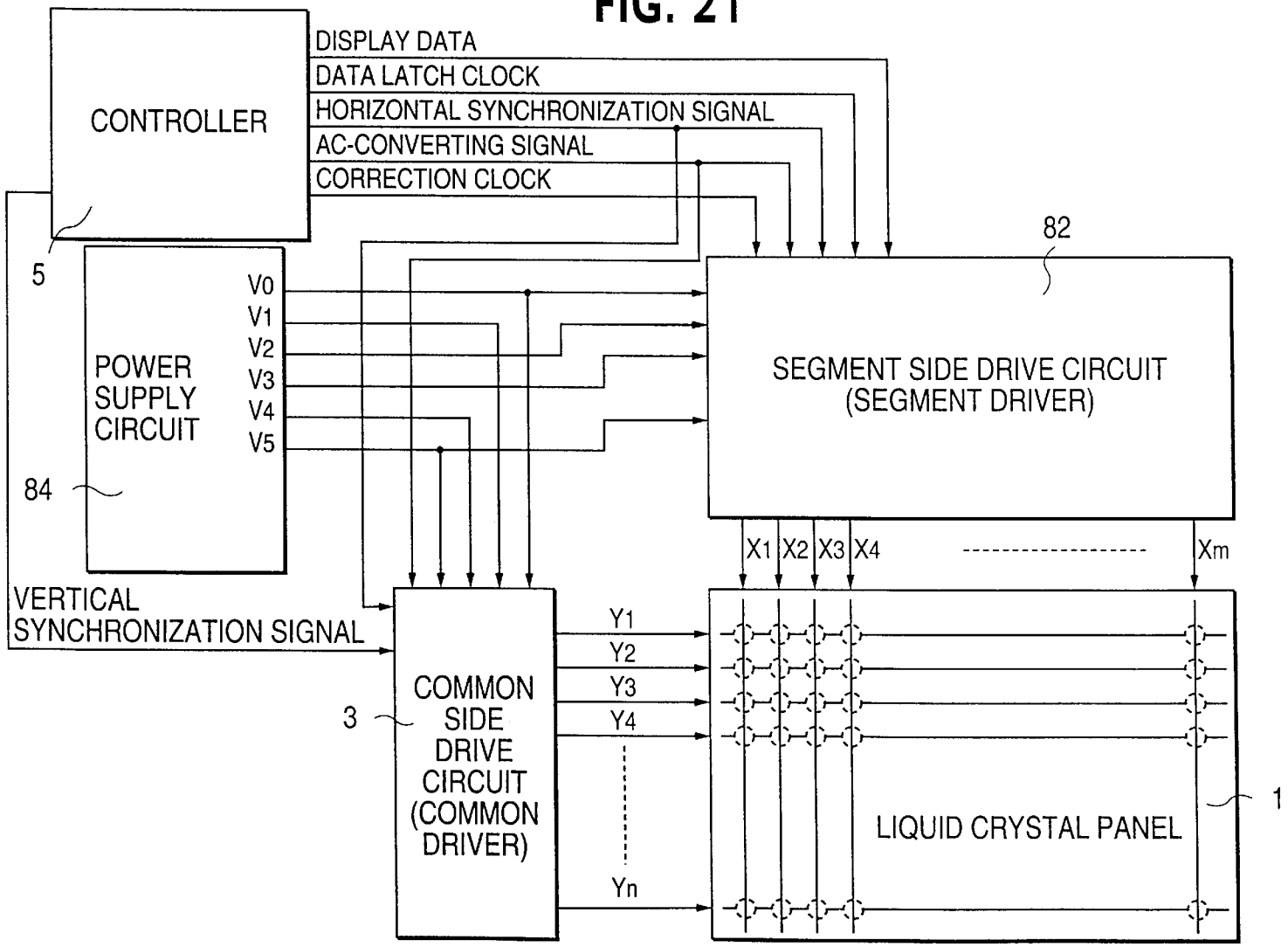
FIG. 21 is a block diagram schematically showing the electrical configuration for driving a liquid crystal panel according to fifth embodiment of the invention.

FIG. 21 schematically shows the electrical configuration of a drive device of a liquid crystal display apparatus in fifth embodiment of the invention. Components of this embodiment which correspond to those in the first through fourth embodiments are denoted with the same reference numerals and similar description will be omitted. Segment electrodes of the liquid crystal panel 1 which displays images are driven in parallel by the segment side drive circuit 82, and common electrodes are successively selected and driven by the common side drive circuit 3.

Figure 39:
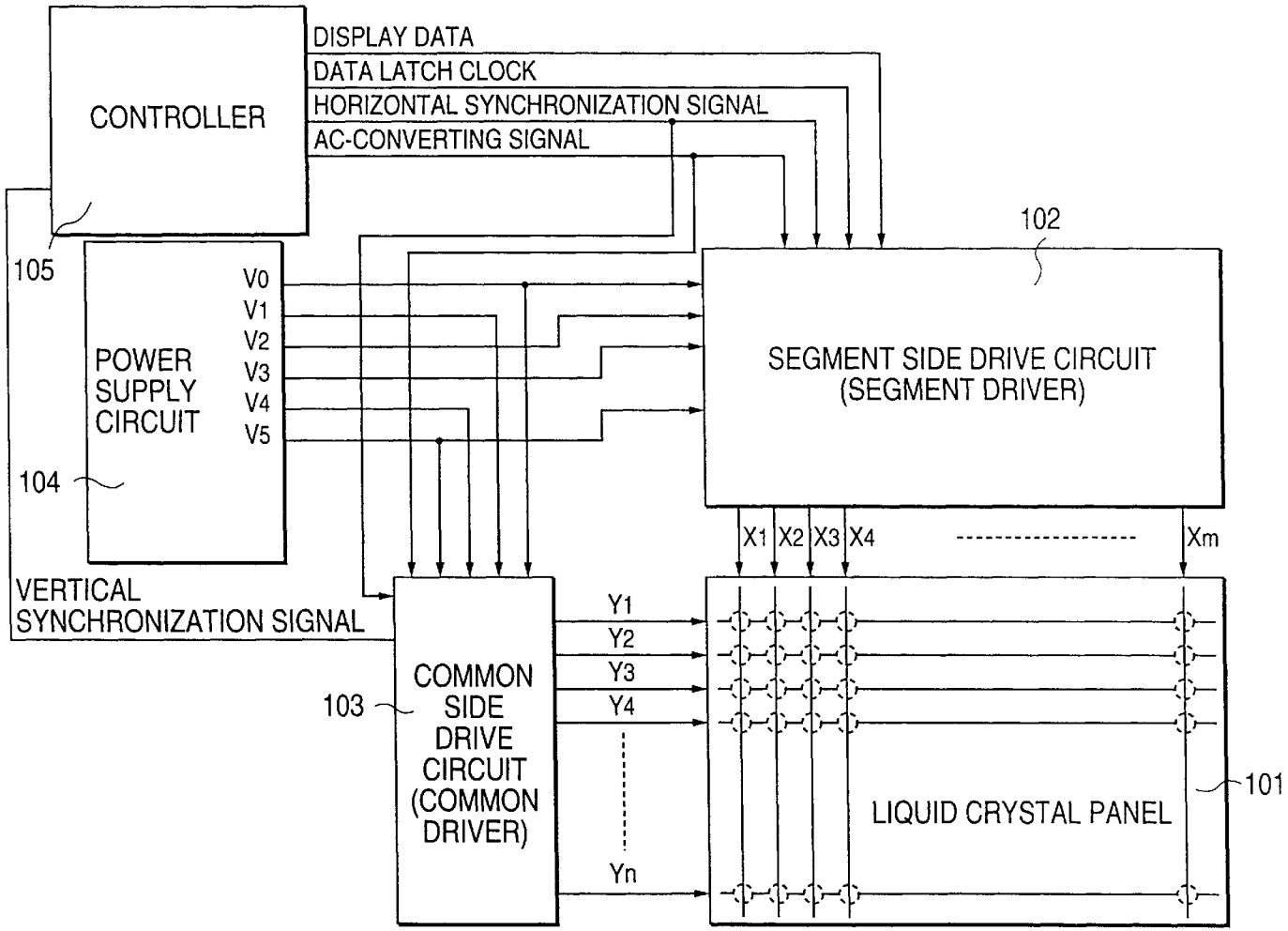
FIG. 39 (PRIOR ART)
FIG. 39 is a block diagram schematically showing the electrical configuration for driving a liquid crystal panel of the prior art.
Figure 40:
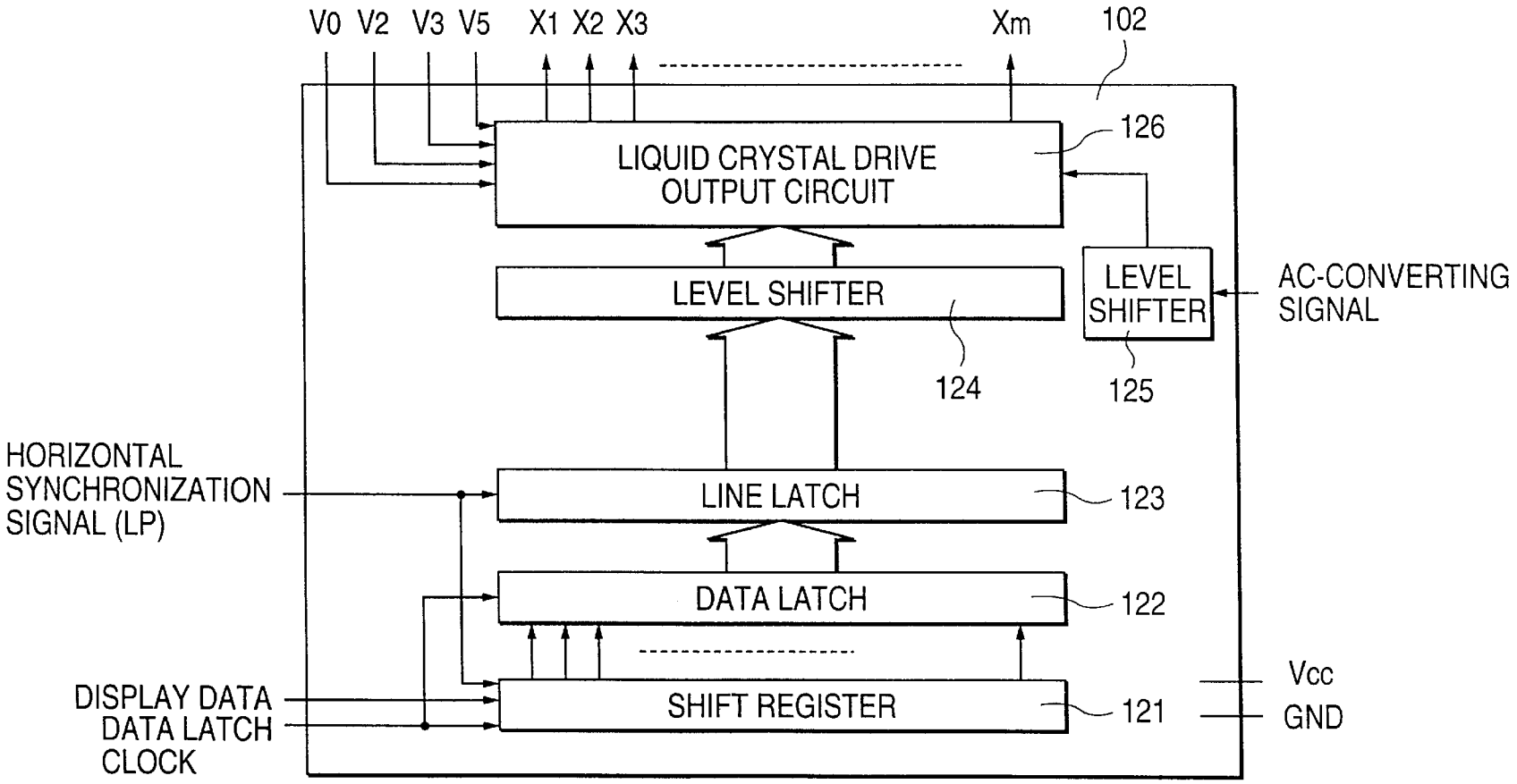
FIG. 40 (PRIOR ART)
FIG. 40 is a block diagram showing the internal electrical configuration of the segment side drive circuit 102 shown in FIG. 39.
Figure 41:
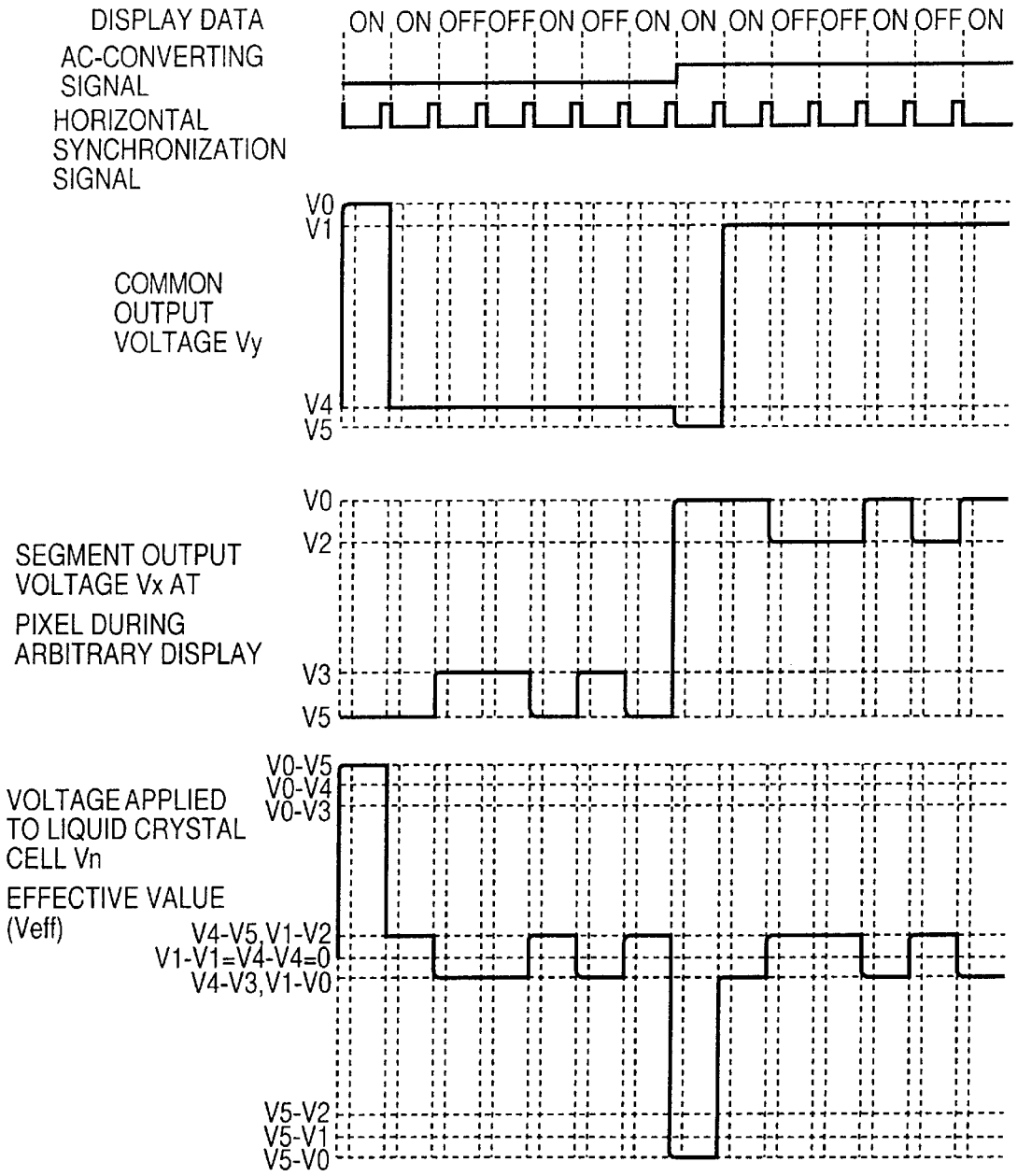
FIG. 41 (PRIOR ART)
FIG. 41 is a timing chart showing voltage waveforms of various portions of the configuration shown in FIG. 39.
Figure 42:
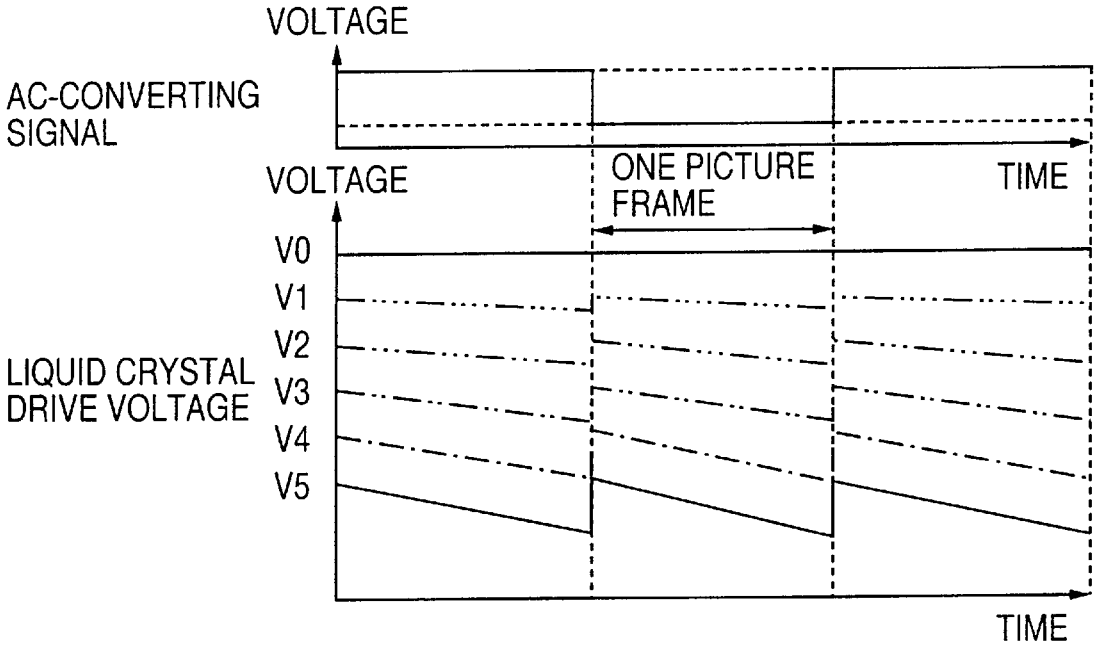
FIG. 42 (PRIOR ART)
FIG. 42 is a timing chart showing voltage generated by a power supply circuit of another prior art.
Figure 43:
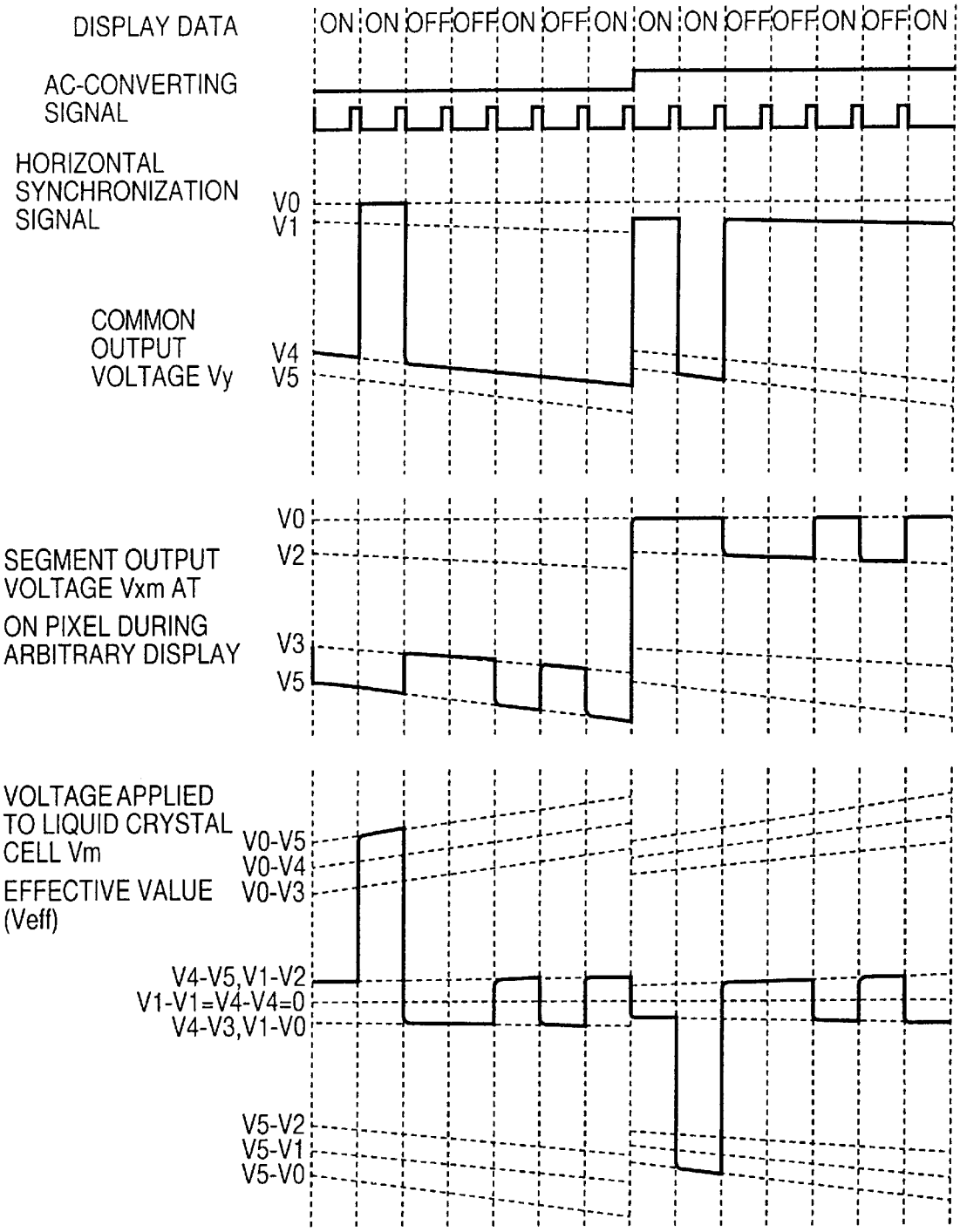
FIG. 43 (PRIOR ART)
FIG. 43 is a timing chart showing voltage waveforms of various portions of prior art which operates with the liquid crystal drive voltage shown in FIG. 42.
Figure 44:
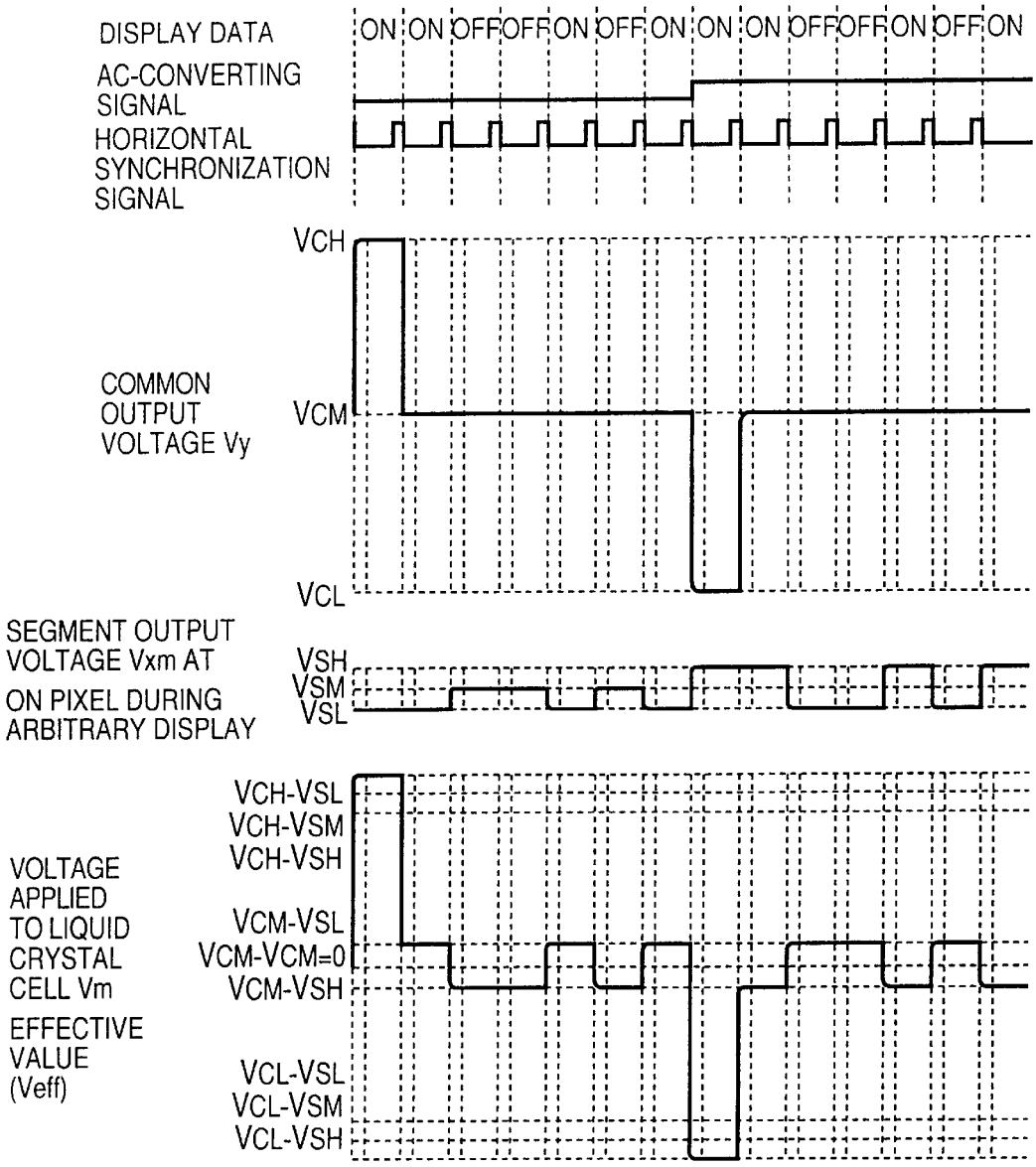
FIG. 44 (PRIOR ART)
FIG. 44 is a timing chart showing voltage waveforms of various portions of a case where display of a liquid crystal panel is obtained by supplying a low voltage such as 5V to a segment side drive circuit.

The segment side drive circuit 82 and the common side drive circuit 3 are supplied by a power supply circuit 84, which is similar to the power supply circuit 104 of the prior art shown in FIG. 39, with a plurality of kinds of voltage for giving display on the liquid crystal panel 1. The power supply circuit 84 supplies the segment side drive circuit 82 with four kinds of voltage V0, V2, V3, V5, which are in relation of V0>V2>V3>V5. The power supply circuit 84 supplies the common side drive circuit 3 with the maximum voltage V0, the minimum voltage V5, voltage V1 which is V0>V1>V2 and voltage V4 which is V3>V4>V5.

Display data of each pixel for the image to be displayed on the liquid crystal panel 1 is given from the controller 5 to the segment side drive circuit 82 in synchronization with the data latch clock. The controller 5 supplies the segment side drive circuit 82 and the common side drive circuit 3 with horizontal synchronization signal for successively switching the selection of common electrodes. The controller 5 also supplies the segment side drive circuit 82 with correction clock signal which represents the correction period for correcting the output voltage from the segment side drive circuit 82 in each scanning period.

Figure 22:
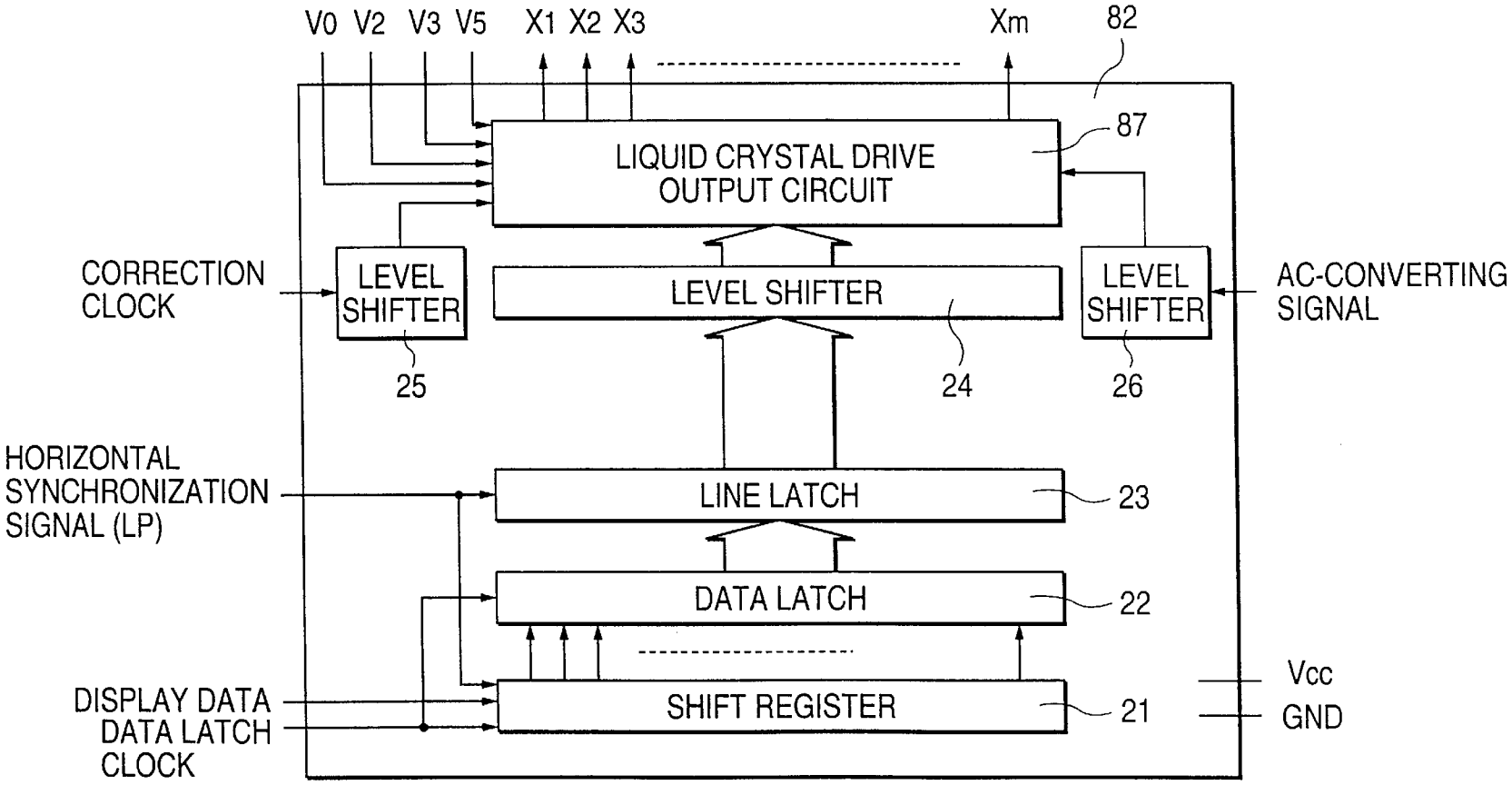
FIG. 22 is a block diagram showing the inner electrical configuration of a segment side drive circuit 82 of FIG. 21.

FIG. 22 shows the internal electrical configuration of the segment side drive circuit 82 of FIG. 21. The segment side drive circuit 82 is similar to the segment side drive circuit 2 shown in FIG. 2, and therefore corresponding components are denoted with the same reference numerals and similar description will be omitted. What is different is that the number of power voltages supplied to the liquid crystal drive output circuit 87 is reduced to four.

Figure 23:
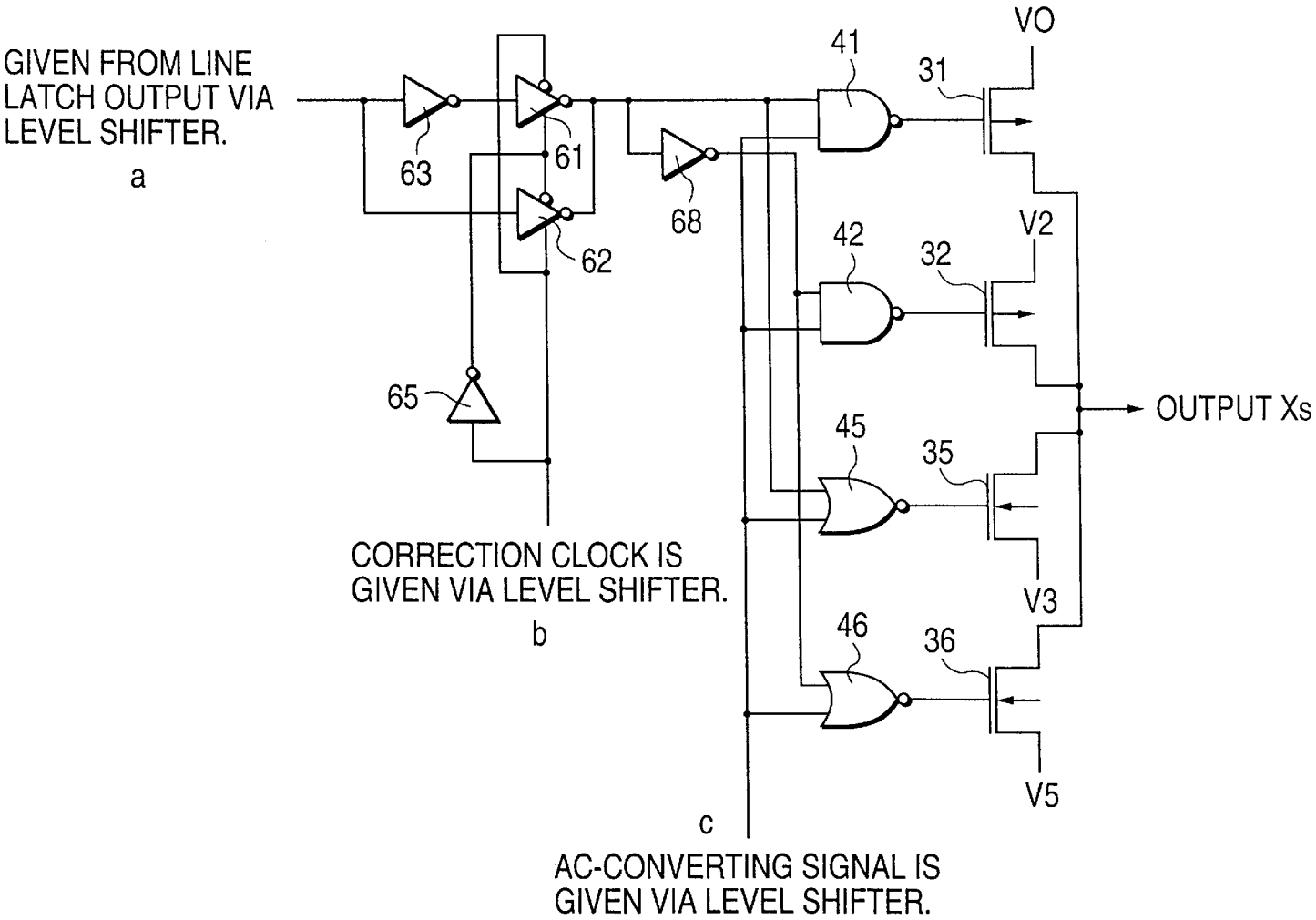
FIG. 23 is an electrical circuit diagram of a liquid crystal drive output circuit 87 of FIG. 22.

FIG. 23 shows a configuration for one segment electrode of the liquid crystal drive output circuit 87 shown in FIG. 22. The liquid crystal drive output circuit 87 is similar to the liquid crystal drive output circuit 57 shown in FIG. 11, and therefore corresponding components are denoted with the same reference numerals and similar description will be omitted. To the output Xs terminal are connected in common, drain electrodes of P channel MOS transistors 31, 32 source electrodes of which are provided with voltages V0, V2 supplied from the power supply 84, and drain electrodes of N channel MOS transistors 35, 36 source electrodes of which are provided with voltages V3, V5 supplied from the power supply 84. The drain electrodes connected in common give an output Xs. Connected to the gate electrodes of P channel MOS transistors 31, 32 are output terminals of 2-input NAND circuits 41, 42, respectively. Connected to the gate electrodes of N channel MOS transistors 35, 36 are output terminals of 2-input NOR circuits 45, 46, respectively.

Supplied to one of the inputs of each of the NAND circuit 41 and the NOR circuit 45 are the output of the clocked inverter circuit 62, to which the line latch output a is given, and the output of the clocked inverter circuit 61, to which the line latch output a inverted by the inverter circuit 63 is given, while being switched from one to another. Switching between the clocked inverter circuits 61, 62 is carried out by the correction clock b and the output of the inverter circuit 65 which inverts the correction clock b. Output of the inverter circuit 68 obtained by inverting the signal given to one of inputs of each of the NAND circuit 41 and the NOR circuit 45 is given to one of inputs of each of the NAND circuit 42 and the NOR circuit 46. Other inputs of the NAND circuits 41, 42 and the NOR circuit 45, 46 are supplied with the AC-converting signal c via level shifters.

Truth table values representing the operations of these logic circuits are shown in Table 4. When signal b which corresponds to the correction clock is "H", namely high level, V2 or V3 of OFF display voltage level is output as correction voltage during ON display when signal a is "H", and V0 or V5 of ON display voltage level is output as correction voltage during OFF display when signal a is "L".

TABLE 4

| a | b | c | Xn |
|---|---|---|---|
| L | L | H | V2 |
| H | L | H | V0 |
| H | H | H | V2 |
| L | H | H | V0 |
| H | L | L | V5 |
| L | L | L | V3 |
| L | H | L | V5 |
| H | H | L | V3 |

Figure 24:
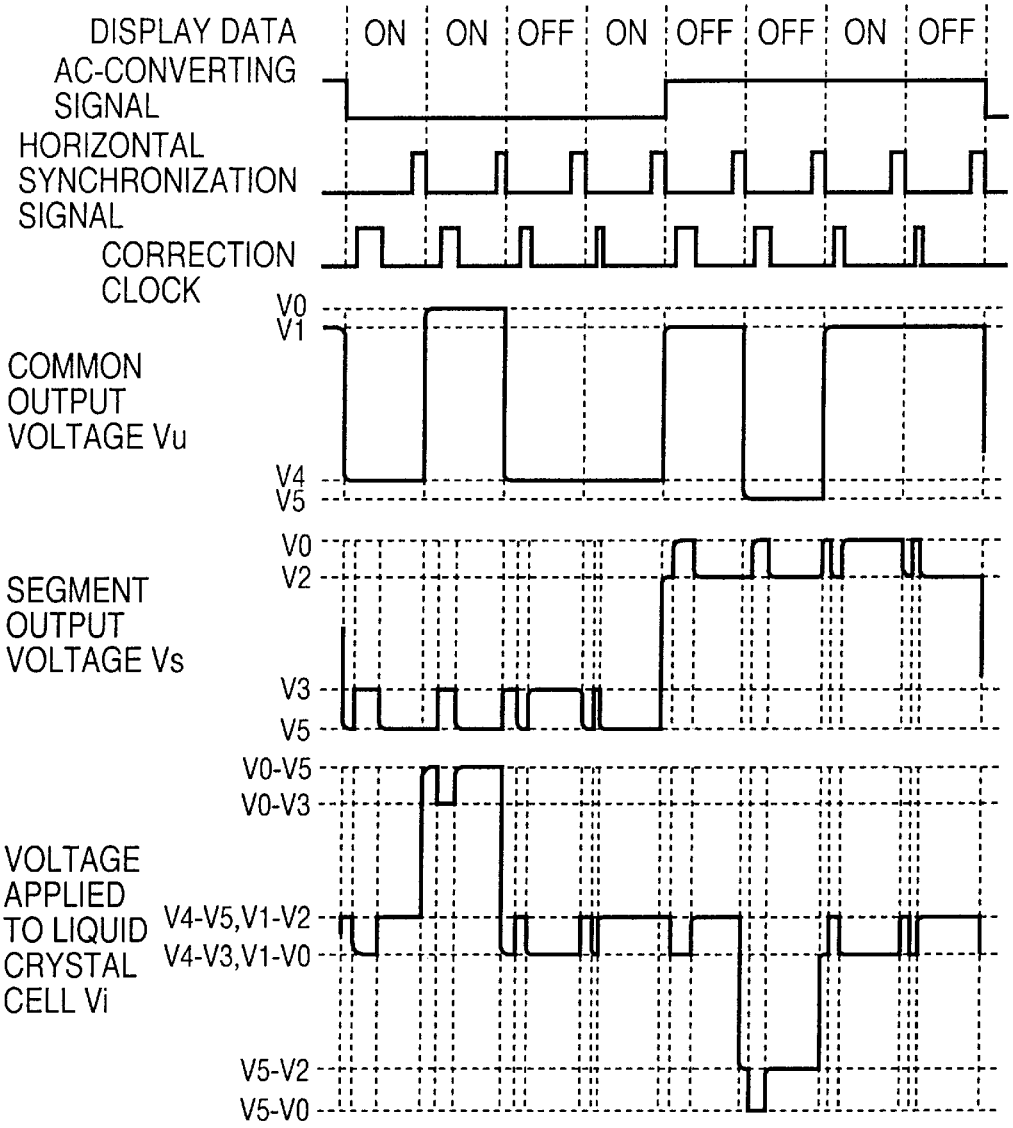
FIG. 24 is a timing chart showing signal waveforms of various portions in the embodiment of FIG. 21.

The relationship between the AC-converting signal, the horizontal synchronization signal and the correction clock is similar to those in FIG. 4 and FIG. 5. FIG. 24 shows the voltage waveforms of various portions under the similar conditions as those in FIG. 6. Although change in the voltage applied to the liquid crystal cell becomes larger compared to FIG. 6, number of voltages supplied can be reduced.

Figure 25:
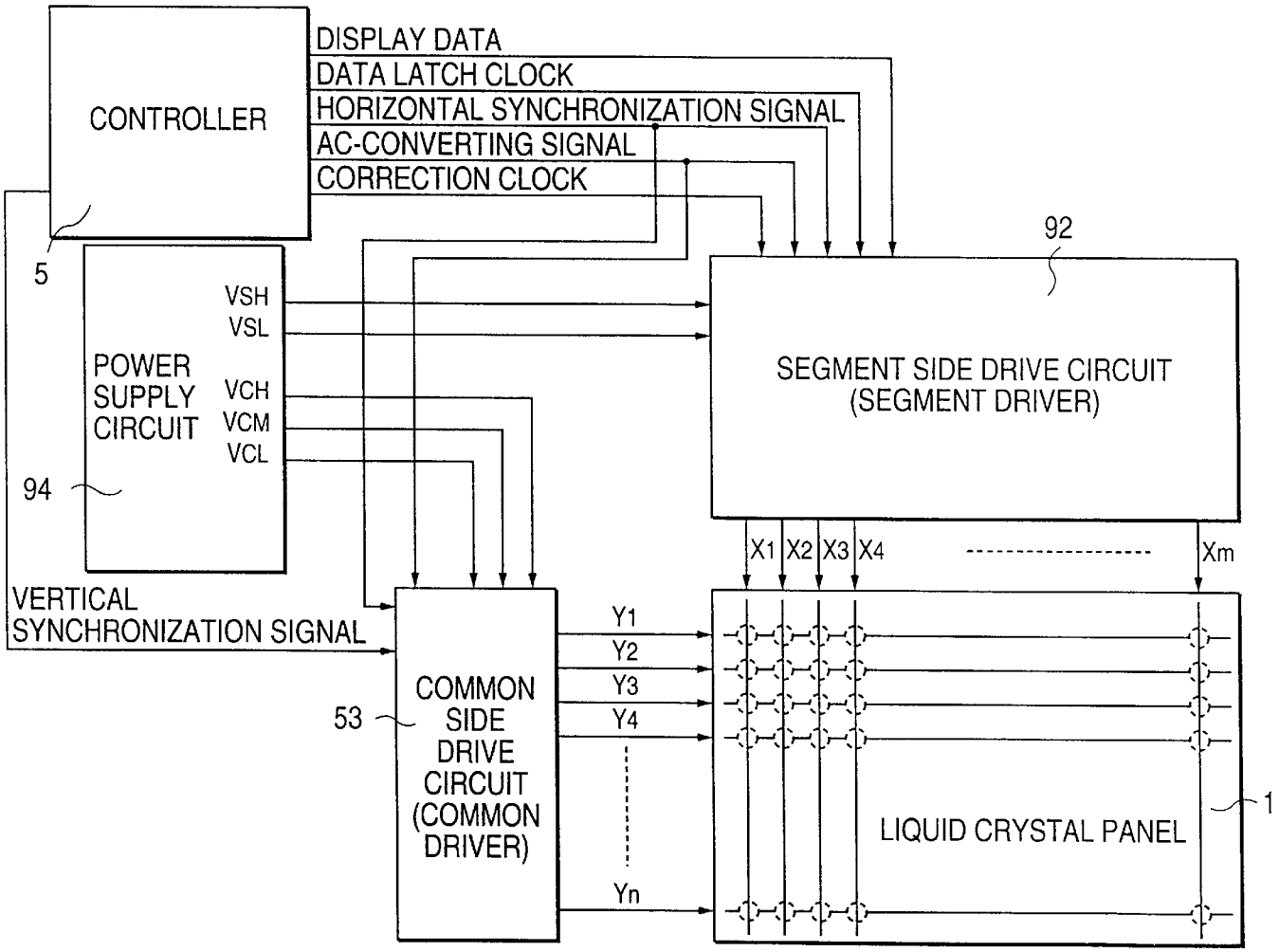
FIG. 25 is a block diagram schematically showing the electrical configuration for driving a liquid crystal panel according to sixth embodiment of the invention.

FIG. 25 schematically shows the electrical configuration of a drive device for a liquid crystal panel according to a sixth embodiment of the invention. This embodiment is similar to the second embodiment shown in FIG. 9, and therefore corresponding components are denoted with the same reference numerals and similar description will be omitted. A segment side drive circuit 92 operates within the range of logic circuit operating voltage which is usually 5V. A power supply circuit 94 supplies the segment side drive circuit 92 with two voltages, VSH and VSL, and provides the common side drive circuit 53 with three levels of voltage, namely selection voltages VCH and VCL, and non-selection voltage VCM.

Figure 26:
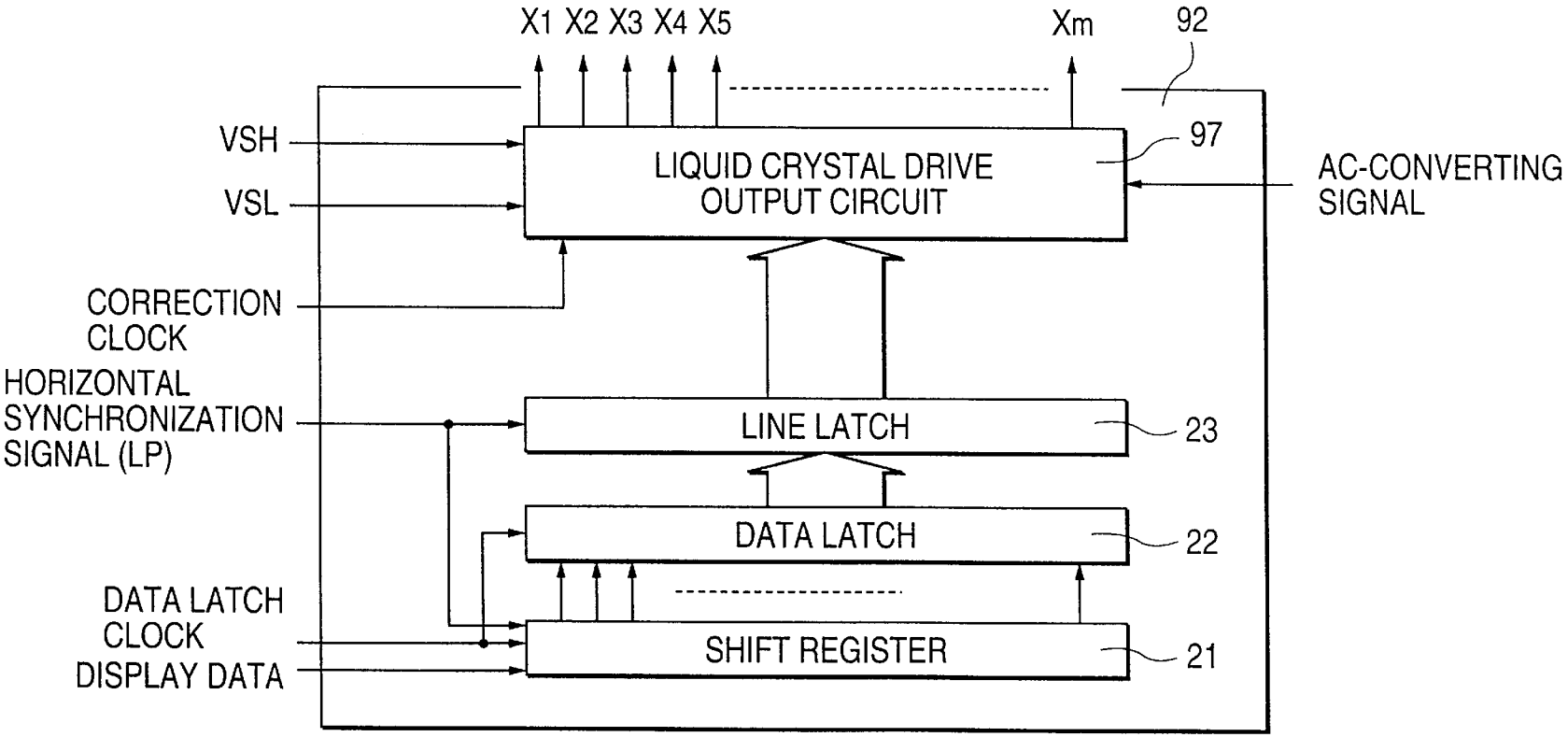
FIG. 26 is a block diagram showing the inner electrical configuration of a segment side drive circuit 92 of FIG. 25.

FIG. 26 shows the internal electrical configuration of the segment side drive circuit 92 shown in FIG. 25. Although the segment side drive circuit 92 and the segment side drive circuit 52 shown in FIG. 10 have similar configurations, they are different in that four voltages VSH, VSHH, VSL and VSLH are supplied to a liquid crystal drive output circuit 57 of the segment side drive circuit 52, while two voltages VSH and VSL are supplied to a liquid crystal drive output circuit 97 of the segment side drive circuit 92.

Figure 27:
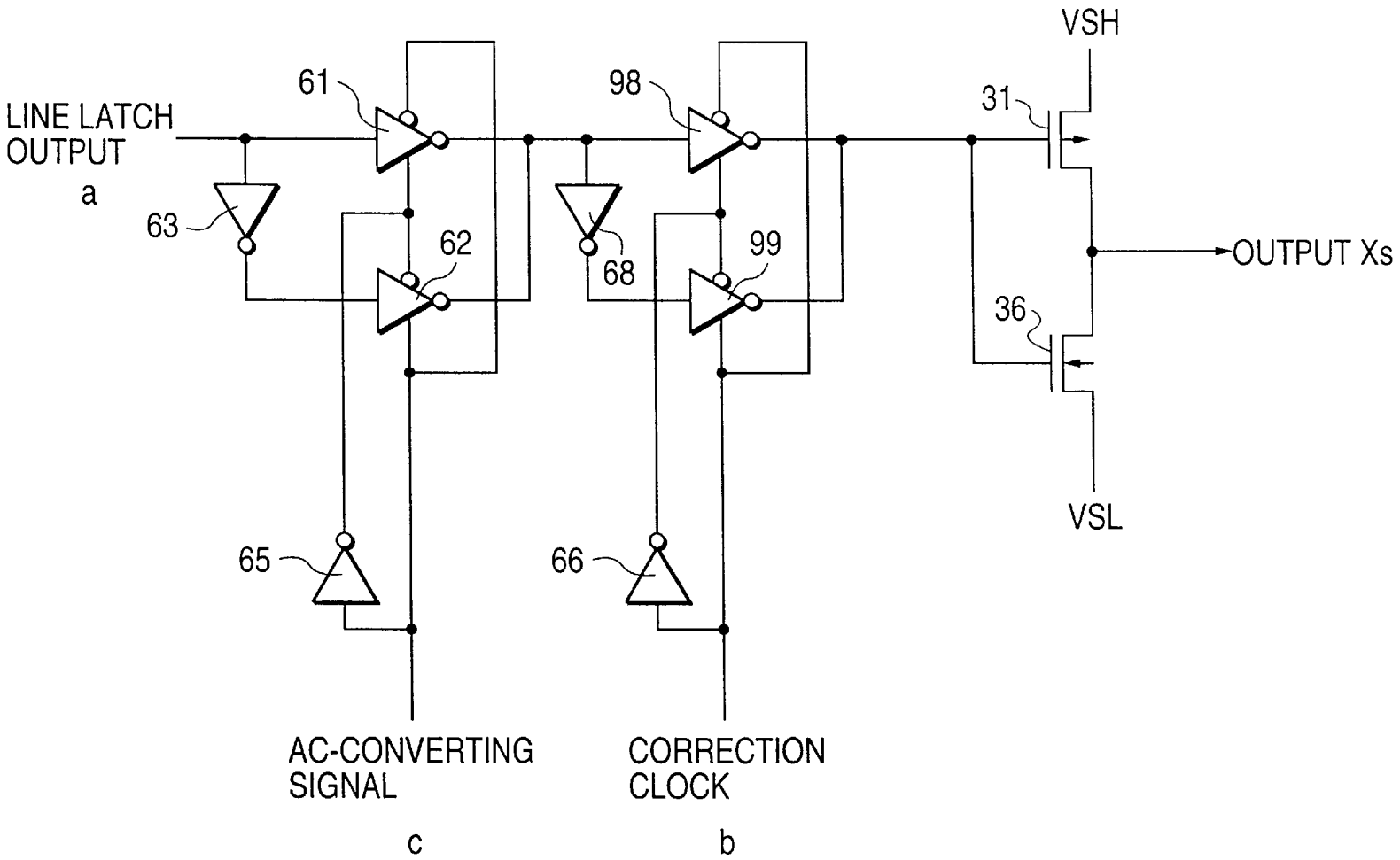
FIG. 27 is an electrical circuit diagram of a liquid crystal drive output circuit 97 of FIG. 26.

FIG. 27 shows the configuration for an output Xs per segment electrode of the liquid crystal drive output circuit 97 shown in FIG. 26. Components corresponding to those of the liquid crystal drive output circuit 57 shown in FIG. 11 are denoted with the same reference numerals and similar description will be omitted. To the output Xs terminal are connected in common, drain electrodes of P channel MOS transistors 31 and N channel MOS transistor 36, source electrodes of which are provided with voltages VSH, VSL supplied from the power supply 94, respectively. The drain electrodes connected in common give the output Xs. Connected to the gate electrodes of the P channel MOS transistors 31 and of the N channel MOS transistor 36 are output terminals of clocked inverters 98, 99, respectively.

Input of the clocked inverter circuit 98 receives outputs of clocked inverter circuits 61, 62 as the line latch output a or an output inverted by an inverter circuit 63, selectively supplied thereto. This signal, after being inverted by an inverter circuit 68, is input to a clocked inverter circuit 99. The clocked inverter circuits 98, 99 are switched by the correction clock b and output of the inverter circuit 66 obtained by inverting the same. Switching between the clocked inverter circuits 61, 62 is carried out by the AC-converting signal c and output of the inverter circuit 65 obtained by inverting the same. Operation of these logic circuits are basically inversion, with truth table values shown in Table 5.

TABLE 5

| a | b | c | Xn |
|---|---|---|---|
| H | H | H | VSL |
| L | H | H | VSH |
| H | L | H | VSH |
| L | L | H | VSL |
| H | H | L | VSH |
| L | H | L | VSL |
| H | L | L | VSL |
| L | L | L | VSH |

Figure 28:
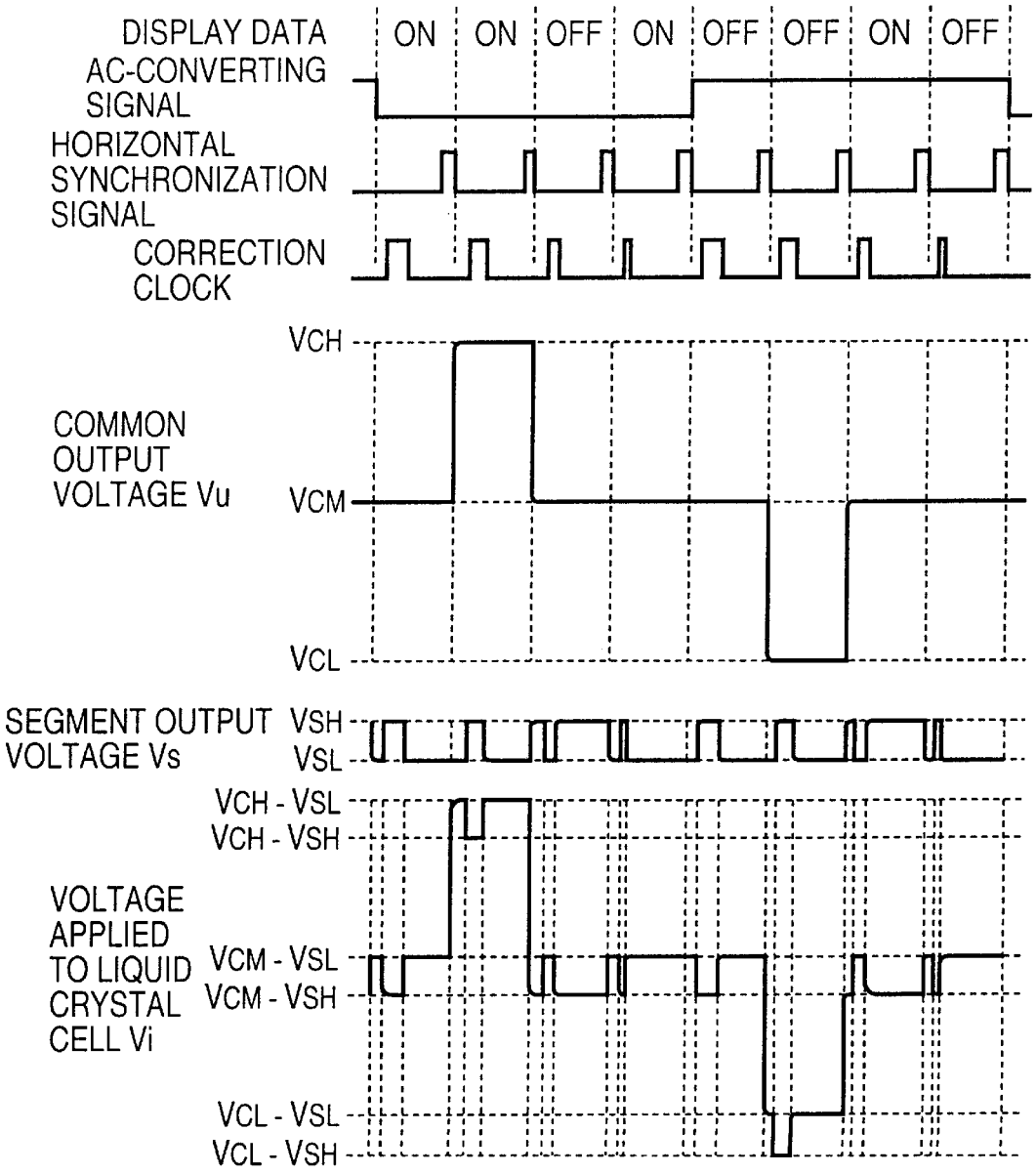
FIG. 28 is a timing chart showing signal waveform of various portions in the embodiment of FIG. 25.

FIG. 28 shows voltage waveforms of various portions and waveform of voltage Vi applied to the liquid crystal cell in the embodiment shown in FIG. 25. Segment output voltage Vs is selected from among two voltages VSH and VSL according to a combination of the AC-converting signal, the line latch output and the correction clock. The correction clock in this embodiment is adjusted so that the pulse width decreases at every scanning line as shown in FIG. 4. In this embodiment, number of voltages supplied is further reduced from that of the embodiment shown in FIG.13.

Figure 29:
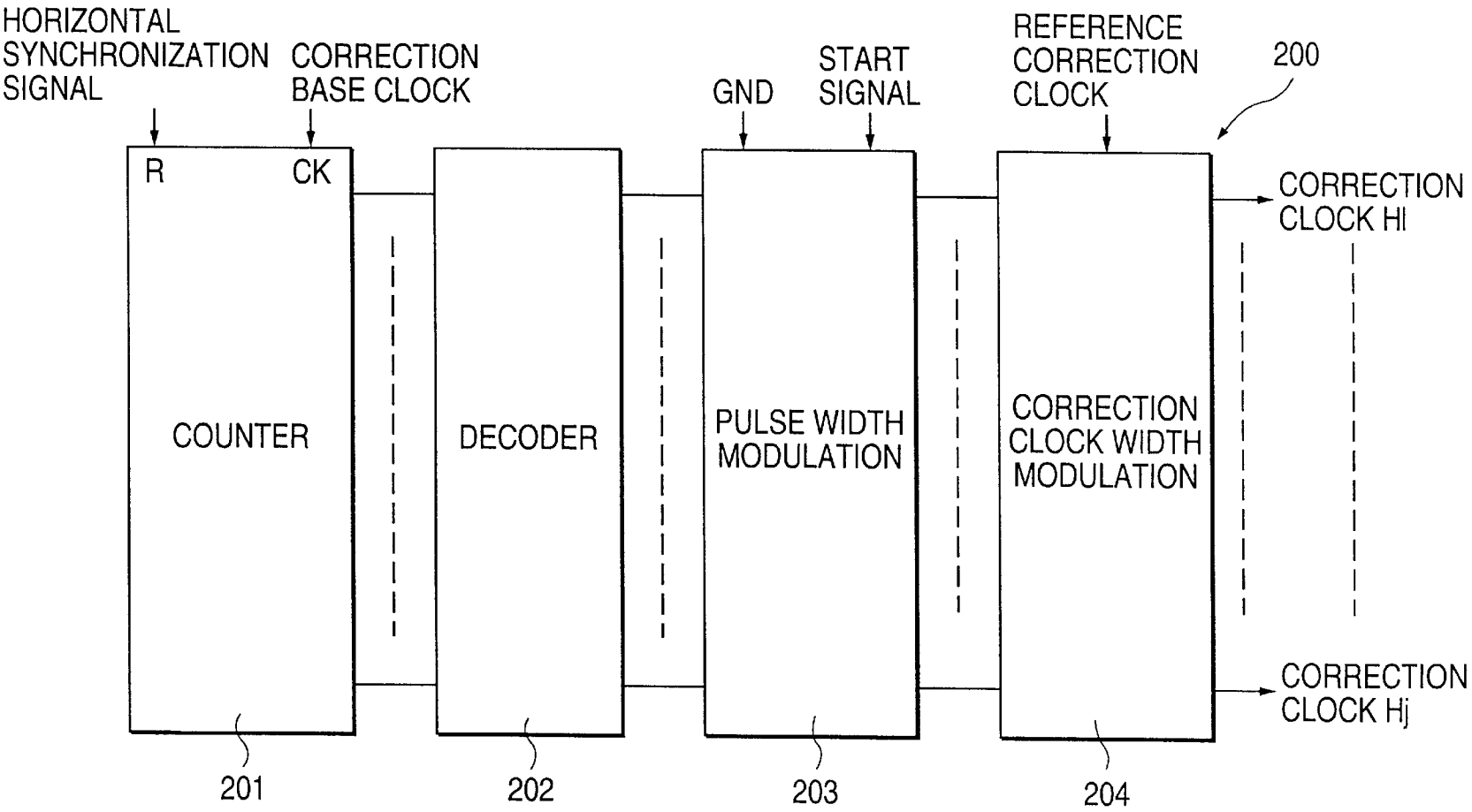
FIG. 29 is a block diagram showing a correction clock forming circuit 200 used in seventh embodiment of the invention.

FIG. 29 shows a correction clock forming circuit 200 used in seventh embodiment of this invention. Electrical configuration for driving the liquid crystal panel in this embodiment is similar to that of the embodiment of FIG. 1, and therefore description thereof will be omitted.

The correction clock forming circuit 200 is configured including a counter 201, a decoder circuit 202, a pulse width modulator 203 and a correction clock width modulator 204. The Correction clock forming circuit 200 is, together with the correction clock generator circuit 70 shown in FIG. 14, provided in the controller 5 shown in FIG.1, for example. In this embodiment, the correction clock signal which is output from the correction clock generator circuit 70 is specifically referred to as reference correction clock signal.

The counter 201 is initialized when a horizontal synchronization signal is input to the reset terminal R. After being initialized, the counter 201 counts down according to the correction base signal given at the clock input terminal CK. Output of the counter 201 is equal to or less than the number of the correction base clock pulses given in one horizontal scanning period. The decoder 202 supplies count data to the pulse width modulator 203 according to the output of the counter 201.

The pulse width modulator 203 receives start signal and ground voltage GND, and an output which is set by the start signal changes to ground voltage GND upon change of the signal which is output from the decoder 202. Consequently, pulse width changes at every period for the correction base clock signal. A correction clock width modulator 204 is supplied with the reference correction clock signal by the correction clock generator circuit 70 shown in FIG. 14. The correction clock width modulator 204 is configured so that the output thereof turns to low level when both the reference correction clock signal and the output of the pulse width modulator 203 are at high level. From the correction clock width modulator 203 are output correction clock signals H1 through Hj (j is a number not greater than m, while collectively denoted with symbol H) of which pulse width decreases successively every time the correction base clock signal falls. By supplying the correction clock signal H successively to the liquid crystal drive output circuit portion 40 shown in FIG. 3, the correction clock signal which is given to the liquid crystal drive output according to the distance from the common side drive circuit is caused to change. Also since pulse width of the reference correction clock signal decreases at every horizontal scanning period, the correction clock signal changes according also to the distance from the segment side drive circuit.

Figure 30:
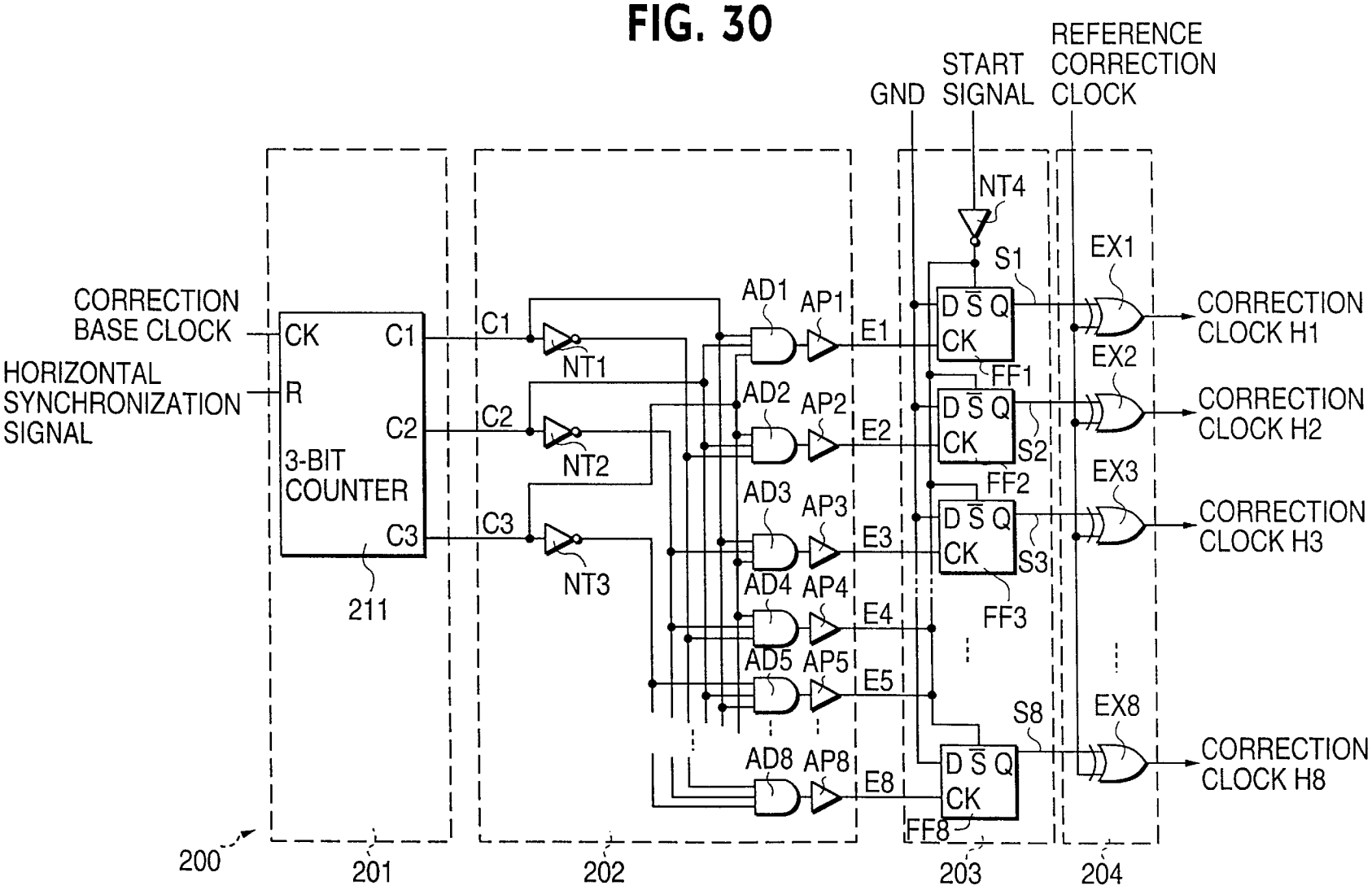
FIG. 30 shows an example of particular circuit of the correction clock forming circuit 200.

FIG. 30 shows an example of configuration of a specific circuit of the correction clock forming circuit 200. In the configuration example shown in FIG. 30, eight base clock signals H1 through H8 having different pulse widths are output. The counter 201 is configured including a 3-bit counter 211. A reset terminal R of the 3-bit counter 211 receives horizontal synchronization signal input thereto, while clock input terminal CK thereof receives the correction base clock signal input thereto. Outputs C1, C2, C3 of the 3-bit counter 211 are given to a decoder 202.

The decoder 202 is configured including inverter circuits NT1 through NT3, 3-input AND circuits AD1 through AD8 and buffer circuits AP1 through AP8. Supplied to the inverter circuits NT1 through NT3 are outputs C1, C2, C3, respectively. Supplied to the 3-input AND circuits AD1 through AD8 are the outputs C1, C2, C3 and the outputs of the inverter circuits NT1 through NT3 in different combinations. Outputs of the AND circuits AD1 through AD8 supplied via the buffer circuits AP1 through AP8 to the pulse width modulator 203 as outputs E1 through E8.

The pulse width modulator 203 is configured including the inverter circuit NT4 and the D flip-flop circuits FF1 through FF8. The outputs E1 through E8 are supplied to the clock input terminals CK of the D flip-flop circuits FF1 through FF8. Supplied to the set inputs S* of the D flip-flop circuits FF1 through FF8 is start signal inverted by the inverter circuit NT4. The inputs D receive ground voltage GND supplied thereto. Therefore, the outputs Q of the D flip-flop circuits FF1 through FF8 are set upon input of the start signal and become voltage GND according to the outputs E1 through E8. Outputs Q of the D flip-flop circuits FF1 through FF8 are supplied to the correction clock width modulator 204 as signals S1 through S8.

The correction clock width modulator 204 comprises EXOR (exclusive OR) circuits EX1 through EX8, with one of the inputs of each of these circuits receiving the reference correction clock signal and other inputs receiving signals S1 through S8. The correction clock width modulator 204 outputs correction clock signals H1 through H8 successively according to falling of the signals S1 through S8.

Figure 31:
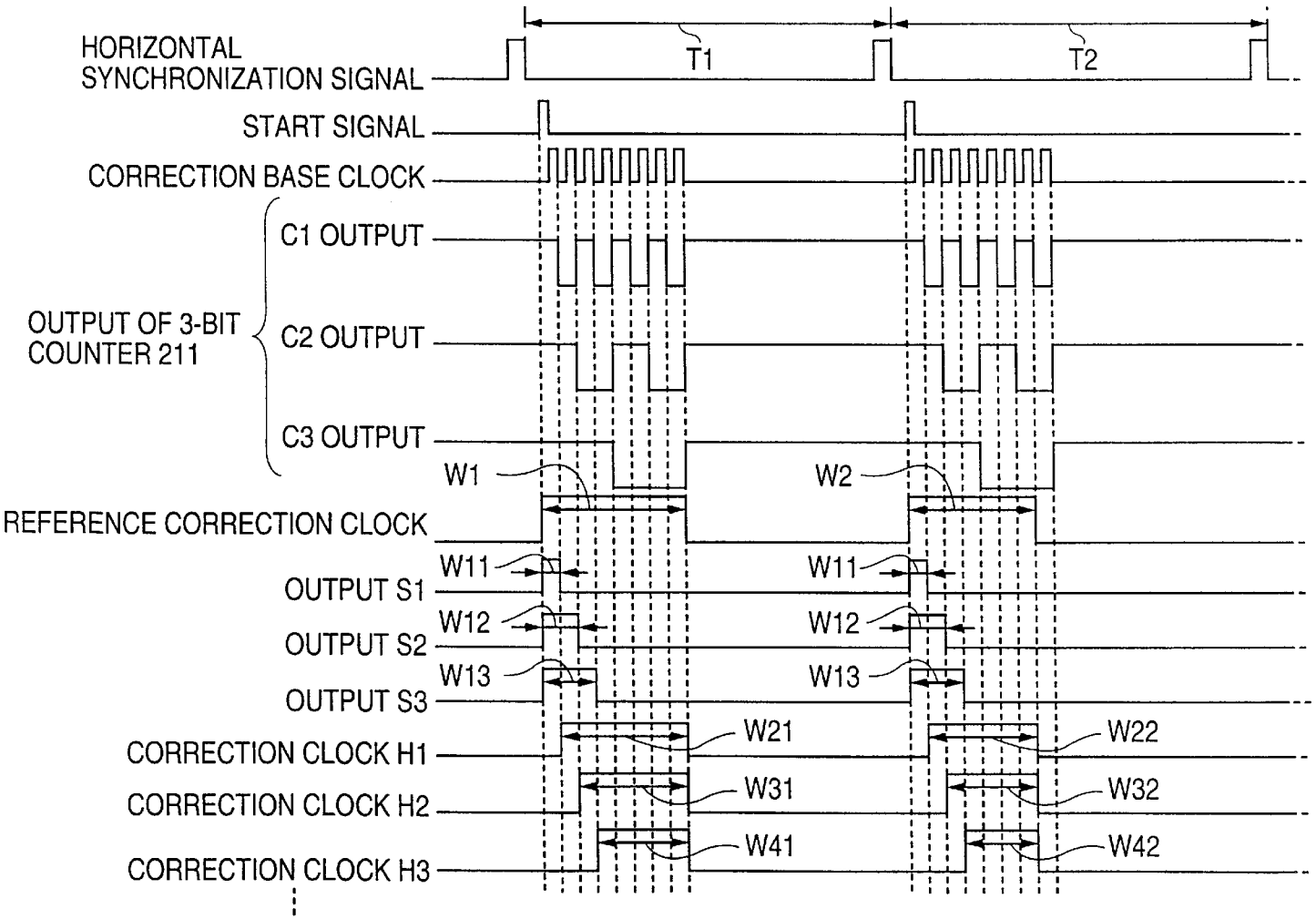
FIG. 31 is a timing chart showing voltage waveforms of various portions of the correction clock forming circuit 200 shown in FIG. 30.
Figure 32:
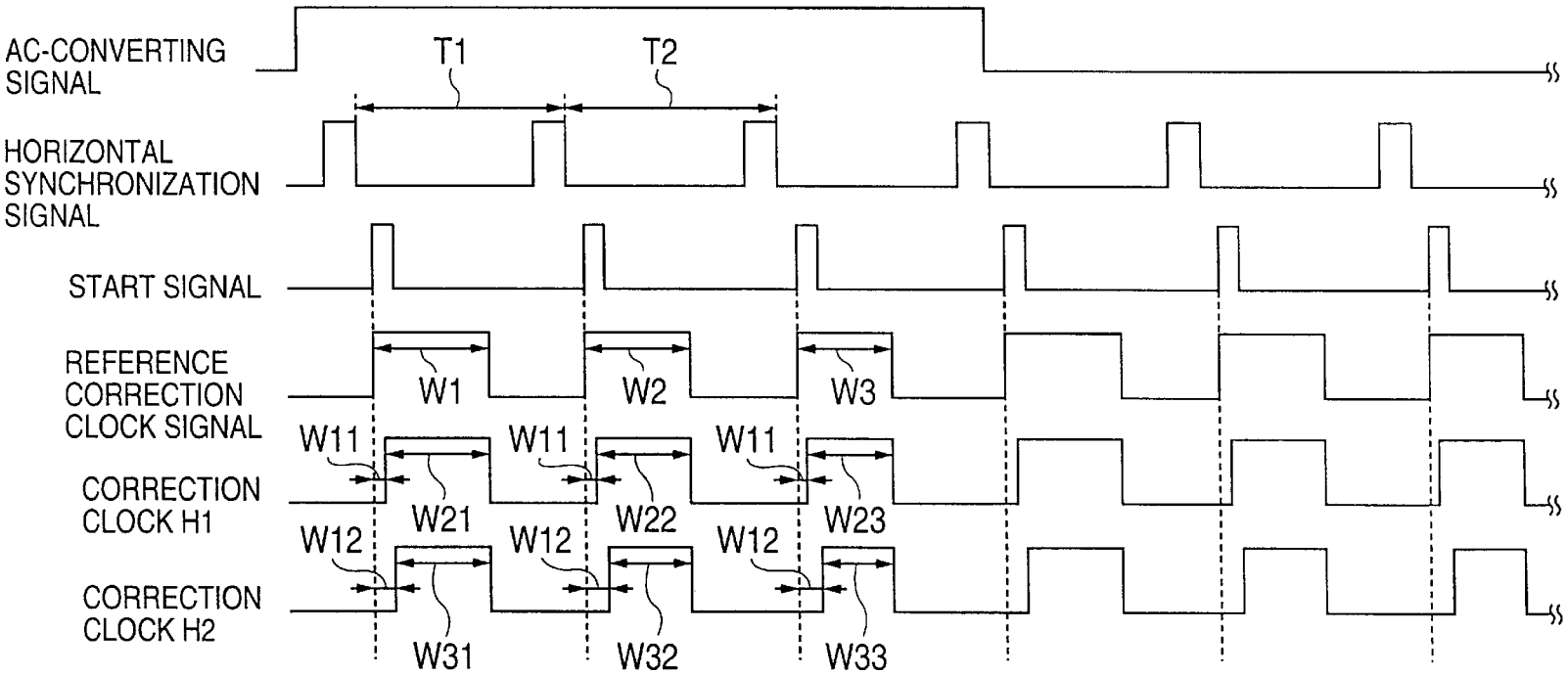
FIG. 32 is a timing chart showing the relationship between reference correction clock signal and correction clock signal in the correction clock forming circuit 200 shown in FIG. 30.

FIG. 31 shows voltage waveforms of various portions of the correction clock forming circuit 200 shown in FIG. 30, and FIG. 32 illustrates the relationship between the reference correction clock signal and the correction clock signal. In FIG. 31, the period between rise and fall of the horizontal synchronization signal becomes the horizontal scanning period T1, and the period between the end of the horizontal scanning period T1 and the next fall of the horizontal synchronization signal becomes the horizontal scanning period T2. The reference correction clock signal which is the output of the correction clock forming circuit remains at high level for a period from rise of the start signal in the horizontal scanning period T1 until the correction base clock falls eight times. The pulse width of the reference correction clock becomes W1. In the next horizontal scanning period T2, the reference correction clock signal remains at high level for a period from rise of the start signal until the correction base clock falls seven times. The pulse width of the reference correction clock becomes W21.

When the 3-bit counter 211 is reset by the horizontal synchronization signal, outputs C1, C2, C3 of the 3-bit counter 211 become high level. The 3-bit counter 211 counts down according to the correction base clock signal. The outputs S1, S2, S3 which are turned to high level by the start signal fall successively upon the correction base clock. Pulse widths of the outputs S1, S2, S3 become longer in this order, being W11, W12, W13, respectively. When the output S1 falls, the correction clock signal H1 rises and remains at high level till the reference correction clock signal falls. Pulse width of the correction clock signal H1 in horizontal scanning period becomes W21 which is the pulse width W1 minus W11, and becomes W22 which is the pulse width W2 minus W11 in the horizontal scanning period T2.

Pulse widths W31, W32, W41, W42 of the correction clock signals H2, H3 in horizontal scanning periods T1, T2 are given by equations (1) through (4).

$$W31=W1-W12 \quad (1)$$

$$W32=W2-W12 \quad (2)$$

$$W41=W1-W13 \quad (3)$$

$$W42=W2-W13 \quad (4)$$

The correction clock signals H successively rise in response to the fall of the output S, and remain at high level until the reference correction clock signal falls.

Figure 33A:
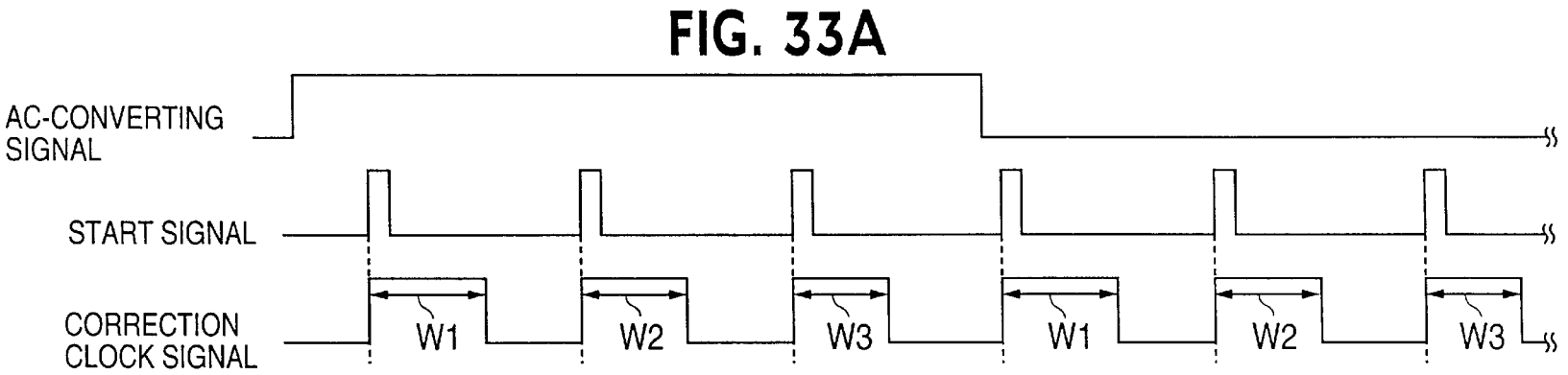
FIGS. 33A and 33B show the relationship between the AC-converting signal, the start signal and the correction clock signal in the seventh embodiment and in the first embodiment.
Figure 33B:
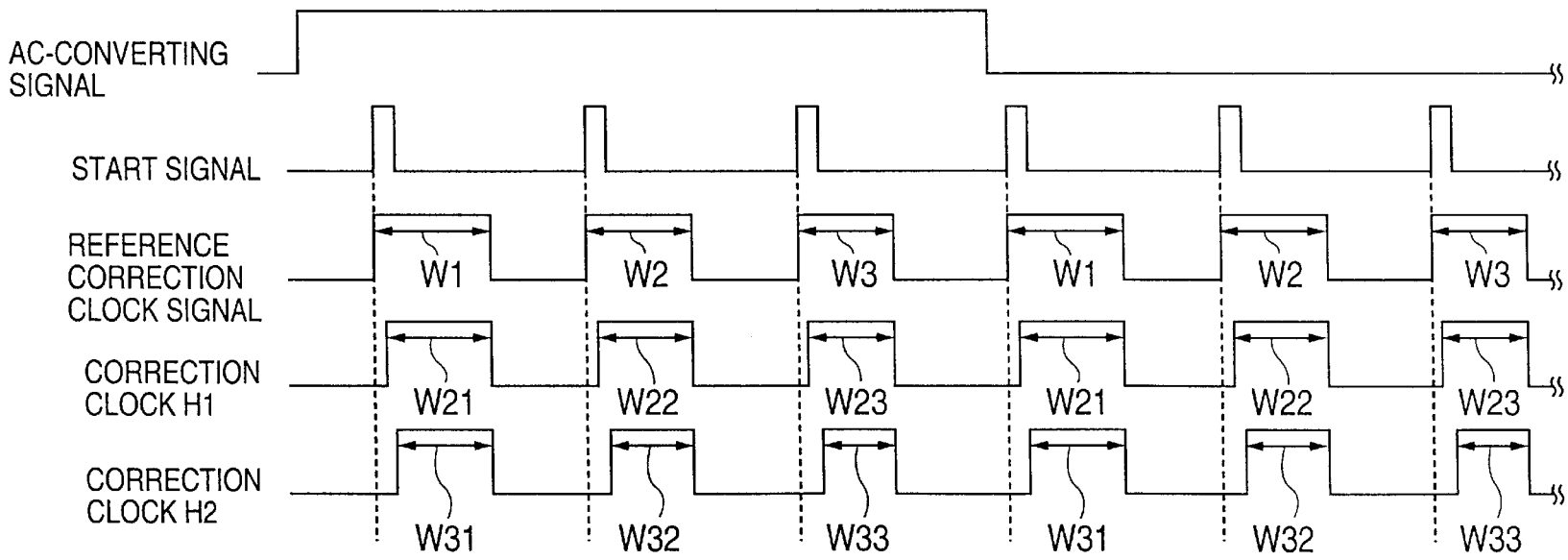

FIG. 33 shows the relationship between the AC-converting signal, the start signal and the correction clock signal in this embodiment and the first embodiment. Although the number of scanning lines is assumed to be 3 for the convenience of description, it is usually 480, for example. (1) is a timing chart which is almost identical with the timing chart shown in FIG. 4. Such correction clock signals are successively output as the pulse width thereof decreases successively as W1, W2 and W3, every time the start signal rises in a period when, for example, the AC-converting signal is high level.

(2) is a timing chart of this embodiment. Similarly to (1), the pulse width thereof decreases successively as W21, W22 and W23, every time the start signal rises in a period when, for example, the AC-converting signal is high level, and the pulse width of the correction clock signal in one horizontal scanning period decreases successively as W1, W21, W31 as the distance from the common side drive circuit increases in the order of the correction clock signals H1, H2, . . . .

Figure 34:
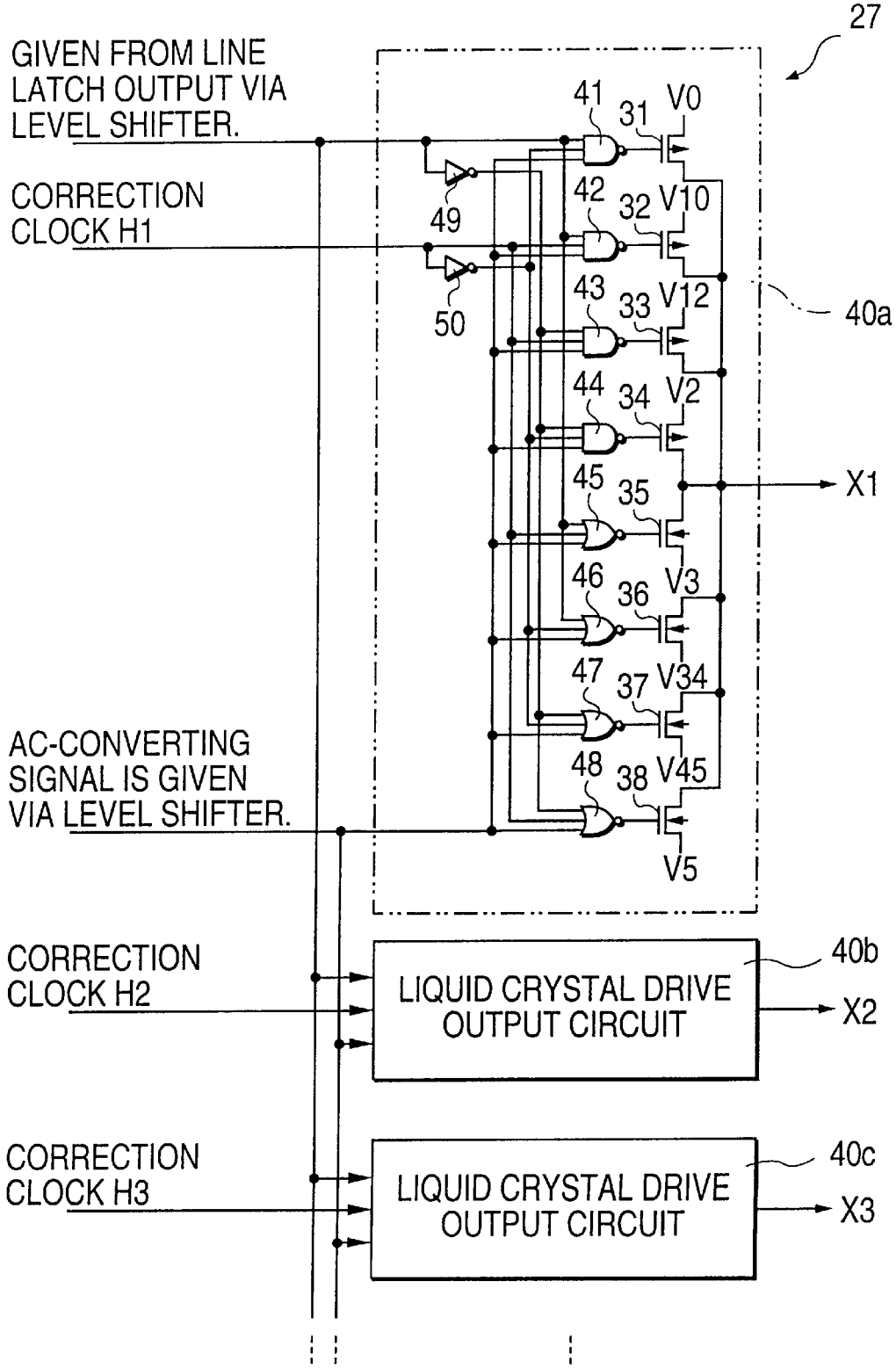
FIG. 34 is an electric circuit diagram showing one portion of the liquid crystal drive output circuit 27 shown in FIG. 2.

FIG. 34 shows a part of the liquid crystal drive output circuit 27 shown in FIG. 2. Provided in the liquid crystal drive output circuit 27 are output circuit portions 40*a*, 40*b*, 40*c*, . . . of the same configuration as the output circuit portions 40 shown in FIG. 3, individually in correspondence with the segment electrodes. The output circuit portions 40 receive a line latch output and an AC-converting signal via level shifters. In case a correction period is specified for every segment electrode, the liquid crystal drive output circuit 27 is supplied with different correction clock signals H of the same number as that of the output circuit portions 40 included in the liquid crystal drive output circuit 27.

Figure 35:
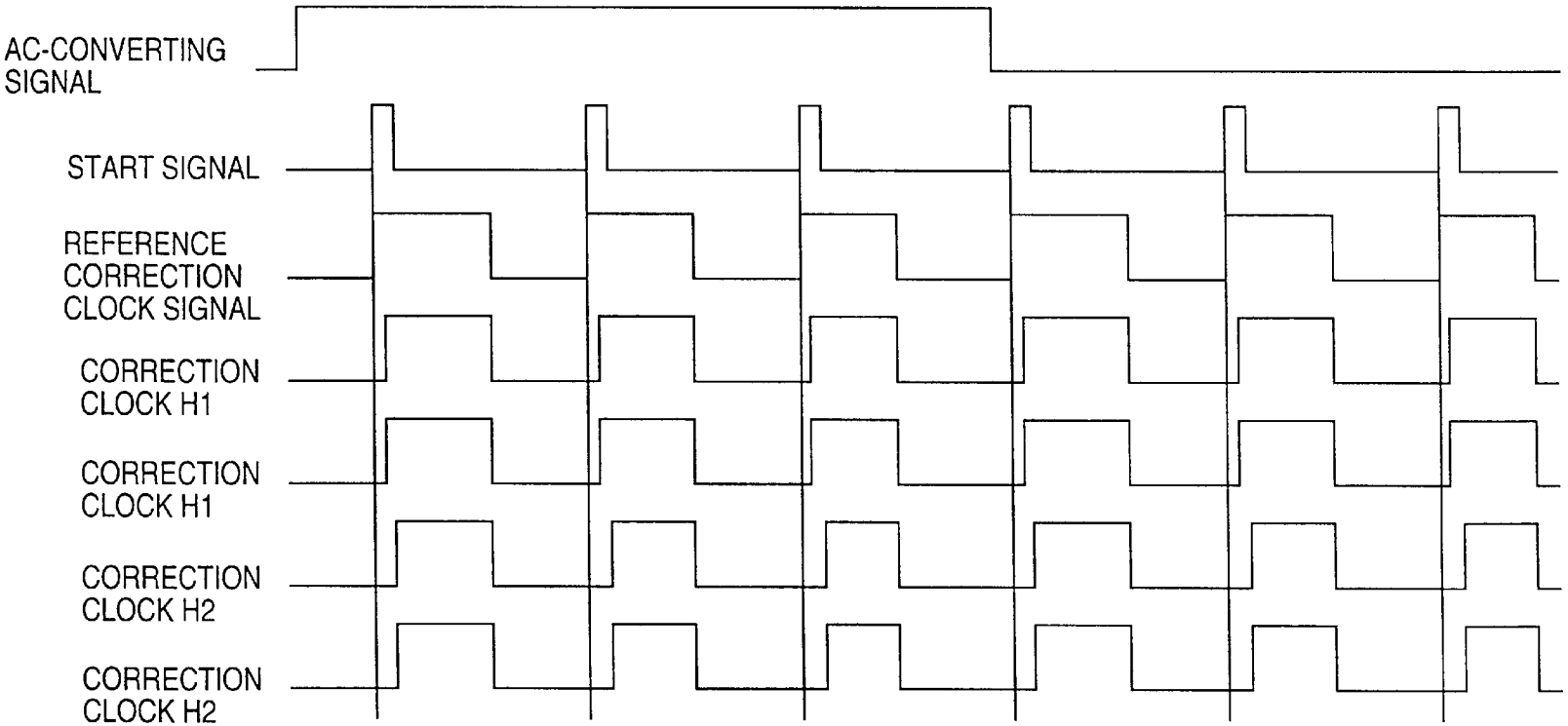
FIG. 35 is a timing chart of a case where pulse width of correction clock signal is changed at intervals of every two segment electrodes.

FIG. 35 shows the relationship between the signals in case the pulse width of the correction clock signal is changed at every two segment electrodes, not at every segment electrode as shown in FIG. 34. Adjustment by changing the pulse width of the correction clock signal can also be carried out at intervals of a plurality of segment electrodes. When there are a large number of segment electrodes, it is difficult to change the pulse width at every segment electrode as shown in FIG. 34. Also when there are a large number of segment electrodes, adjacent segment electrodes have little difference in the distance from the common side drive circuit. Therefore, it is desirable to change the pulse width of the correction clock signal at intervals of a plurality of segment electrodes when there are a large number of segment electrodes.

Figure 36:
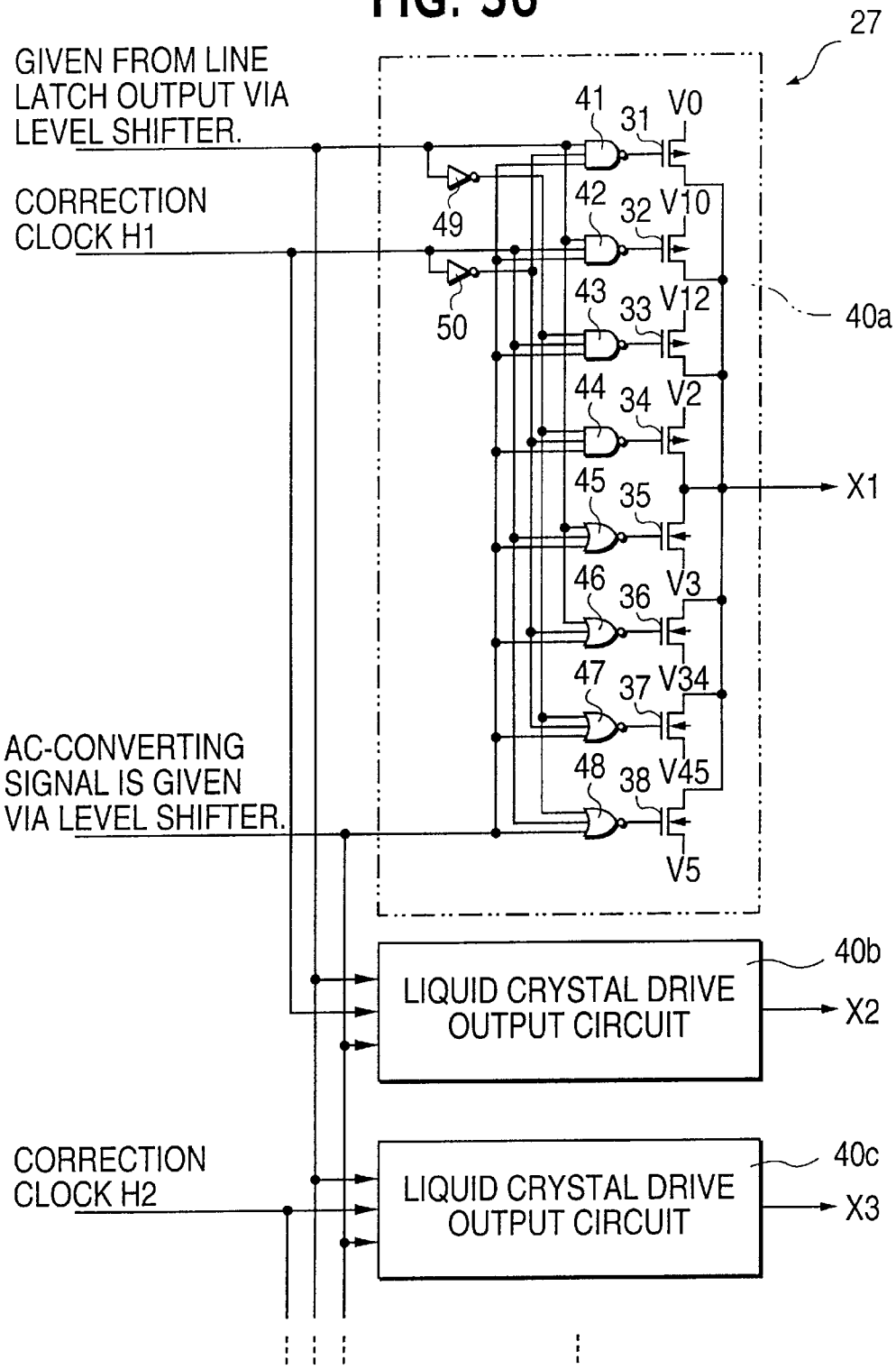
FIG. 36 is an electric circuit diagram showing a part of the liquid crystal drive output circuit 27 in case where pulse width of the correction clock signal is changed at intervals of every two segment electrodes in the seventh embodiment.

FIG. 36 shows a part of the liquid crystal drive output circuit 27 in case the pulse width of the correction clock signal is changed at intervals of two segment electrodes. The configuration shown in FIG. 36 is similar to the configuration shown in FIG. 34, and therefore corresponding components are denoted with the same reference numerals and similar description will be omitted. Correction clock signal H1 is given commonly to the output circuit portion 40a which outputs a voltage to the segment electrode X1 and to the output circuit portion 40*b* which outputs a voltage to the segment electrode X2. Correction clock signal H2 is given to the output circuit portion 40*c* which outputs a voltage to the segment electrode X3.

Figure 37:
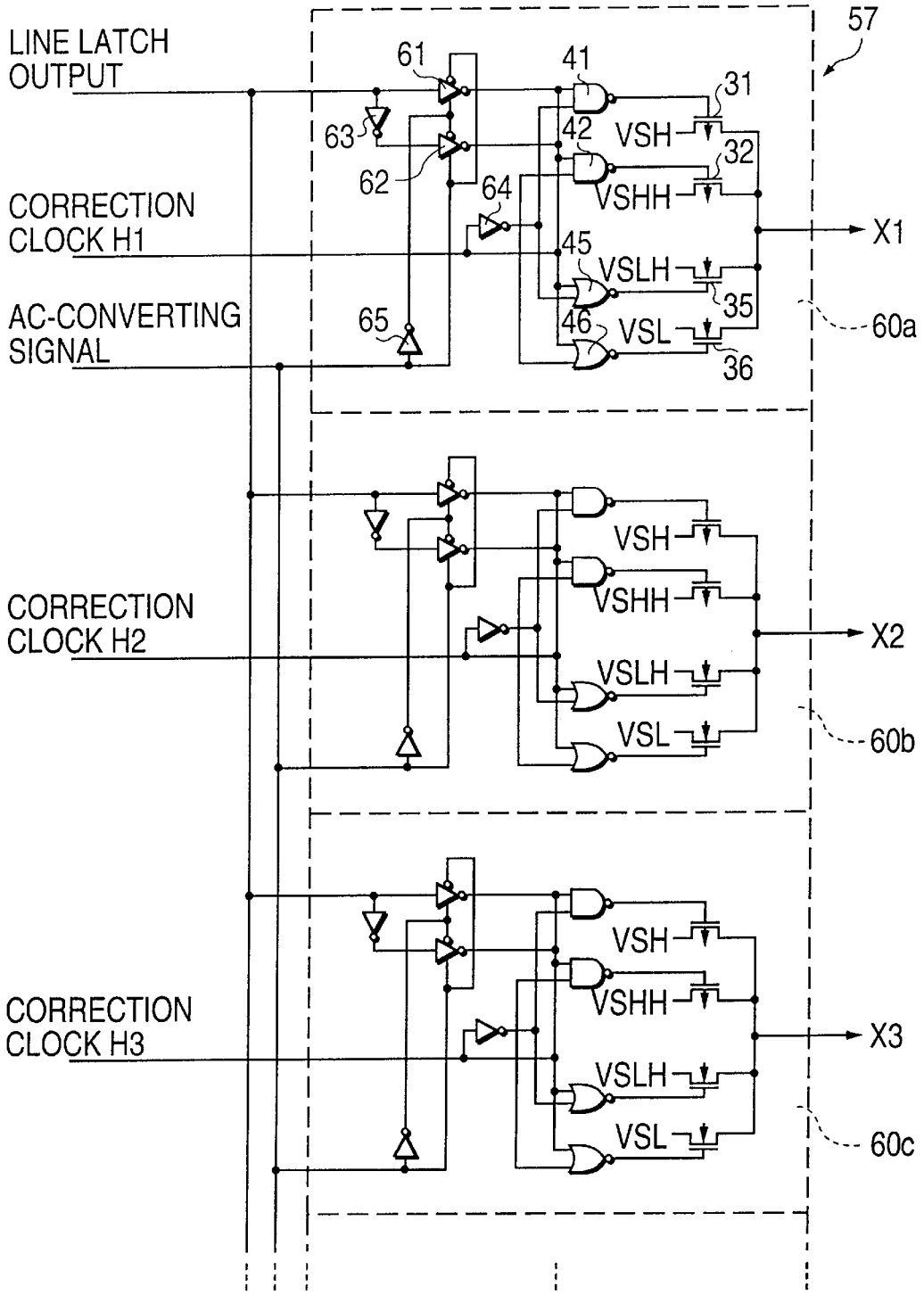
FIG. 37 is an electric circuit diagram showing a part of the liquid crystal drive output circuit 57 in case where 5V drive method is applied to the seventh embodiment, as eighth embodiment of the invention.

FIG. 37 shows a part of the liquid crystal drive output circuit 57 in case 5V drive method is applied to the seventh embodiment, as an eighth embodiment of the invention. Provided in the liquid crystal drive output circuit 57 are output circuit portions 60*a*, 60*b*, 60*c*, . . . of the same configuration as the output circuit portions 60 shown in FIG. 11, individually in correspondence with the segment electrodes X1, X2, X3, . . . The output circuit portions 60 receive a line latch output and an AC-converting signal via level shifters. In case a correction period is specified for every segment electrode, different correction clock signals H of the same number as that of the output circuit portions 60 are supplied successively.

Figure 38:
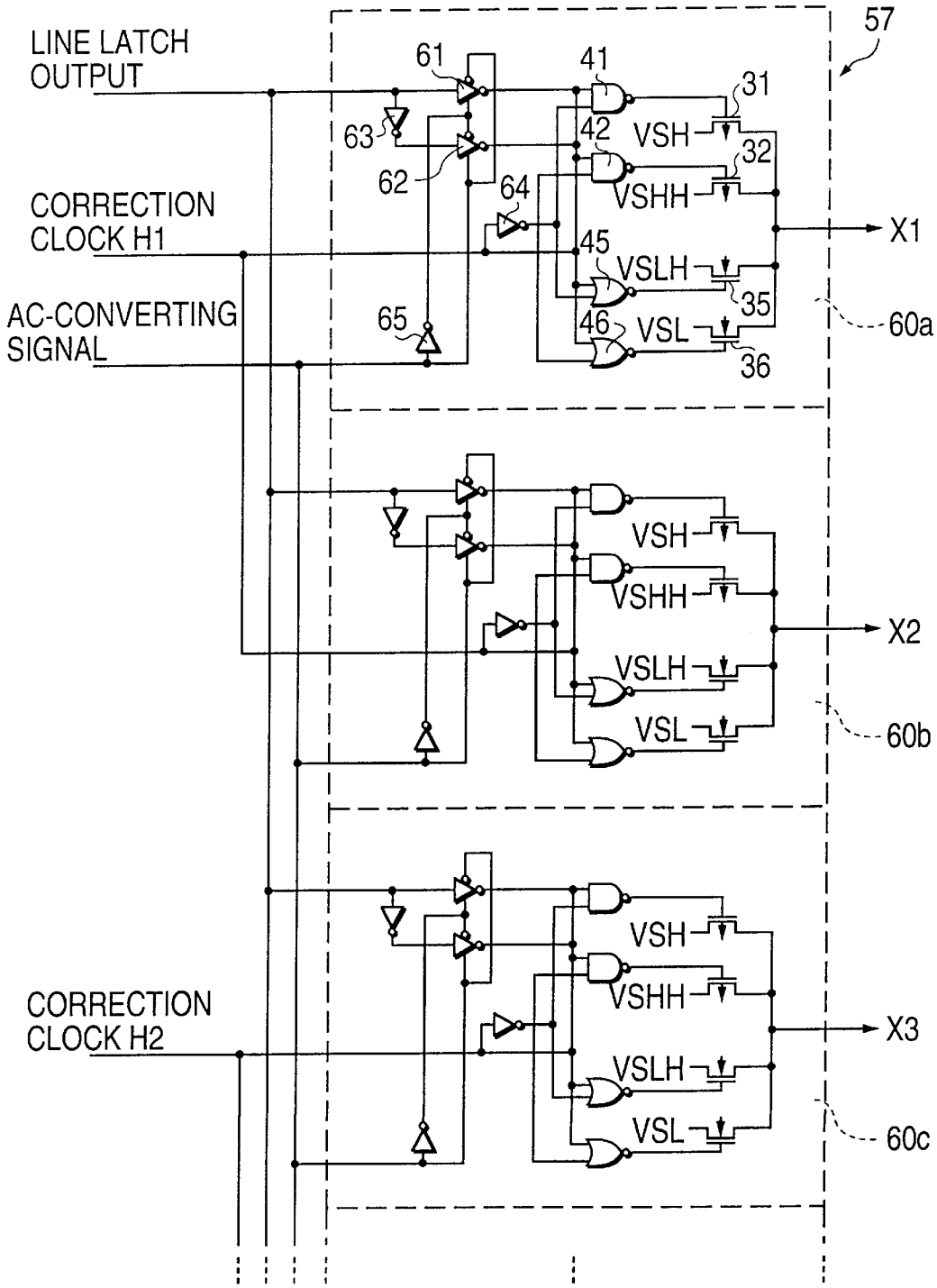
FIG. 38 is an electric circuit diagram showing a part of the liquid crystal drive output circuit 57 in case where pulse width of the correction clock signal is changed at intervals of every two segment electrodes in the seventh embodiment.

FIG. 38 shows a part of the liquid crystal drive output circuit 57 in case the pulse width of the correction clock signal is changed at intervals of two segment electrodes. The configuration shown in FIG. 38 is similar to the configuration shown in FIG. 37, and therefore corresponding components are denoted with the same reference numerals and similar description will be omitted. Correction clock signal H1 is given commonly to the output circuit portion 60a which outputs a voltage to the segment electrode X1 and to the output circuit portion 60*b* which outputs a voltage to the segment electrode X2. Correction clock signal H2 is given to the output circuit portion 60*c* which outputs a voltage to the segment electrode X3.

Adjustment of changing the pulse width of the correction clock signal can also be carried out at intervals of two or more segment electrodes. When there are a large number of segment electrodes, it is difficult to change the pulse width for every segment electrode as shown in FIG. 37. Also when there are a large number of segment electrodes, adjacent segment electrodes have little difference in the distance from the common side drive circuit. Therefore, it is desirable to change the pulse width of the correction clock signal at intervals of a plurality of segment electrodes when there are a large number of segment electrodes.

Although a liquid crystal panel of simple matrix type is driven in the embodiments described above, the present invention can be applied to other types of liquid crystal panels such as active matrix type.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A drive device for driving a liquid crystal display apparatus in which a segment side drive circuit for driving a plurality of pixel columns in parallel according to display data and a common side drive circuit for sequentially selecting and driving scanning lines in a pixel line direction in every scanning period are arranged in the periphery of a liquid crystal panel, the drive device comprising:

correction period setting means for setting a correction period during which a level of an output voltage of the segment side drive circuit is corrected in every scanning period so that an effective value thereof decreases during ON display and increases during OFF display; and output control means for adjusting an amount of correction for the output voltage of the segment side drive circuit according to a distance between the segment side drive circuit and a scanning line selected by the common side drive circuit in the liquid crystal panel, wherein the correction period setting means controls the correction period so that the correction period decreases as the distance of each pixel column from the common side drive circuit increases.

2. The drive device for driving a liquid crystal display apparatus of claim 1, wherein the output control means adjusts the amount of correction for the output voltage to drive each pixel column by the segment side drive circuit, according to a distance of each pixel column from the common side drive circuit.

3. The drive device for driving a liquid crystal display apparatus of claim 2, wherein the correction period setting means decreases the correction period for each of the plurality of pixel columns.

4. The drive device for driving a liquid crystal display apparatus of any one of claims 1 to 3, wherein the output control means changes the output voltage level of the segment side drive circuit to an intermediate level between an ON display level and an OFF display level.

5. The drive device for driving a liquid crystal display apparatus of claim 4, wherein the output control means makes the intermediate level identical with that of a nonselection voltage, derived for a non-selected scanning line, from the common side drive circuit.

6. The drive device for driving a liquid crystal display apparatus of claim 4, wherein the output control means controls an amount of change in the voltage of the intermediate level such that the amount of change decreases as the distance between the segment side drive circuit and the scanning line selected by the common side drive circuit in the liquid crystal panel increases.

7. The drive device for driving a liquid crystal display apparatus of claim 4, wherein the output control means controls the intermediate level to be changed in the correction period in different ways, depending upon whether the output voltage from the segment side drive circuit is at the ON display voltage level or at the OFF display voltage level.

8. The drive device for driving a liquid crystal display apparatus of claim 1, wherein the output control means changes the output voltage level of the segment side drive circuit, to an OFF display level during ON display and to an ON display level during OFF display, during the correction period.

9. The drive device for driving a liquid crystal display apparatus of claim 2, wherein the output control means changes the output voltage level of the segment side drive circuit to an OFF display level during ON display and to an ON display level during OFF display, during the correction period.

10. The drive device for driving a liquid crystal display apparatus of claim 1, wherein the output control means controls the correction period to decrease as the distance between the segment side drive circuit and the scanning line selected by the common side drive circuit in the liquid crystal panel increases.

11. The drive device for driving a liquid crystal display apparatus of claim 2, wherein the output control means controls the correction period to decrease as the distance between the segment side drive circuit and the scanning line selected by the common side drive circuit in the liquid crystal panel increases.

12. The drive device for driving a liquid crystal display apparatus of claim 2, wherein the output control means controls the correction period to decrease as the distance between the segment side drive circuit and the scanning line selected by the common side drive circuit in the liquid crystal panel increases.

13. The drive device for driving a liquid crystal display apparatus of claim 3, wherein the output control means controls the correction period to decrease as the distance between the segment side drive circuit and the scanning line selected by the common side drive circuit in the liquid crystal panel increases.

14. A drive method for driving a liquid crystal display apparatus in which a segment side drive circuit for driving a plurality of pixel columns in parallel according to display data and a common side drive circuit for sequentially selecting driving scanning lines in a pixel line direction in every scanning period are arranged in the periphery of a liquid crystal panel, the drive method comprising the steps of:

setting at least one correction period during which a level of an output voltage of the segment side drive circuit is corrected so that an effective value of the output voltage decreases during ON display and increases during OFF display;

adjusting an amount of correction for the output voltage of the segment side drive circuit according to a distance between the segment side drive circuit and a scanning line selected by the common side drive circuit in the liquid crystal panel; and decreasing the correction period as the distance between the segment side drive circuit and the scanning line selected by the common side drive circuit increases.

15. The drive method for driving a liquid crystal display apparatus of claim 14, wherein the amount of correction is adjusted according to the distance of each pixel column from the common side drive circuit.

16. The drive method for driving a liquid crystal display apparatus of claim 14 or 15, wherein in the correction period, the output voltage level of the segment side drive circuit is changed to an intermediate level between an ON display level and an OFF display level.

17. The drive method for driving a liquid crystal display apparatus of claim 14 or 15, wherein in the correction period, the output voltage level of the segment side drive circuit is changed to an OFF level during ON display and to an ON display level during OFF display.

18. The drive method of claim 16, further comprising the step of:

decreasing the amount of change in the voltage of the intermediate level as the distance between the segment side drive circuit and the scanning line selected by the common side drive circuit increases.

* * * * *